US009802631B2

(12) United States Patent
Matthews et al.

(10) Patent No.: US 9,802,631 B2
(45) Date of Patent: Oct. 31, 2017

(54) ROUTE EXAMINING SYSTEM

(71) Applicant: General Electric Company, Schenectady, NY (US)

(72) Inventors: Brett Alexander Matthews, Niskayuna, NY (US); Gregory Boverman, Niskayuna, NY (US); Yuri Alexeyevich Plotnikov, Niskayuna, NY (US); Frederick Wilson Wheeler, Niskayuna, NY (US); Majid Nayeri, Niskayuna, NY (US); Jeffrey Michael Fries, Grain Valley, MO (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 15/047,083

(22) Filed: Feb. 18, 2016

(65) Prior Publication Data

US 2016/0194012 A1 Jul. 7, 2016

Related U.S. Application Data

(63) Continuation-in-part of application No. 14/527,246, filed on Oct. 29, 2014, now Pat. No. 9,481,384, which (Continued)

(51) Int. Cl.
*B61L 3/10* (2006.01)
*B61L 23/04* (2006.01)

(52) U.S. Cl.
CPC ..... *B61L 23/044* (2013.01); *B61L 3/10* (2013.01)

(58) Field of Classification Search
CPC ..... B61L 23/044; B61L 3/10
See application file for complete search history.

(56) References Cited

U.S. PATENT DOCUMENTS 4,100,795 A 7/1978 Panetti
5,386,727 A 2/1995 Searle
(Continued)

FOREIGN PATENT DOCUMENTS

CN 101351373 A 1/2009
JP 2002294609 A 10/2002
(Continued)

OTHER PUBLICATIONS

High-Speed Rail IDEA Program, Feasibility of Locomotive-Mounted Broken Rail Detection, Jun. 2004.
(Continued)

*Primary Examiner* — Truc M Do
*Assistant Examiner* — Jess Whittington
(74) *Attorney, Agent, or Firm* — Nitin N. Joshi

(57) ABSTRACT

Systems for examining a route inject one or more electrical examination signals into a conductive route from onboard a vehicle system traveling along the route, detect one or more electrical characteristics of the route based on the one or more electrical examination signals, and detect a break in conductivity of the route responsive to the one or more electrical characteristics decreasing by more than a designated drop threshold for a time period within a designated drop time period. Feature vectors may be determined for the electrical characteristics and compared to one or more patterns in order to distinguish between breaks in the conductivity of the route and other causes for changes in the electrical characteristics.

16 Claims, 17 Drawing Sheets

Related U.S. Application Data is a continuation-in-part of application No. 14/016,310, filed on Sep. 3, 2013, now Pat. No. 8,914,171.

(60) Provisional application No. 62/165,007, filed on May 21, 2015, provisional application No. 62/161,626, filed on May 14, 2015, provisional application No. 61/729,188, filed on Nov. 21, 2012.

(56) References Cited

U.S. PATENT DOCUMENTS

| | | | | |
|---|---|---|---|---|
| 5,777,891 | A | 7/1998 | Pagano et al. | |
| 6,262,573 | B1 * | 7/2001 | Wojnarowski | B61K 9/10 324/217 |
| 8,914,171 | B2 | 12/2014 | Noffsinger et al. | |
| 9,108,640 | B2 | 8/2015 | Jackson | |
| 2001/0019263 | A1 * | 9/2001 | Kwun | G01N 29/11 324/217 |
| 2003/0038216 | A1 * | 2/2003 | Holgate | B61L 23/044 246/122 R |
| 2005/0076716 | A1 | 4/2005 | Turner | |
| 2006/0076461 | A1 * | 4/2006 | DeRose | B61K 9/00 246/122 R |
| 2007/0233335 | A1 | 10/2007 | Kumar et al. | |
| 2008/0105791 | A1 * | 5/2008 | Karg | B61K 9/10 246/120 |
| 2011/0284700 | A1 * | 11/2011 | Brand | B61L 15/0036 246/28 R |
| 2013/0284859 | A1 * | 10/2013 | Polivka | B61L 27/0055 246/34 R |
| 2014/0125356 | A1 | 5/2014 | Cooper et al. | |
| 2014/0138493 | A1 | 5/2014 | Noffsinger et al. | |

FOREIGN PATENT DOCUMENTS

| | | | | |
|---|---|---|---|---|
| JP | 2002294609 | * | 12/2002 | E01B 35/00 |
| WO | 2006/065730 | A2 | 6/2006 | |
| WO | 2014193610 | A1 | 12/2014 | |

OTHER PUBLICATIONS

Maldonado et al., "Autonomous Broken Rail Detection Technology for Use on Revenue Service Trains", U.S. Department of transportation, Federal Railroad Administration, Dec. 2014.

Dick, C. T., Barkan, C. P., Chapman, E. R., Stehly, M. P., (2003). "Multivariate statistical model for predicting occurrence and location of broken rails". Transportation Research Record: Journal of the Transplantation Research Board, 1825(1), 48-55.

Dick, C. T., Barkan, C. P., Chapman, E. R., Stehly, M. P., "Predicting the Occurrence of Broken Rails: A Quantitative Approach". (2000); In: Proceedings of the American railway engineering and maintenance of way association annual conference.

Schafer II, D. H. (2008). "Effect of Train Length on Railroad Accidents and a Quantitative Analysis of Factors Affecting Broken Rails". Thesis, University of Illinois at Urbana-Champaign.

Jared Klineman Cooper et al., filed Jul. 30, 2013, U.S. Appl. No. 13/954,096.

Joseph Forrest Noffsinger et al., filed Mar. 19, 2016, U.S. Appl. No. 15/075,118.

Joseph Forrest Noffsinger et al., filed May 6, 2016, U.S. Appl. No. 15/148,570.

Jared Klineman Cooper et al., filed Jan. 15, 2014 , U.S. Appl. No. 14/155,454.

Unofficial English Translation of Chinese Office Action issued in connection with Related CN Application No. 201380071077.1 dated Feb. 6, 2016.

* cited by examiner

ROUTE EXAMINING SYSTEM

CROSS-REFERENCE TO RELATED APPLICATIONS

This application claims priority to U.S. Provisional Application No. 62/165,007, filed 21 May 2015 (the "'007 Application") and to U.S. Provisional Application No. 61/161,626, filed 14 May 2015 (the "'093 Application"). This application also is a continuation-in-part of U.S. application Ser. No. 14/527,246, filed 29 Oct. 2014 (the "'246 Application"), which is a continuation-in-part of and claims priority to U.S. application Ser. No. 14/016,310, filed 3 Sep. 2013 (the "'310 Application," now U.S. Pat. No. 8,914,171), which claims priority to U.S. Provisional Application No. 61/729,188, filed on 21 Nov. 2012 (the "'188 Application"). The entire disclosures of the '007 Application, the '626 Application, the '093 Application, the '246 Application, the '188 Application, and the '310 Application are incorporated by reference.

GOVERNMENT LICENSE RIGHTS

This invention was made with Government support under contract number DTFR5314C00021 awarded by GOVT. The Government has certain rights in this invention.

FIELD

Embodiments of the subject matter disclosed herein relate to examining routes traveled by vehicles for damage to the routes and/or to determine information about the routes and/or vehicles.

BACKGROUND

Routes that are traveled by vehicles may become damaged over time with extended use. For example, tracks on which rail vehicles travel may become damaged and/or broken. A variety of known systems are used to examine rail tracks to identify where the damaged and/or broken portions of the track are located. For example, some systems use cameras, lasers, and the like, to optically detect breaks and damage to the tracks. The cameras and lasers may be mounted on the rail vehicles, but the accuracy of the cameras and lasers may be limited by the speed at which the rail vehicles move during inspection of the route. As a result, the cameras and lasers may not be able to be used during regular operation (e.g., travel) of the rail vehicles in revenue service.

Other systems use ultrasonic transducers that are placed at or near the tracks to ultrasonically inspect the tracks. These systems may require very slow movement of the transducers relative to the tracks in order to detect damage to the track. When a suspect location is found by an ultrasonic inspection vehicle, a follow-up manual inspection may be required for confirmation of defects using transducers that are manually positioned and moved along the track and/or are moved along the track by a relatively slower moving inspection vehicle. Inspections of the track can take a considerable amount of time, during which the inspected section of the route may be unusable by regular route traffic.

Other systems use human inspectors who move along the track to inspect for broken and/or damaged sections of track. This manual inspection is slow and prone to errors.

Other systems use wayside devices that send electric signals through the tracks. If the signals are not received by other wayside devices, then a circuit that includes the track is identified as being open and the track is considered to be broken. These systems are limited at least in that the wayside devices are immobile. As a result, the systems cannot inspect large spans of track and/or a large number of devices must be installed in order to inspect the large spans of track. These systems are also limited at least in that a single circuit could stretch for multiple miles. As a result, if the track is identified as being open and is considered broken, it is difficult and time-consuming to locate the exact location of the break within the long circuit. For example, a maintainer must patrol the length of the circuit to locate the problem.

These systems are also limited at least in that other track features, such as highway (e.g., hard wire) crossing shunts, wide band (e.g., capacitors) crossing shunts, narrow band (e.g., tuned) crossing shunts, switches, insulated joints, and turnouts (e.g., track switches) may emulate the signal response expected from a broken rail and provide a false alarm. For example, scrap metal on the track, crossing shunts, etc., may short the rails together, preventing the current from traversing the length of the circuit, indicating that the circuit is open. Additionally, insulated joints and/or turnouts may include intentional conductive breaks that create an open circuit. In response, the system may identify a potentially broken section of track, and a person or machine may be dispatched to patrol the circuit to locate the break, even if the detected break is a false alarm (e.g., not a break in the track). A need remains to reduce the probability of false alarms to make route maintenance more efficient.

Some vehicle location determination systems may be unable to determine locations of the vehicle systems in some circumstances. For example, during initialization of the location determination systems, the vehicle system may be unable to determine the location of the vehicle system. During travel of the vehicle system in certain locations such as tunnels, valleys, urban areas, etc., the location determination systems may be unable to determine the locations of the vehicle systems. An improved manner for determining locations of vehicle systems is needed.

BRIEF DESCRIPTION

In one embodiment, a system (e.g., a route examining system) includes a first application unit configured to inject a first electrical examination signal into a conductive route from onboard a vehicle system traveling along the route, a first detection unit configured to detect a first electrical characteristic of the route based on the first electrical examination signal, and one or more processors configured to detect a break in conductivity of the route responsive to the first electrical characteristic decreasing by more than a designated drop threshold for a time period within a designated drop time period.

In another embodiment, a system (e.g., a route examining system) includes first and second application units, first and second detection units, and one or more processors. The first application unit is configured to be disposed onboard a vehicle traveling along a route having plural conductive rails. The first application unit is configured to inject a first electrical examination signal having one or more of a first frequency or a first unique identifier into a first rail of the plural conductive rails. The second application unit is configured to be disposed onboard the vehicle and to inject a second electrical examination signal having one or more of a different, second frequency or a different, second unique identifier into a second rail of the plural conductive rails. The first detection unit is configured to be disposed onboard the vehicle and to measure a first electrical characteristic of the first rail based on the first electrical examination signal and to measure a second electrical characteristic of the first rail based on the second electrical examination signal. The second detection unit is configured to be disposed onboard the vehicle and to measure a third electrical characteristic of the second rail based on the first electrical examination signal and to measure a fourth electrical characteristic of the second rail based on the second electrical examination signal. The one or more processors are configured to detect a break in conductivity of one or more of the first rail or the second rail of the route responsive to one or more of the first electrical characteristic, the second electrical characteristic, the third electrical characteristic, or the fourth electrical characteristic decreasing by more than a designated drop threshold for a time period that is within a designated drop time period.

In one embodiment, a method (e.g., for examining a route) includes injecting a first electrical examination signal into a conductive route from onboard a vehicle system traveling along the route, detecting a first electrical characteristic of the route based on the first electrical examination signal, and detecting a break in conductivity of the route responsive to the first electrical characteristic decreasing by more than a designated drop threshold for a time period within a designated drop time period.

In an embodiment, a method (e.g., for examining a route and/or determining information about the route and/or a vehicle system) includes injecting a first electrical examination signal into a conductive route from onboard a vehicle system traveling along the route, detecting a first electrical characteristic of the route based on the first electrical examination signal, and detecting, using a route examining system that also is configured to detect damage to the route based on the first electrical characteristic, a first frequency tuned shunt in the route based on the first electrical characteristic.

In an embodiment, a system (e.g., a route examining system) includes a first application unit configured to inject a first electrical examination signal into a conductive route from onboard a vehicle system traveling along the route, a first detection unit configured to measure a first electrical characteristic of the route based on the first electrical examination signal, and an identification unit configured to detect damage to the route based on the first electrical characteristic and to detect a first frequency tuned shunt in the route based on the first electrical characteristic.

In an embodiment, a system (e.g., a route examining system) includes a first application unit configured to inject a first electrical signal having a first frequency into a first conductive rail of a route from onboard a vehicle system, a first detection unit configured to monitor a first characteristic of the first conductive rail of the route from onboard the vehicle system based on the first electrical signal, a second application unit configured to inject a second electrical signal having a different, second frequency into a second conductive rail of the route from onboard the vehicle system, a second detection unit configured to monitor a second characteristic of the second conductive rail of the route from onboard the vehicle system based on the second electrical signal, and an identification unit configured to detect damage to the route and to determine one or more of identify the route from several different routes, determine a location of the vehicle system along the route, determine a direction of travel of the vehicle system, determine a speed of the vehicle system, or identify a missing or damaged frequency tuned shunt based on one or more of the first or second characteristic.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
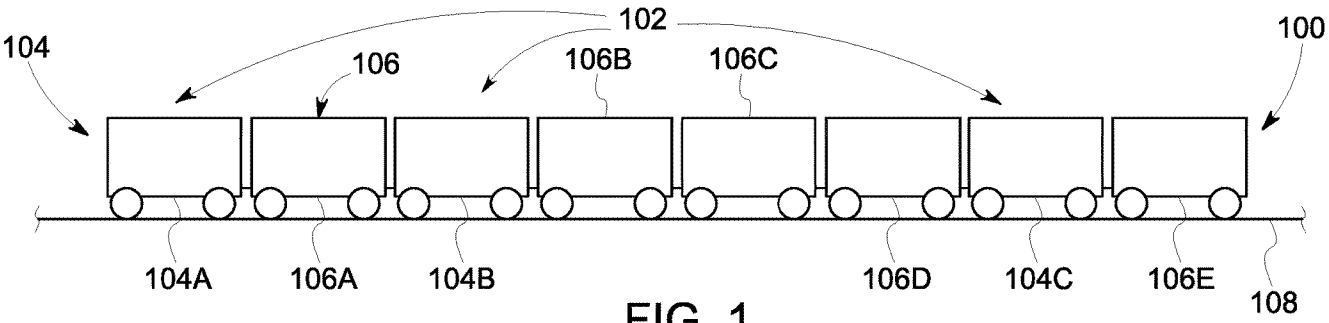
FIG. 1 is a schematic illustration of a vehicle system that includes an embodiment of a route examining system.

Embodiments of the inventive subject matter described herein relate to systems for examining a route being traveled upon by a vehicle system in order to identify potential sections of the route that are damaged or broken. In an embodiment, the vehicle system may examine the route by injecting an electrical signal into the route from a first vehicle in the vehicle system as the vehicle system travels along the route and monitoring the route at another, second vehicle that also is in the vehicle system. Detection of the signal at the second vehicle and/or detection of changes in the signal at the second vehicle may indicate a potentially damaged (e.g., broken or partially broken) section of the route between the first and second vehicles. In an embodiment, the route may be a track of a rail vehicle system and the first and second vehicle may be used to identify a broken or partially broken section of one or more rails of the track. The electrical signal that is injected into the route may be powered by an onboard energy storage device, such as one or more batteries, and/or an off-board energy source, such as a catenary and/or electrified rail of the route. When the damaged section of the route is identified, one or more responsive actions may be initiated. For example, the vehicle system may automatically slow down or stop. As another example, a warning signal may be communicated (e.g., transmitted or broadcast) to one or more other vehicle systems to warn the other vehicle systems of the damaged section of the route, to one or more wayside devices disposed at or near the route so that the wayside devices can communicate the warning signals to one or more other vehicle systems. In another example, the warning signal may be communicated to an off-board facility that can arrange for the repair and/or further examination of the damaged section of the route.

The term "vehicle" as used herein can be defined as a mobile machine that transports at least one of a person, people, or a cargo. For instance, a vehicle can be, but is not limited to being, a rail car, an intermodal container, a locomotive, a marine vessel, mining equipment, construction equipment, an automobile, and the like. A "vehicle system" includes two or more vehicles that are interconnected with each other to travel along a route. For example, a vehicle system can include two or more vehicles that are directly connected to each other (e.g., by a coupler) or that are indirectly connected with each other (e.g., by one or more other vehicles and couplers). A vehicle system can be referred to as a consist, such as a rail vehicle consist.

"Software" or "computer program" as used herein includes, but is not limited to, one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, an application, instructions stored in a memory, part of an operating system or other type of executable instructions. "Computer" or "processing element" or "computer device" as used herein includes, but is not limited to, any programmed or programmable electronic device that can store, retrieve, and process data. "Non-transitory computer-readable media" include, but are not limited to, a CD-ROM, a removable flash memory card, a hard disk drive, a magnetic tape, and a floppy disk. "Computer memory", as used herein, refers to a storage device configured to store digital data or information which can be retrieved by a computer or processing element. "Controller," "unit," and/or "module," as used herein, can to the logic circuitry and/or processing elements and associated software or program involved in controlling an energy storage system. The terms "signal", "data", and "information" may be used interchangeably herein and may refer to digital or analog forms.

FIG. 1 is a schematic illustration of a vehicle system 100 that includes an embodiment of a route examining system 102. The vehicle system 100 includes several vehicles 104, 106 that are mechanically connected with each other to travel along a route 108. The vehicles 104 (e.g., the vehicles 104A-C) represent propulsion-generating vehicles, such as vehicles that generate tractive effort or power in order to propel the vehicle system 100 along the route 108. In an embodiment, the vehicles 104 can represent rail vehicles such as locomotives. The vehicles 106 (e.g., the vehicles 106A-E) represent non-propulsion generating vehicles, such as vehicles that do not generate tractive effort or power. In an embodiment, the vehicles 106 can represent rail cars. Alternatively, the vehicles 104, 106 may represent other types of vehicles. In another embodiment, one or more of the individual vehicles 104 and/or 106 represent a group of vehicles, such as a consist of locomotives or other vehicles.

The route 108 can be a body, surface, or medium on which the vehicle system 100 travels. In an embodiment, the route 108 can include or represent a body that is capable of conveying a signal between vehicles in the vehicle system 100, such as a conductive body capable of conveying an electrical signal (e.g., a direct current, alternating current, radio frequency, or other signal).

The examining system 102 can be distributed between or among two or more vehicles 104, 106 of the vehicle system 100. For example, the examining system 102 may include two or more components that operate to identify potentially damaged sections of the route 108, with at least one component disposed on each of two different vehicles 104, 106 in the same vehicle system 100. In the illustrated embodiment, the examining system 102 is distributed between or among two different vehicles 104. Alternatively, the examining system 102 may be distributed among three or more vehicles 104, 106. Additionally or alternatively, the examining system 102 may be distributed between one or more vehicles 104 and one or more vehicles 106, and is not limited to being disposed onboard a single type of vehicle 104 or 106. As described below, in another embodiment, the examining system 102 may be distributed between a vehicle in the vehicle system and an off-board monitoring location, such as a wayside device.

In operation, the vehicle system 100 travels along the route 108. A first vehicle 104 electrically injects an examination signal into the route 108. For example, the first vehicle 104A may apply a direct current, alternating current, radio frequency signal, or the like, to the route 108 as an examination signal. The examination signal propagates through or along the route 108. A second vehicle 104B or 104C may monitor one or more electrical characteristics of the route 108 when the examination signal is injected into the route 108.

The examining system 102 can be distributed among two separate vehicles 104 and/or 106. In the illustrated embodiment, the examining system 102 has components disposed onboard at least two of the propulsion-generating vehicles 104A, 104B, 104C. Additionally or alternatively, the examining system 102 may include components disposed onboard at least one of the non-propulsion generating vehicles 106. For example, the examining system 102 may be located onboard two or more propulsion-generating vehicles 104, two or more non-propulsion generating vehicles 106, or at least one propulsion-generating vehicle 104 and at least one non-propulsion generating vehicle 106.

In operation, during travel of the vehicle system 100 along the route 108, the examining system 102 electrically injects an examination signal into the route 108 at a first vehicle 104 or 106 (e.g., beneath the footprint of the first vehicle 104 or 106). For example, an onboard or off-board power source may be controlled to apply a direct current, alternating current, RF signal, or the like, to a track of the route 108. The examining system 102 monitors electrical characteristics of the route 108 at a second vehicle 104 or 106 of the same vehicle system 100 (e.g., beneath the footprint of the second vehicle 104 or 106) in order to determine if the examination signal is detected in the route 108. For example, the voltage, current, resistance, impedance, or other electrical characteristic of the route 108 may be monitored at the second vehicle 104, 106 in order to determine if the examination signal is detected and/or if the examination signal has been altered. If the portion of the route 108 between the first and second vehicles conducts the examination signal to the second vehicle, then the examination signal may be detected by the examining system 102. The examining system 102 may determine that the route 108 (e.g., the portion of the route 108 through which the examination signal propagated) is intact and/or not damaged.

On the other hand, if the portion of the route 108 between the first and second vehicles does not conduct the examination signal to the second vehicle (e.g., such that the examination signal is not detected in the route 108 at the second vehicle), then the examination signal may not be detected by the examining system 102. The examining system 102 may determine that the route 108 (e.g., the portion of the route 108 disposed between the first and second vehicles during the time period that the examination signal is expected or calculated to propagate through the route 108) is not intact and/or is damaged. For example, the examining system 102 may determine that the portion of a track between the first and second vehicles is broken such that a continuous conductive pathway for propagation of the examination signal does not exist. The examining system 102 can identify this section of the route as being a potentially damaged section of the route 108. In routes 108 that are segmented (e.g., such as rail tracks that may have gaps), the examining system 102 may transmit and attempt to detect multiple examination signals in order to prevent false detection of a broken portion of the route 108.

Because the examination signal may propagate relatively quickly through the route 108 (e.g., faster than a speed at which the vehicle system 100 moves), the route 108 can be examined using the examination signal when the vehicle system 100 is moving, such as transporting cargo or otherwise operating at or above a non-zero, minimum speed limit of the route 108.

Additionally or alternatively, the examining system 102 may detect one or more changes in the examination signal at the second vehicle. The examination signal may propagate through the route 108 from the first vehicle to the second vehicle. But, due to damaged portions of the route 108 between the first and second vehicles, one or more signal characteristics of the examination signal may have changed. For example, the signal-to-noise ratio, intensity, power, or the like, of the examination signal may be known or designated when injected into the route 108 at the first vehicle. One or more of these signal characteristics may change (e.g., deteriorate or decrease) during propagation through a mechanically damaged or deteriorated portion of the route 108, even though the examination signal is received (e.g., detected) at the second vehicle. The signal characteristics can be monitored upon receipt of the examination signal at the second vehicle. Based on changes in one or more of the signal characteristics, the examining system 102 may identify the portion of the route 108 that is disposed between the first and second vehicles as being a potentially damaged portion of the route 108. For example, if the signal-to-noise ratio, intensity, power, or the like, of the examination signal decreases below a designated threshold and/or decreases by more than a designated threshold decrease, then the examining system 102 may identify the section of the route 108 as being potentially damaged.

In response to identifying a section of the route 108 as being damaged or damaged, the examining system 102 may initiate one or more responsive actions. For example, the examining system 102 can automatically slow down or stop movement of the vehicle system 100. The examining system 102 can automatically issue a warning signal to one or more other vehicle systems traveling nearby of the damaged section of the route 108 and where the damaged section of the route 108 is located. The examining system 102 may automatically communicate a warning signal to a stationary wayside device located at or near the route 108 that notifies the device of the potentially damaged section of the route 108 and the location of the potentially damaged section. The stationary wayside device can then communicate a signal to one or more other vehicle systems traveling nearby of the potentially damaged section of the route 108 and where the potentially damaged section of the route 108 is located. The examining system 102 may automatically issue an inspection signal to an off-board facility, such as a repair facility, that notifies the facility of the potentially damaged section of the route 108 and the location of the section. The facility may then send one or more inspectors to check and/or repair the route 108 at the potentially damaged section. Alternatively, the examining system 102 may notify an operator of the potentially damaged section of the route 108 and the operator may then manually initiate one or more responsive actions.

Figure 2:
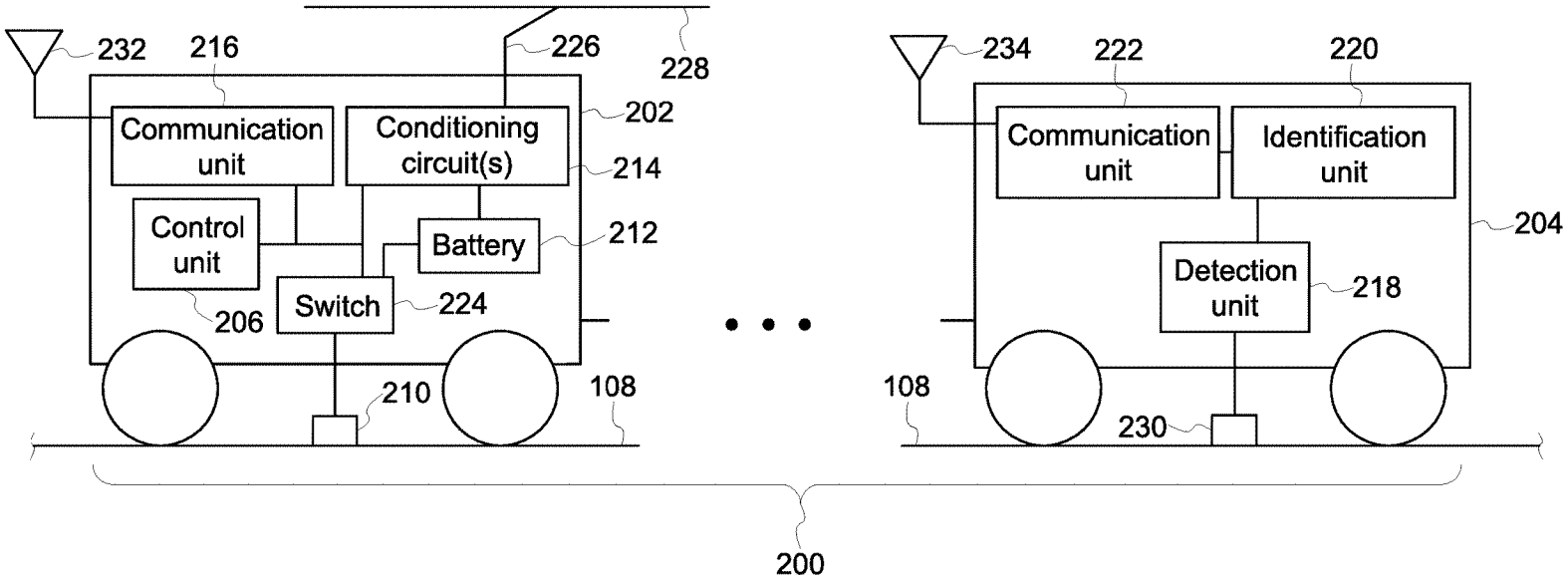
FIG. 2 is a schematic illustration of an embodiment of an examining system.

FIG. 2 is a schematic illustration of an embodiment of an examining system 200. The examining system 200 may represent the examining system 102 shown in FIG. 1. The examining system 200 is distributed between a first vehicle 202 and a second vehicle 204 in the same vehicle system. The vehicles 202, 204 may represent vehicles 104 and/or 106 of the vehicle system 100 shown in FIG. 1. In an embodiment, the vehicles 202, 204 represent two of the vehicles 104, such as the vehicle 104A and the vehicle 104B, the vehicle 104B and the vehicle 104C, or the vehicle 104A and the vehicle 104C. Alternatively, one or more of the vehicles 202, 204 may represent at least one of the vehicles 106. In another embodiment, the examining system 200 may be distributed among three or more of the vehicles 104 and/or 106.

The examining system 200 includes several components described below that are disposed onboard the vehicles 202, 204. For example, the illustrated embodiment of the examining system 200 includes a control unit 206, an application device 210, an onboard power source 212 ("Battery" in FIG. 2), one or more conditioning circuits 214, a communication unit 216, and one or more switches 224 disposed onboard the first vehicle 202. The examining system 200 also includes a detection unit 218, an identification unit 220, a detection device 230, and a communication unit 222 disposed onboard the second vehicle 204. Alternatively, one or more of the control unit 206, application device 210, power source 212, conditioning circuits 214, communication unit 216, and/or switch 224 may be disposed onboard the second vehicle 204 and/or another vehicle in the same vehicle system, and/or one or more of the detection unit 218, identification unit 220, detection device 230, and communication unit 222 may be disposed onboard the first vehicle 202 and/or another vehicle in the same vehicle system.

The control unit 206 controls supply of electric current to the application device 210. In an embodiment, the application device 210 includes one or more conductive bodies that engage the route 108 as the vehicle system that includes the vehicle 202 travels along the route 108. For example, the application device 210 can include a conductive shoe, brush, or other body that slides along an upper and/or side surface of a track such that a conductive pathway is created that extends through the application device 210 and the track. Additionally or alternatively, the application device 210 can include a conductive portion of a wheel of the first vehicle 202, such as the conductive outer periphery or circumference of the wheel that engages the route 108 as the first vehicle 202 travels along the route 108. In another embodiment, the application device 210 may be inductively coupled with the route 108 without engaging or touching the route 108 or any component that engages the route 108.

The application device 210 is conductively coupled with the switch 224, which can represent one or more devices that control the flow of electric current from the onboard power source 212 and/or the conditioning circuits 214. The switch 224 can be controlled by the control unit 206 so that the control unit 206 can turn on or off the flow of electric current through the application device 210 to the route 108. In an embodiment, the switch 224 also can be controlled by the control unit 206 to vary one or more waveforms and/or waveform characteristics (e.g., phase, frequency, amplitude, and the like) of the current that is applied to the route 108 by the application device 210.

The onboard power source 212 represents one or more devices capable of storing electric energy, such as one or more batteries, capacitors, flywheels, and the like. Additionally or alternatively, the power source 212 may represent one or more devices capable of generating electric current, such as an alternator, generator, photovoltaic device, gas turbine, or the like. The power source 212 is coupled with the switch 224 so that the control unit 206 can control when the electric energy stored in the power source 212 and/or the electric current generated by the power source 212 is conveyed as electric current (e.g., direct current, alternating current, an RF signal, or the like) to the route 108 via the application device 210.

The conditioning circuit 214 represents one or more circuits and electric components that change characteristics of electric current. For example, the conditioning circuit 214 may include one or more inverters, converters, transformers, batteries, capacitors, resistors, inductors, and the like. In the illustrated embodiment, the conditioning circuit 214 is coupled with a connecting assembly 226 that is configured to receive electric current from an off-board source. For example, the connecting assembly 226 may include a pantograph that engages an electrified conductive pathway 228 (e.g., a catenary) extending along the route 108 such that the electric current from the catenary 228 is conveyed via the connecting assembly 226 to the conditioning circuit 214. Additionally or alternatively, the electrified conductive pathway 228 may represent an electrified portion of the route 108 (e.g., an electrified rail) and the connecting assembly 226 may include a conductive shoe, brush, portion of a wheel, or other body that engages the electrified portion of the route 108. Electric current is conveyed from the electrified portion of the route 108 through the connecting assembly 226 and to the conditioning circuit 214.

The electric current that is conveyed to the conditioning circuit 214 from the power source 212 and/or the off-board source (e.g., via the connecting assembly 226) can be altered by the conditioning circuit 214. For example, the conditioning circuit 214 can change the voltage, current, frequency, phase, magnitude, intensity, waveform, and the like, of the current that is received from the power source 212 and/or the connecting assembly 226. The modified current can be the examination signal that is electrically injected into the route 108 by the application device 210. Additionally or alternatively, the control unit 206 can form the examination signal by controlling the switch 224. For example, the examination signal can be formed by turning the switch 224 on to allow current to flow from the conditioning circuit 214 and/or the power source 212 to the application device 210.

In an embodiment, the control unit 206 may control the conditioning circuit 214 to form the examination signal. For example, the control unit 206 may control the conditioning circuit 214 to change the voltage, current, frequency, phase, magnitude, intensity, waveform, and the like, of the current that is received from the power source 212 and/or the connecting assembly 226 to form the examination signal. The examination signal optionally may be a waveform that includes multiple frequencies. The examination signal may include multiple harmonics or overtones. The examination signal may be a square wave or the like.

The examination signal is conducted through the application device 210 to the route 108, and is electrically injected into a conductive portion of the route 108. For example, the examination signal may be conducted into a conductive track of the route 108. In another embodiment, the application device 210 may not directly engage (e.g., touch) the route 108, but may be wirelessly coupled with the route 108 in order to electrically inject the examination signal into the route 108 (e.g., via induction).

The conductive portion of the route 108 that extends between the first and second vehicles 202, 204 during travel of the vehicle system may form a track circuit through which the examination signal may be conducted. The first vehicle 202 can be coupled (e.g., coupled physically, coupled wirelessly, among others) to the track circuit by the application device 210. The power source (e.g., the onboard power source 212 and/or the off-board electrified conductive pathway 228) can transfer power (e.g., the examination signal) through the track circuit toward the second vehicle 204.

By way of example and not limitation, the first vehicle 202 can be coupled to a track of the route 108, and the track can be the track circuit that extends and conductively couples one or more components of the examining system 200 on the first vehicle 202 with one or more components of the examining system 200 on the second vehicle 204.

In an embodiment, the control unit 206 includes or represents a manager component. Such a manager component can be configured to activate a transmission of electric current into the route 108 via the application device 210. In another instance, the manager component can activate or deactivate a transfer of the portion of power from the onboard and/or off-board power source to the application device 210, such as by controlling the switch and/or conditioning circuit. Moreover, the manager component can adjust parameter(s) associated with the portion of power that is transferred to the route 108. For instance, the manager component can adjust an amount of power transferred, a frequency at which the power is transferred (e.g., a pulsed power delivery, AC power, among others), a duration of time the portion of power is transferred, among others. Such parameter(s) can be adjusted by the manager component based on at least one of a geographic location of the vehicle or the device or an identification of the device (e.g., type, location, make, model, among others).

The manager component can leverage a geographic location of the vehicle or the device in order to adjust a parameter for the portion of power that can be transferred to the device from the power source. For instance, the amount of power transferred can be adjusted by the manager component based on the device power input. By way of example and not limitation, the portion of power transferred can meet or be below the device power input in order to reduce risk of damage to the device. In another example, the geographic location of the vehicle and/or the device can be utilized to identify a particular device and, in turn, a power input for such device. The geographic location of the vehicle and/or the device can be ascertained by a location on a track circuit, identification of the track circuit, Global Positioning Service (GPS), among others.

The detection unit 218 disposed onboard the second vehicle 204 as shown in FIG. 2 monitors the route 108 to attempt to detect the examination signal that is injected into the route 108 by the first vehicle 202. The detection unit 218 is coupled with the detection device 230. In an embodiment, the detection device 230 includes one or more conductive bodies that engage the route 108 as the vehicle system that includes the vehicle 204 travels along the route 108. For example, the detection device 230 can include a conductive shoe, brush, or other body that slides along an upper and/or side surface of a track such that a conductive pathway is created that extends through the detection device 230 and the track. Additionally or alternatively, the detection device 230 can include a conductive portion of a wheel of the second vehicle 204, such as the conductive outer periphery or circumference of the wheel that engages the route 108 as the second vehicle 204 travels along the route 108. In another embodiment, the detection device 230 may be inductively coupled with the route 108 without engaging or touching the route 108 or any component that engages the route 108.

The detection unit 218 monitors one or more electrical characteristics of the route 108 using the detection device 230. For example, the voltage of a direct current conducted by the route 108 may be detected by monitoring the voltage conducted along the route 108 to the detection device 230. In another example, the current (e.g., frequency, amps, phases, or the like) of an alternating current or RF signal being conducted by the route 108 may be detected by monitoring the current conducted along the route 108 to the detection device 230. As another example, the signal-to-noise ratio of a signal being conducted by the detection device 230 from the route 108 may be detected by the detection unit 218 examining the signal conducted by the detection device 230 (e.g., a received signal) and comparing the received signal to a designated signal. For example, the examination signal that is injected into the route 108 using the application device 210 may include a designated signal or portion of a designated signal. The detection unit 218 may compare the received signal that is conducted from the route 108 into the detection device 230 with this designated signal in order to measure a signal-to-noise ratio of the received signal.

The detection unit 218 determines one or more electrical characteristics of the signal that is received (e.g., picked up) by the detection device 230 from the route 108 and reports the characteristics of the received signal to the identification unit 220. The one or more electrical characteristics may include voltage, current, frequency, phase, phase shift or difference, modulation, intensity, embedded signature, and the like. If no signal is received by the detection device 230, then the detection unit 218 may report the absence of such a signal to the identification unit 220. For example, if the detection unit 218 does not detect at least a designated voltage, designated current, or the like, as being received by the detection device 230, then the detection unit 218 may not detect any received signal. Alternatively or additionally, the detection unit 218 may communicate the detection of a signal that is received by the detection device 230 only upon detection of the signal by the detection device 230.

In an embodiment, the detection unit 218 may determine the characteristics of the signals received by the detection device 230 in response to a notification received from the control unit 206 in the first vehicle 202. For example, when the control unit 206 is to cause the application device 210 to inject the examination signal into the route 108, the control unit 206 may direct the communication unit 216 to transmit a notification signal to the detection device 230 via the communication unit 222 of the second vehicle 204. The communication units 216, 222 may include respective antennas 232, 234 and associated circuitry for wirelessly communicating signals between the vehicles 202, 204, and/or with off-board locations. The communication unit 216 may wirelessly transmit a notification to the detection unit 218 that instructs the detection unit 218 as to when the examination signal is to be input into the route 108. Additionally or alternatively, the communication units 216, 222 may be connected via one or more wires, cables, and the like, such as a multiple unit (MU) cable, train line, or other conductive pathway(s), to allow communication between the communication units 216, 222.

The detection unit 218 may begin monitoring signals received by the detection device 230. For example, the detection unit 218 may not begin or resume monitoring the received signals of the detection device 230 unless or until the detection unit 218 is instructed that the control unit 206 is causing the injection of the examination signal into the route 108. Alternatively or additionally, the detection unit 218 may periodically monitor the detection device 230 for received signals and/or may monitor the detection device 230 for received signals upon being manually prompted by an operator of the examining system 200.

The identification unit 220 receives the characteristics of the received signal from the detection unit 218 and determines if the characteristics indicate receipt of all or a portion of the examination signal injected into the route 108 by the first vehicle 202. Although the detection unit 218 and the identification unit 220 are shown as separate units, the detection unit 218 and the identification unit 220 may refer to the same unit. For example, the detection unit 218 and the identification unit 220 may be a single hardware component disposed onboard the second vehicle 204.

The identification unit 220 examines the characteristics and determines if the characteristics indicate that the section of the route 108 disposed between the first vehicle 202 and the second vehicle 204 is damaged or at least partially damaged. For example, if the application device 210 injected the examination signal into a track of the route 108 and one or more characteristics (e.g., voltage, current, frequency, intensity, signal-to-noise ratio, and the like) of the examination signal are not detected by the detection unit 218, then, the identification unit 220 may determine that the section of the track that was disposed between the vehicles 202, 204 is broken or otherwise damaged such that the track cannot conduct the examination signal. Additionally or alternatively, the identification unit 220 can examine the signal-to-noise ratio of the signal detected by the detection unit 218 and determine if the section of the route 108 between the vehicles 202, 204 is potentially broken or damaged. For example, the identification unit 220 may identify this section of the route 108 as being broken or damaged if the signal-to-noise ratio of one or more (or at least a designated amount) of the received signals is less than a designated ratio.

The identification unit 220 may include or be communicatively coupled (e.g., by one or more wired and/or wireless connections that allow communication) with a location determining unit that can determine the location of the vehicle 204 and/or vehicle system. For example, the location determining unit may include a GPS unit or other device that can determine where the first vehicle and/or second vehicle are located along the route 108. The distance between the first vehicle 202 and the second vehicle 204 along the length of the vehicle system may be known to the identification unit 220, such as by inputting the distance into the identification unit 220 using one or more input devices and/or via the communication unit 222.

The identification unit 220 can identify which section of the route 108 is potentially damaged based on the location of the first vehicle 202 and/or the second vehicle 204 during transmission of the examination signal through the route 108. For example, the identification unit 220 can identify the section of the route 108 that is within a designated distance of the vehicle system, the first vehicle 202, and/or the second vehicle 204 as the potentially damaged section when the identification unit 220 determines that the examination signal is not received or at least has a decreased signal-to-noise ratio.

Additionally or alternatively, the identification unit 220 can identify which section of the route 108 is potentially damaged based on the locations of the first vehicle 202 and the second vehicle 204 during transmission of the examination signal through the route 108, the direction of travel of the vehicle system that includes the vehicles 202, 204, the speed of the vehicle system, and/or a speed of propagation of the examination signal through the route 108. The speed of propagation of the examination signal may be a designated speed that is based on one or more of the material(s) from which the route 108 is formed, the type of examination signal that is injected into the route 108, and the like. In an embodiment, the identification unit 220 may be notified when the examination signal is injected into the route 108 via the notification provided by the control unit 206. The identification unit 220 can then determine which portion of the route 108 is disposed between the first vehicle 202 and the second vehicle 204 as the vehicle system moves along the route 108 during the time period that corresponds to when the examination signal is expected to be propagating through the route 108 between the vehicles 202, 204 as the vehicles 202, 204 move. This portion of the route 108 may be the section of potentially damaged route that is identified.

One or more responsive actions may be initiated when the potentially damaged section of the route 108 is identified. For example, in response to identifying the potentially damaged portion of the route 108, the identification unit 220 may notify the control unit 206 via the communication units 222, 216. The control unit 206 and/or the identification unit 220 can automatically slow down or stop movement of the vehicle system. For example, the control unit 206 and/or identification unit 220 can be communicatively coupled with one or more propulsion systems (e.g., engines, alternators/generators, motors, and the like) of one or more of the propulsion-generating vehicles in the vehicle system. The control unit 206 and/or identification unit 220 may automatically direct the propulsion systems to slow down and/or stop.

Figure 3:
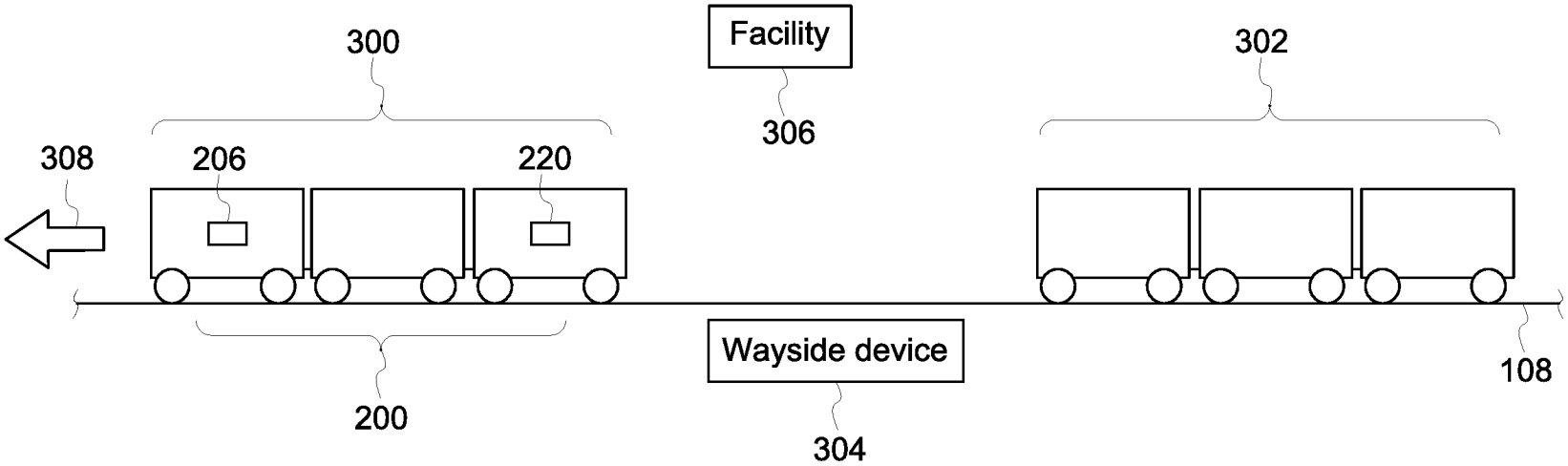
FIG. 3 illustrates a schematic diagram of an embodiment of plural vehicle systems traveling along the route.

With continued reference to FIG. 2, FIG. 3 illustrates a schematic diagram of an embodiment of plural vehicle systems 300, 302 traveling along the route 108. One or more of the vehicle systems 300, 302 may represent the vehicle system 100 shown in FIG. 1 that includes the route examining system 200. For example, at least a first vehicle system 300 traveling along the route 108 in a first direction 308 may include the examining system 200. The second vehicle system 302 may be following the first vehicle system 300 on the route 108, but spaced apart and separated from the first vehicle system 300.

In addition or as an alternate to the responsive actions that may be taken when a potentially damaged section of the route 108 is identified, the examining system 200 onboard the first vehicle system 300 may automatically notify the second vehicle system 302. The control unit 206 and/or the identification unit 220 may wirelessly communicate (e.g., transmit or broadcast) a warning signal to the second vehicle system 302. The warning signal may notify the second vehicle system 302 of the location of the potentially damaged section of the route 108 before the second vehicle system 302 arrives at the potentially damaged section. The second vehicle system 302 may be able to slow down, stop, or move to another route to avoid traveling over the potentially damaged section.

Additionally or alternatively, the control unit 206 and/or identification unit 220 may communicate a warning signal to a stationary wayside device 304 in response to identifying a section of the route 108 as being potentially damaged. The device 304 can be, for instance, wayside equipment, an electrical device, a client asset, a defect detection device, a device utilized with Positive Train Control (PTC), a signal system component(s), a device utilized with Automated Equipment Identification (AEI), among others. In one example, the device 304 can be a device utilized with AEI. AEI is an automated equipment identification mechanism that can aggregate data related to equipment for the vehicle. By way of example and not limitation, AEI can utilize passive radio frequency technology in which a tag (e.g., passive tag) is associated with the vehicle and a reader/receiver receives data from the tag when in geographic proximity thereto. The AEI device can be a reader or receiver that collects or stores data from a passive tag, a data store that stores data related to passive tag information received from a vehicle, an antenna that facilitates communication between the vehicle and a passive tag, among others. Such an AEI device may store an indication of where the potentially damaged section of the route 108 is located so that the second vehicle system 302 may obtain this indication when the second vehicle system 302 reads information from the AEI device.

In another example, the device 304 can be a signaling device for the vehicle. For instance, the device 304 can provide visual and/or audible warnings to provide warning to other entities such as other vehicle systems (e.g., the vehicle system 302) of the potentially damaged section of the route 108. The signaling devices can be, but not limited to, a light, a motorized gate arm (e.g., motorized motion in a vertical plane), an audible warning device, among others.

In another example, the device 304 can be utilized with PTC. PTC can refer to communication-based/processor-based vehicle control technology that provides a system capable of reliably and functionally preventing collisions between vehicle systems, over speed derailments, incursions into established work zone limits, and the movement of a vehicle system through a route switch in the improper position. PTC systems can perform other additional specified functions. Such a PTC device 304 can provide warnings to the second vehicle system 204 that cause the second vehicle system 204 to automatically slow and/or stop, among other responsive actions, when the second vehicle system 204 approaches the location of the potentially damaged section of the route 108.

In another example, the wayside device 304 can act as a beacon or other transmitting or broadcasting device other than a PTC device that communicates warnings to other vehicles or vehicle systems traveling on the route 108 of the identified section of the route 108 that is potentially damaged.

The control unit 206 and/or identification unit 220 may communicate a repair signal to an off-board facility 306 in response to identifying a section of the route 108 as being potentially damaged. The facility 306 can represent a location, such as a dispatch or repair center, that is located off-board of the vehicle systems 202, 204. The repair signal may include or represent a request for further inspection and/or repair of the route 108 at the potentially damaged section. Upon receipt of the repair signal, the facility 306 may dispatch one or more persons and/or equipment to the location of the potentially damaged section of the route 108 in order to inspect and/or repair the route 108 at the location.

Additionally or alternatively, the control unit 206 and/or identification unit 220 may notify an operator of the vehicle system of the potentially damaged section of the route 108 and suggest the operator initiate one or more of the responsive actions described herein.

In another embodiment, the examining system 200 may identify the potentially damaged section of the route 108 using the wayside device 304. For example, the detection device 230, the detection unit 218, and the communication unit 222 may be located at or included in the wayside device 304. The control unit 206 on the vehicle system may determine when the vehicle system is within a designated distance of the wayside device 304 based on an input or known location of the wayside device 304 and the monitored location of the vehicle system (e.g., from data obtained from a location determination unit). Upon traveling within a designated distance of the wayside device 304, the control unit 206 may cause the examination signal to be injected into the route 108. The wayside device 304 can monitor one or more electrical characteristics of the route 108 similar to the second vehicle 204 described above. If the electrical characteristics indicate that the section of the route 108 between the vehicle system and the wayside device 304 is damaged or broken, the wayside device 304 can initiate one or more responsive actions, such as by directing the vehicle system to automatically slow down and/or stop, warning other vehicle systems traveling on the route 108, requesting inspection and/or repair of the potentially damaged section of the route 108, and the like.

Figure 5:
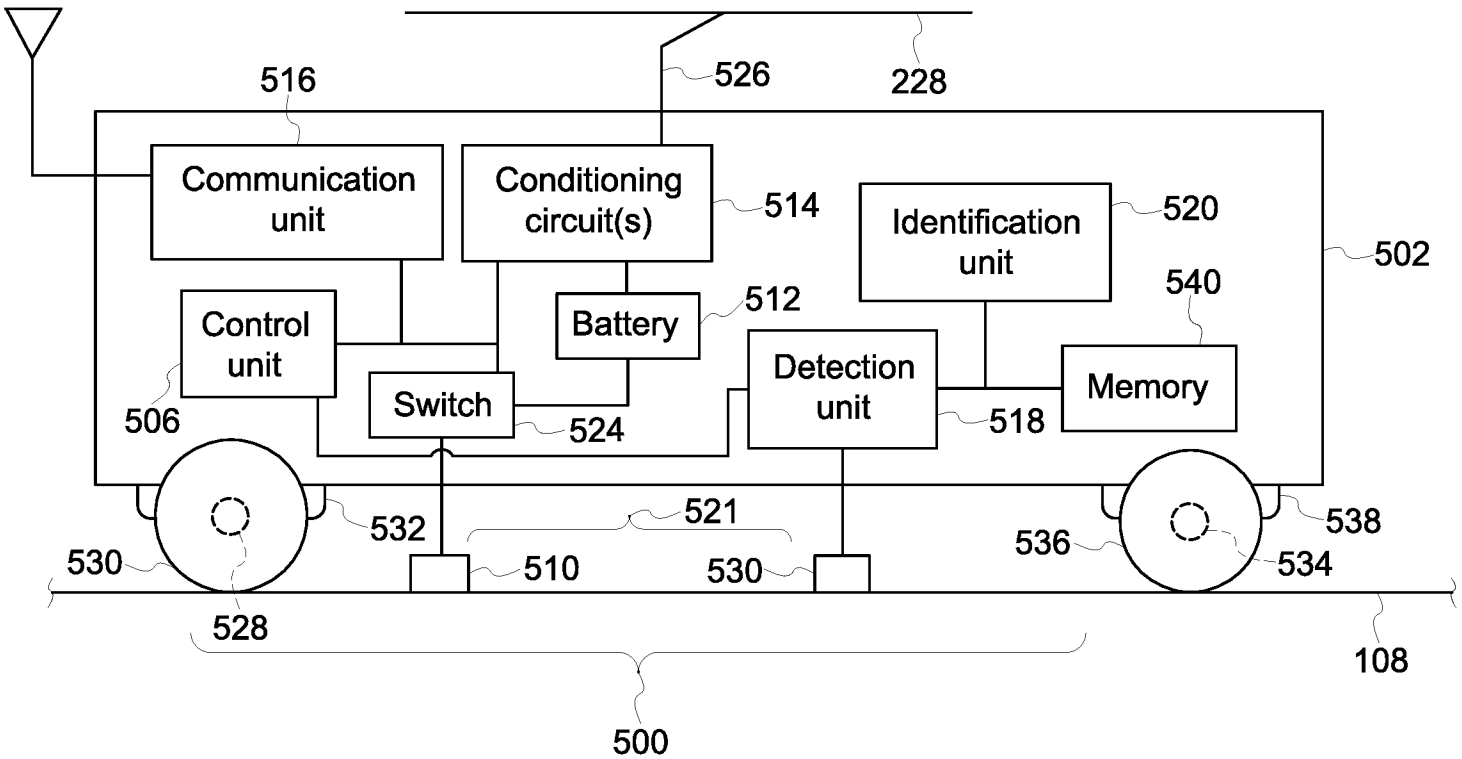
FIG. 5 is a schematic illustration of an embodiment of an examining system.

FIG. 5 is a schematic illustration of an embodiment of an examining system 500. The examining system 500 may represent the examining system 102 shown in FIG. 1. In contrast to the examining system 200 shown in FIG. 2, the examining system 500 is disposed within a single vehicle 502 in a vehicle system that may include one or more additional vehicles mechanically coupled with the vehicle 502. The vehicle 502 may represent a vehicle 104 and/or 106 of the vehicle system 100 shown in FIG. 1.

The examining system 500 includes an identification unit 520 and a signal communication system 521. The identification unit 520 may be similar to or represent the identification unit 220 shown in FIG. 2. The signal communication system 521 includes at least one application device and at least one detection device and/or unit. In the illustrated embodiment, the signal communication system 521 includes one application device 510 and one detection device 530. The application device 510 and the detection device 530 may be similar to or represent the application device 210 and the detection device 230, respectively (both shown in FIG. 2). The application device 510 and the detection device 530 may be a pair of transmit and receive coils in different, discrete housings that are spaced apart from each other, as shown in FIG. 5. Alternatively, the application device 510 and the detection device 530 may be a pair of transmit and receive coils held in a common housing. In another alternative embodiment, the application device 510 and the detection device 530 include a same coil, where the coil is configured to inject at least one examination signal into the route 108 and is also configured to monitor one or more electrical characteristics of the route 108 in response to the injection of the at least one examination signal.

In other embodiments shown and described below, the signal communication system 521 may include two or more application devices and/or two or more detection devices or units. Although not indicated in FIG. 5, in addition to the application device 510 and the detection device 530, the signal communication system 521 may further include one or more switches 524 (which may be similar to or represent the switches 224 shown in FIG. 2), a control unit 506 (which may be similar to or represent the control unit 206 shown in FIG. 2), one or more conditioning circuits 514 (which may be similar to or represent the circuits 214 shown in FIG. 2), an onboard power source 512 ("Battery" in FIG. 5, which may be similar to or represent the power source 212 shown in FIG. 2), and/or one or more detection units 518 (which may be similar to or represent the detection unit 218 shown in FIG. 2). The illustrated embodiment of the examining system 500 may further include a communication unit 516 (which may be similar to or represent the communication unit 216 shown in FIG. 2). As shown in FIG. 5, these components of the examining system 500 are disposed onboard a single vehicle 502 of a vehicle system, although one or more of the components may be disposed onboard a different vehicle of the vehicle system from other components of the examining system 500. As described above, the control unit 506 controls supply of electric current to the application device 510 that engages or is inductively coupled with the route 108 as the vehicle 502 travels along the route 108. The application device 510 is conductively coupled with the switch 524 that is controlled by the control unit 506 so that the control unit 506 can turn on or off the flow of electric current through the application device 510 to the route 108. The power source 512 is coupled with the switch 524 so that the control unit 506 can control when the electric energy stored in the power source 512 and/or the electric current generated by the power source 512 is conveyed as electric current to the route 108 via the application device 510.

The conditioning circuit 514 may be coupled with a connecting assembly 526 that is similar to or represents the connecting assembly 226 shown in FIG. 2. The connecting assembly 526 receives electric current from an off-board source, such as the electrified conductive pathway 228. Electric current can be conveyed from the electrified portion of the route 108 through the connecting assembly 526 and to the conditioning circuit 514.

The electric current that is conveyed to the conditioning circuit 514 from the power source 512 and/or the off-board source can be altered by the conditioning circuit 514. The modified current can be the examination signal that is electrically injected into the route 108 by the application device 510. Optionally, the control unit 506 can form the examination signal by controlling the switch 524, as described above. Optionally, the control unit 506 may control the conditioning circuit 514 to form the examination signal, also as described above.

The examination signal is conducted through the application device 510 to the route 108, and is electrically injected into a conductive portion of the route 108. The conductive portion of the route 108 that extends between the application device 510 and the detection device 530 of the vehicle 502 during travel may form a track circuit through which the examination signal may be conducted.

The control unit 506 may include or represent a manager component. Such a manager component can be configured to activate a transmission of electric current into the route 108 via the application device 510. In another instance, the manager component can activate or deactivate a transfer of the portion of power from the onboard and/or off-board power source to the application device 510, such as by controlling the switch and/or conditioning circuit. Moreover, the manager component can adjust parameter(s) associated with the portion of power that is transferred to the route 108.

The detection unit 518 monitors the route 108 to attempt to detect the examination signal that is injected into the route 108 by the application device 510. In one aspect, the detection unit 518 may follow behind the application device 510 along a direction of travel of the vehicle 502. The detection unit 518 is coupled with the detection device 530 that engages or is inductively coupled with the route 108, as described above.

The detection unit 518 monitors one or more electrical characteristics of the route 108 using the detection device 530. The detection unit 518 may compare the received signal that is conducted from the route 108 into the detection device 530 with this designated signal in order to measure a signal-to-noise ratio of the received signal. The detection unit 518 determines one or more electrical characteristics of the signal by the detection device 530 from the route 108 and reports the characteristics of the received signal to the identification unit 520. If no signal is received by the detection device 530, then the detection unit 518 may report the absence of such a signal to the identification unit 520. In an embodiment, the detection unit 518 may determine the characteristics of the signals received by the detection device 530 in response to a notification received from the control unit 506, as described above.

The detection unit 518 may begin monitoring signals received by the detection device 530. For example, the detection unit 518 may not begin or resume monitoring the received signals of the detection device 530 unless or until the detection unit 518 is instructed that the control unit 506 is causing the injection of the examination signal into the route 108. Alternatively or additionally, the detection unit 518 may periodically monitor the detection device 530 for received signals and/or may monitor the detection device 530 for received signals upon being manually prompted by an operator of the examining system 500.

In one aspect, the application device 510 includes a first axle 528 and/or a first wheel 530 that is connected to the axle 528 of the vehicle 502. The axle 528 and wheel 530 may be connected to a first truck 532 of the vehicle 502. The application device 510 may be conductively coupled with the route 108 (e.g., by directly engaging the route 108) to inject the examination signal into the route 108 via the axle 528 and the wheel 530, or via the wheel 530 alone. The detection device 530 may include a second axle 534 and/or a second wheel 536 that is connected to the axle 534 of the vehicle 502. The axle 534 and wheel 536 may be connected to a second truck 538 of the vehicle 502. The detection device 530 may monitor the electrical characteristics of the route 108 via the axle 534 and the wheel 536, or via the wheel 536 alone. Optionally, the axle 534 and/or wheel 536 may inject the signal while the other axle 528 and/or wheel 530 monitors the electrical characteristics.

The identification unit 520 receives the one or more characteristics of the received signal from the detection unit 518 and determines if the characteristics indicate receipt of all or a portion of the examination signal injected into the route 108 by the application device 510. The identification unit 520 interprets the one or more characteristics monitored by the detection unit 518 to determine a state of the route. The identification unit 520 examines the characteristics and determines if the characteristics indicate that a test section of the route 108 disposed between the application device 510 and the detection device 530 is in a non-damaged state, is in a damaged or at least partially damaged state, or is in a non-damaged state that indicates the presence of an electrical short, as described below.

The identification unit 520 may include or be communicatively coupled with a location determining unit that can determine the location of the vehicle 502. The distance between the application device 510 and the detection device 530 along the length of the vehicle 502 may be known to the identification unit 520, such as by inputting the distance into the identification unit 520 using one or more input devices and/or via the communication unit 516.

The identification unit 520 can identify which section of the route 108 is potentially damaged based on the location of the vehicle 502 during transmission of the examination signal through the route 108, the direction of travel of the vehicle 502, the speed of the vehicle 502, and/or a speed of propagation of the examination signal through the route 108, as described above.

One or more responsive actions may be initiated when the potentially damaged section of the route 108 is identified. For example, in response to identifying the potentially damaged portion of the route 108, the identification unit 520 may notify the control unit 506. The control unit 506 and/or the identification unit 520 can automatically slow down or stop movement of the vehicle 502 and/or the vehicle system that includes the vehicle 502. For example, the control unit 506 and/or identification unit 520 can be communicatively coupled with one or more propulsion systems (e.g., engines, alternators/generators, motors, and the like) of one or more of the propulsion-generating vehicles in the vehicle system. The control unit 506 and/or identification unit 520 may automatically direct the propulsion systems to slow down and/or stop.

Figure 4:
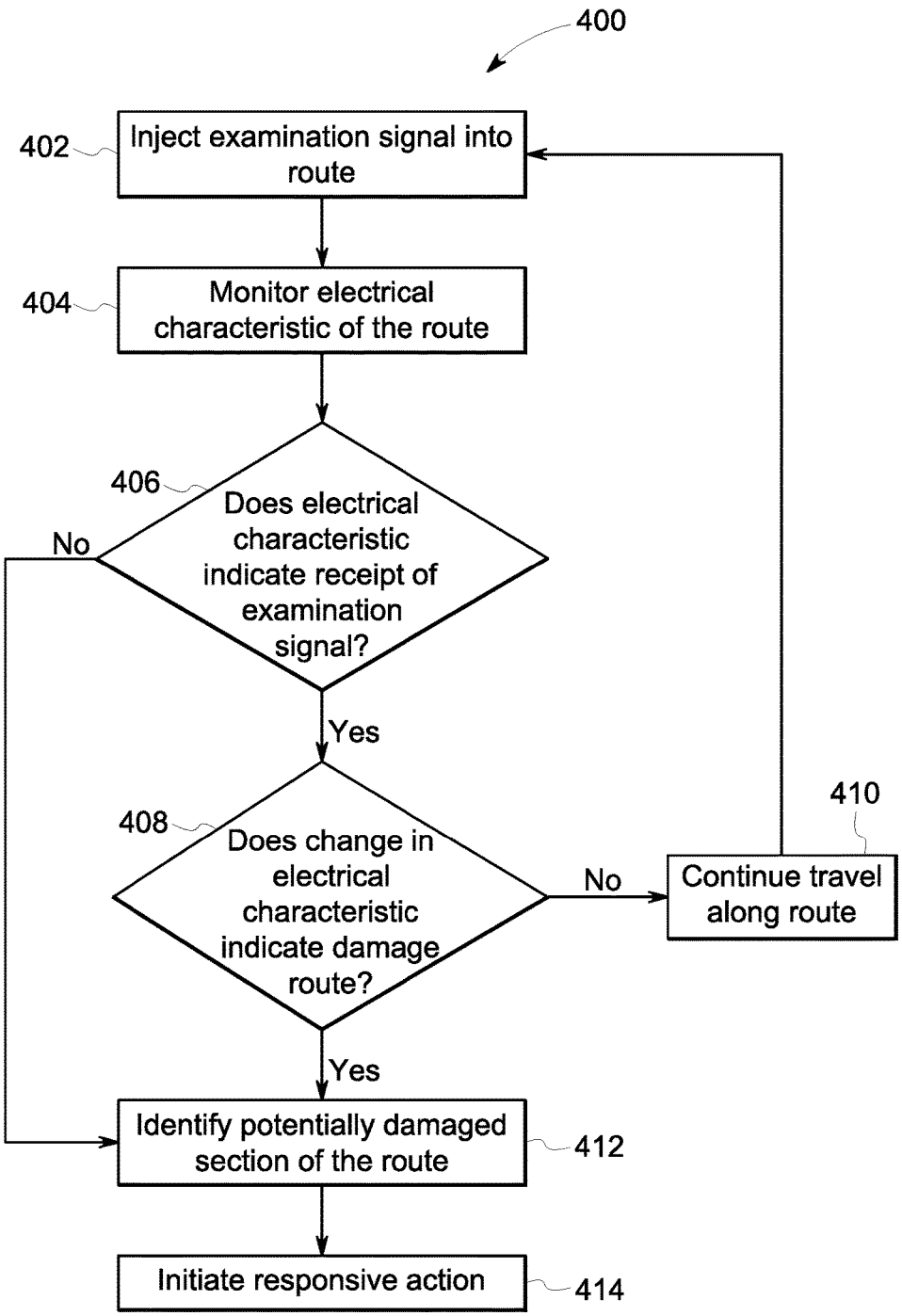
FIG. 4 is a flowchart of an embodiment of a method for examining a route being traveled by a vehicle system from onboard the vehicle system.

FIG. 4 is a flowchart of an embodiment of a method 400 for examining a route being traveled by a vehicle system from onboard the vehicle system. The method 400 may be used in conjunction with one or more embodiments of the vehicle systems and/or examining systems described herein. Alternatively, the method 400 may be implemented with another system.

At 402, an examination signal is injected into the route being traveled by the vehicle system at a first vehicle. For example, a direct current, alternating current, RF signal, or another signal may be conductively and/or inductively injected into a conductive portion of the route 108, such as a track of the route 108.

At 404, one or more electrical characteristics of the route are monitored at another, second vehicle in the same vehicle system. For example, the route 108 may be monitored to determine if any voltage or current is being conducted by the route 108.

At 406, a determination is made as to whether the one or more monitored electrical characteristics indicate receipt of the examination signal. For example, if a direct current, alternating current, or RF signal is detected in the route 108, then the detected current or signal may indicate that the examination signal is conducted through the route 108 from the first vehicle to the second vehicle in the same vehicle system. As a result, the route 108 may be substantially intact between the first and second vehicles. Optionally, the examination signal may be conducted through the route 108 between components joined to the same vehicle. As a result, the route 108 may be substantially intact between the components of the same vehicle. Flow of the method 400 may proceed to 408. On the other hand, if no direct current, alternating current, or RF signal is detected in the route 108, then the absence of the current or signal may indicate that the examination signal is not conducted through the route 108 from the first vehicle to the second vehicle in the same vehicle system or between components of the same vehicle. As a result, the route 108 may be broken between the first and second vehicles, or between the components of the same vehicle. Flow of the method 400 may then proceed to 412.

At 408, a determination is made as to whether a change in the one or more monitored electrical characteristics indicates damage to the route. For example, a change in the examination signal between when the signal was injected into the route 108 and when the examination signal is detected may be determined. This change may reflect a decrease in voltage, a decrease in current, a change in frequency and/or phase, a decrease in a signal-to-noise ratio, or the like. The change can indicate that the examination signal was conducted through the route 108, but that damage to the route 108 may have altered the signal. For example, if the change in voltage, current, frequency, phase, signal-to-noise ratio, or the like, of the injected examination signal to the detected examination signal exceeds a designated threshold amount (or if the monitored characteristic decreased below a designated threshold), then the change may indicate damage to the route 108, but not a complete break in the route 108. As a result, flow of the method 400 can proceed to 412.

On the other hand, if the change in voltage, amps, frequency, phase, signal-to-noise ratio, or the like, of the injected examination signal to the detected examination signal does not exceed the designated threshold amount (and/or if the monitored characteristic does not decrease below a designated threshold), then the change may not indicate damage to the route 108. As a result, flow of the method 400 can proceed to 410.

At 410, the test section of the route that is between the first and second vehicles in the vehicle system or between the components of the same vehicle is not identified as potentially damaged, and the vehicle system may continue to travel along the route. Additionally examination signals may be injected into the route at other locations as the vehicle system moves along the route.

At 412, the section of the route that is or was disposed between the first and second vehicles, or between the components of the same vehicle, is identified as a potentially damaged section of the route. For example, due to the failure of the examination signal to be detected and/or the change in the examination signal that is detected, the route may be broken and/or damaged between the first vehicle and the second vehicle, or between the components of the same vehicle.

At 414, one or more responsive actions may be initiated in response to identifying the potentially damaged section of the route. As described above, these actions can include, but are not limited to, automatically and/or manually slowing or stopping movement of the vehicle system, warning other vehicle systems about the potentially damaged section of the route, notifying wayside devices of the potentially damaged section of the route, requesting inspection and/or repair of the potentially damaged section of the route, and the like.

In one or more embodiments, a route examining system and method may be used to identify electrical shorts, or short circuits, on a route. The identification of short circuits may allow for the differentiation of a short circuit on a non-damaged section of the route from a broken or deteriorated track on a damaged section of the route. The differentiation of short circuits from open circuits caused by various types of damage to the route provides identification of false alarms. Detecting a false alarm preserves the time and costs associated with attempting to locate and repair a section of the route that is not actually damaged. For example, referring to the method 400 above at 408, a change in the monitored electrical characteristics may indicate that the test section of the route includes an electrical short that short circuits the two tracks together. For example, an increase in the amplitude of monitored voltage or current and/or a phase shift may indicate the presence of an electrical short. The electrical short provides a circuit path between the two tracks, which effectively reduces the circuit path of the propagating examination signal between the point of injection and the place of detection, which results in an increased voltage and/or current and/or the phase shift.

Figure 6:
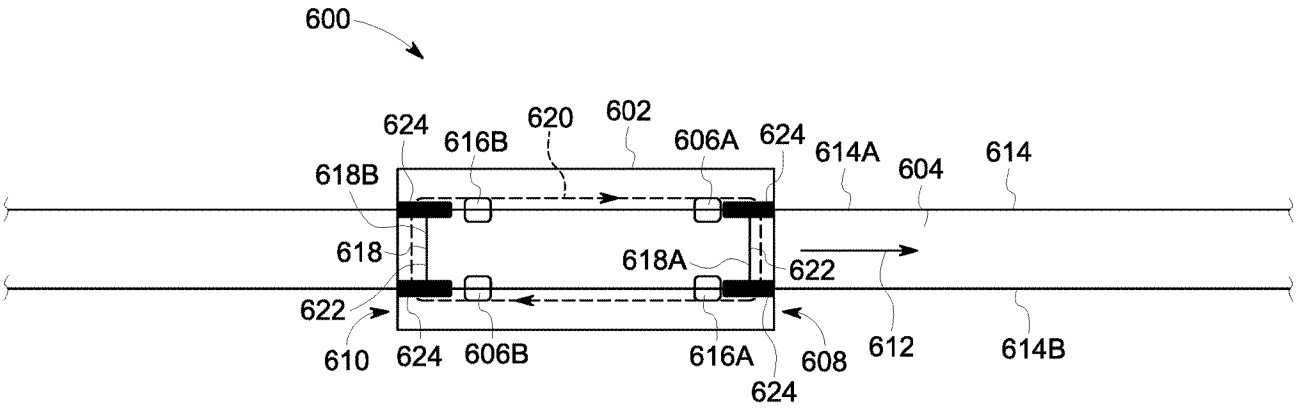
FIG. 6 is a schematic illustration of an embodiment of an examining system on a vehicle of a vehicle system traveling along a route.

FIG. 6 is a schematic illustration of an embodiment of an examining system 600 on a vehicle 602 of a vehicle system (not shown) traveling along a route 604. The examining system 600 may represent the examining system 102 shown in FIG. 1 and/or the examining system 200 shown in FIG. 2. In contrast to the examining system 200, the examining system 600 is disposed within a single vehicle 602. The vehicle 602 may represent at least one of the vehicles 104, 106 of the vehicle system 100 shown in FIG. 1. FIG. 6 may be a top-down view looking at least partially through the vehicle 602. The examining system 600 may be utilized to identify short circuits and breaks on a route, such as a railway track, for example. The vehicle 602 may be one of multiple vehicles of the vehicle system, so the vehicle 602 may be referred to herein as a first vehicle 602.

The vehicle 602 includes multiple transmitters or application devices 606 disposed onboard the vehicle 602. The application devices 606 may be positioned at spaced apart locations along the length of the vehicle 602. For example, a first application device 606A may be located closer to a front end 608 of the vehicle 602 relative to a second application device 606B located closer to a rear end 610 of the vehicle 602. The designations of "front" and "rear" may be based on the direction of travel 612 of the vehicle 602 along the route 604.

The route 604 includes conductive rails 614 in parallel, and the application devices 606 are configured to be conductively and/or inductively coupled with at least one conductive rail 614 along the route 604. For example, the conductive rails 614 may be rails in a railway context. In an embodiment, the first application device 606A is configured to be conductively and/or inductively coupled with a first conductive rail 614A, and the second application device 606B is configured to be conductively and/or inductively coupled with a second conductive rail 614B. As such, the application devices 606 may be disposed on the vehicle 602 diagonally from each other. The application devices 606 are utilized to electrically inject at least one examination signal into the route. For example, the first application device 606A may be used to inject a first examination signal into the first conductive rail 614A of the route 604. Likewise, the second application device 606B may be used to inject a second examination signal into the second conductive rail 614B of the route 604.

The vehicle 602 also includes multiple receiver coils or detection units 616 disposed onboard the vehicle 602. The detection units 616 are positioned at spaced apart locations along the length of the vehicle 602. For example, a first detection unit 616A may be located towards the front end 608 of the vehicle 602 relative to a second detection unit 616B located closer to the rear end 610 of the vehicle 602. The detection units 616 are configured to monitor one or more electrical characteristics of the route 604 along the conductive rails 614 in response to the examination signals being injected into the route 604. The electrical characteristics that are monitored may include a current, a phase shift, a modulation, a frequency, a voltage, an impedance, and the like. For example, the first detection unit 616A may be configured to monitor one or more electrical characteristics of the route 604 along the second rail 614B, and the second detection unit 616B may be configured to monitor one or more electrical characteristics of the route 604 along the first rail 614A. As such, the detection units 616 may be disposed on the vehicle 602 diagonally from each other. In an embodiment, each of the application devices 606A, 606B and the detection units 616A, 616B may define individual corners of a test section of the vehicle 602. Optionally, the application devices 606 and/or the detection units 616 may be staggered in location along the length and/or width of the vehicle 602. Optionally, the application device 606A and detection unit 616A and/or the application device 606B and detection unit 616B may be disposed along the same rail 614. The application devices 606 and/or detection units 616 may be disposed on the vehicle 602 at other locations in other embodiments.

In an embodiment, two of the conductive rails 614 (e.g., rails 614A and 614B) may be conductively and/or inductively coupled to each other through multiple shunts 618 along the length of the vehicle 602. For example, the vehicle 602 may include two shunts 618, with one shunt 618A located closer to the front 608 of the vehicle 602 relative to the other shunt 618B. In an embodiment, the shunts 618 are conductive and together with the rails 614 define an electrically conductive test loop 620. The conductive test loop 620 represents a track circuit or circuit path along the conductive rails 614 between the shunts 618. The test loop 620 moves along the rails 614 as the vehicle 602 travels along the route 604 in the direction 612. Therefore, the section of the conductive rails 614 defining part of the conductive test loop 620 changes as the vehicle 602 progresses on a trip along the route 604.

In an embodiment, the application devices 606 and the detection units 616 are in electrical contact with the conductive test loop 620. For example, the application device 606A may be in electrical contact with rail 614A and/or shunt 618A; the application device 606B may be in electrical contact with rail 614B and/or shunt 618B; the detection unit 616A may be in electrical contact with rail 614B and/or shunt 618A; and the detection unit 616B may be in electrical contact with rail 614A and/or shunt 618B.

The two shunts 618A, 618B may be first and second trucks disposed on a rail vehicle. Each truck 618 includes an axle 622 interconnecting two wheels 624. Each wheel 624 contacts a respective one of the rails 614. The wheels 624 and the axle 622 of each of the trucks 618 are configured to electrically connect (e.g., short) the two rails 614A, 614B to define respective ends of the conductive test loop 620. For example, the injected first and second examination signals may circulate the conductive test loop 620 along the length of a section of the first rail 614A, through the wheels 624 and axle 622 of the shunt 618A to the second rail 614B, along a section of the second rail 614B, and across the shunt 618B, returning to the first rail 614A.

In an embodiment, alternating current transmitted from the vehicle 602 is injected into the route 604 at two or more points through the rails 614 and received at different locations on the vehicle 602. For example, the first and second application devices 606A, 606B may be used to inject the first and second examination signals into respective first and second rails 614A, 614B. One or more electrical characteristics in response to the injected examination signals may be received at the first and second detection units 616A, 616B. Each examination signal may have a unique identifier so the signals can be distinguished from each other at the detection units 616. For example, the unique identifier of the first examination signal may have a base frequency, a phase, a modulation, an embedded signature, and/or the like, that differs from the unique identifier of the second examination signal.

In an embodiment, the examining system 600 may be used to more precisely locate faults on track circuits in railway signaling systems, and to differentiate between track features. For example, the system 600 may be used to distinguish broken tracks (e.g., rails) versus crossing shunt devices, non-insulated switches, scrap metal connected across the rails 614A and 614B, and other situations or devices that might produce an electrical short (e.g., short circuit) when a current is applied to the conductive rails 614 along the route 604. In typical track circuits looking for damaged sections of routes, an electrical short may appear as similar to a break, creating a false alarm. The examining system 600 also may be configured to distinguish breaks in the route due to damage from intentional, non-damaged "breaks" in the route, such as insulated joints and turnouts (e.g., track switches), which simulate actual breaks but do not short the conductive test loop 620 when traversed by a vehicle system having the examining system 600.

In an embodiment, when there is no break or short circuit on the route 604 and the rails 614 are electrically contiguous, the injected examination signals circulate the length of the test loop 620 and are received by all detection units 616 present on the test loop 620. Therefore, both detection units 616A and 616B receive both the first and second examination signals when there is no electrical break or electrical short on the route 604 within the section of the route 604 defining the test loop 620.

As discussed further below, when the vehicle 602 passes over an electrical short (e.g., a device or a condition of a section of the route 604 that causes a short circuit when a current is applied along the section of the route 604), two additional conductive current loops or conductive short loops are formed. The two additional conductive short loops have electrical characteristics that are unique to a short circuit (e.g., as opposed to electrical characteristics of an open circuit caused by a break in a rail 614). For example, the electrical characteristics of the current circulating the first conductive short loop may have an amplitude that is an inverse derivative of the amplitude of the second additional current loop as the electrical short is traversed by the vehicle 602. In addition, the amplitude of the current along the original conductive test loop 620 spanning the periphery of the test section diminishes considerably while the vehicle 602 traverses the electrical short. All of the one or more electrical characteristics in the original and additional current loops may be received and/or monitored by the detection units 616. Sensing the two additional short loops may provide a clear differentiator to identify that the loss of current in the original test loop is the result of a short circuit and not an electrical break in the rail 614. Analysis of the electrical characteristics of the additional short loops relative to the vehicle motion and/or location may provide more precision in locating the short circuit within the span of the test section.

In an alternative embodiment, the examining system 600 includes the two spaced-apart detection units 616A, 616B defining a test section of the route 604 therebetween, but only includes one of the application devices 606A, 606B, such as only the first application device 606A. The detection units 616A, 616B are each configured to monitor one or more electrical characteristics of at least one of the conductive rails 614A, 614B proximate to the respective detection unit 616A, 616B in response to at least one examination signal being electrically injected into at least one of the conductive rails 614A, 614B by the application device 606A. In another alternative embodiment, the examining system 600 includes the two spaced-apart detection units 616A, 616B, but does not include either of the application devices 606A, 606B. For example, the examination signal may be derived from an inherent electrical current of a traction motor (not shown) of the vehicle 602 (or another vehicle of the vehicle system). The examination signal may be injected into at least one of the conductive rails 614A, 614B via a conductive and/or inductive electrical connection between the traction motor and the one or both conductive rails 614A, 614B, such as a conductive connection through the wheels 624. In other embodiments, the examination signal may be derived from electrical currents of other motors of the vehicle 602 or may be an electrical current injected into the rails 614 from a wayside device.

Regardless of whether the examining system 600 includes one application device or no application devices, the identification unit 520 (shown in FIG. 5) is configured to examine the one or more electrical characteristics monitored by each of the first and second detection units 616A, 616B in order to determine a status of the test section of the route 604 based on whether the one or more electrical characteristics indicate that the examination signal is received by both the first and second detection units 616A, 616B, neither of the first or second detection units 616A, 616B, or only one of the first or second detection units 616A, 616B. The status of the test section may be potentially damaged, neither damaged nor includes an electrical short, or not damaged and includes an electrical short. The status of the test section is potentially damaged when neither of the first or second detection units 616A, 616B receive the examination signal, indicating an open circuit loop 620. The status of the test section is neither damaged nor includes an electrical short when both of the first and second detection units 616A, 616B receive the examination signal, indicating a closed circuit loop 620. The status of the test section is not damaged and includes an electrical short when only one of the first or second detection units 616A, 616B receive the examination signal, indicating one open sub-loop and one closed sub-loop within the loop 620.

In an alternative embodiment, the vehicle 602 includes the two spaced-apart application devices 606A, 606B defining a test section of the route 604 therebetween, but only includes one of the detection units 616A, 616B, such as only the first detection unit 616A. The first and second application devices 606A, 606B are configured to electrically inject the first and second examination signals, respectively, into the corresponding conductive rails 614A, 614B that the application devices 606A, 606B are coupled to. The detection unit 616A is configured to monitor one or more electrical characteristics of at least one of the conductive rails 614A, 614B in response to the first and second examination signals being injected into the rails 614.

In this embodiment, the identification unit 520 (shown in FIG. 5) is configured to examine the one or more electrical characteristics monitored by the detection unit 616A in order to determine a status of the test section of the route 604 based on whether the one or more electrical characteristics indicate receipt by the detection unit 616A of both of the first and second examination signals, neither of the first or second examination signals, or only one of the first or second examination signals. The status of the test section is potentially damaged when the one or more electrical characteristics indicate receipt by the detection unit 616A of neither the first nor the second examination signals, indicating an open circuit loop 620. The status of the test section is neither damaged nor includes an electrical short when the one or more electrical characteristics indicate receipt by the detection unit 616A of both the first and second examination signals, indicating a closed circuit loop 620. The status of the test section is not damaged and includes an electrical short when the one or more electrical characteristics indicate receipt by the detection unit 616A of only one of the first or second examination signals, indicating one open circuit sub-loop and one closed circuit sub-loop within the loop 620.

Additionally, or alternatively, the identification unit 520 may be configured to determine that the test section of the route 604 includes an electrical short by detecting a change in a phase difference between the first and second examination signals. For example, the identification unit 520 may compare a detected phase difference between the first and second examination signals that is detected by the detection unit 616A to a known phase difference between the first and second examination signals. The known phase difference may be a phase difference between the examination signals upon injecting the signals into the route 604 or may be a detected phase difference between the examination signals along sections of the route that are known to be not damaged and free of electrical shorts. Thus, if the one of more electrical characteristics monitored by the detection unit 616A indicate that the phase difference between the first and second examination signals is similar to the known phase difference, such that the change in phase difference is negligible or within a threshold value that compensates for variations due to noise, etc., then the status of the test section of route 604 may be non-damaged and free of an electrical short. If the detected phase difference varies from the known phase difference by more than the designated threshold value (such that the change in phase difference exceeds the designated threshold), the status of the test section of route 604 may be non-damaged and includes an electrical short. If the test section of the route 604 is potentially damaged, the one or more monitored electrical characteristics may indicate that the examination signals were not received by the detection unit 616A, so phase difference between the first and second examination signals is not detected.

In another alternative embodiment, the vehicle 602 includes one application device, such as the application device 606A, and one detection unit, such as the detection unit 616A. The application device 606A is disposed proximate to the detection unit 616A. For example, the application device 606A and the detection unit 616A may be located on opposite rails 614A, 614B at similar positions along the length of the vehicle 602 between the two shunts 618, as shown in FIG. 6, or may be located on the same rail 614A or 614B proximate to each other. The application device 606A is configured to electrically inject at least one examination signal into the rails 614, and the detection unit 616A is configured to monitor one or more electrical characteristics of the rails 614 in response to the at least one examination signal being injected into the conductive test loop 620.

In this embodiment, the identification unit 520 (shown in FIG. 5) is configured to examine the one or more electrical characteristics monitored by the detection unit 616A to determine a status of a test section of the route 604 that extends between the shunts 618. The identification unit 520 is configured to determine that the status of the test section is potentially damaged when the one or more electrical characteristics indicate that the at least one examination signal is not received by the detection unit 616A. The status of the test section is neither damaged nor includes an electrical short when the one or more electrical characteristics indicate that the at least one examination signal is received by the detection unit 616A. The status of the test section is not damaged and does include an electrical short when the one or more electrical characteristics indicate at least one of a phase shift in the at least one examination signal or an increased amplitude of the at least one examination signal. The amplitude may be increased over a base line amplitude that is detected or measured when the status of the test section is not damaged and does not include an electrical short. The increased amplitude may gradually increase from the base line amplitude, such as when the detection unit 616A and application device 606A of the signal communication system 521 (shown in FIG. 5) move towards the electrical short in the route 604, and may gradually decrease towards the base line amplitude, such as when the detection unit 616A and application device 606A of the signal communication system 521 move away from the electrical short.

Figure 7:
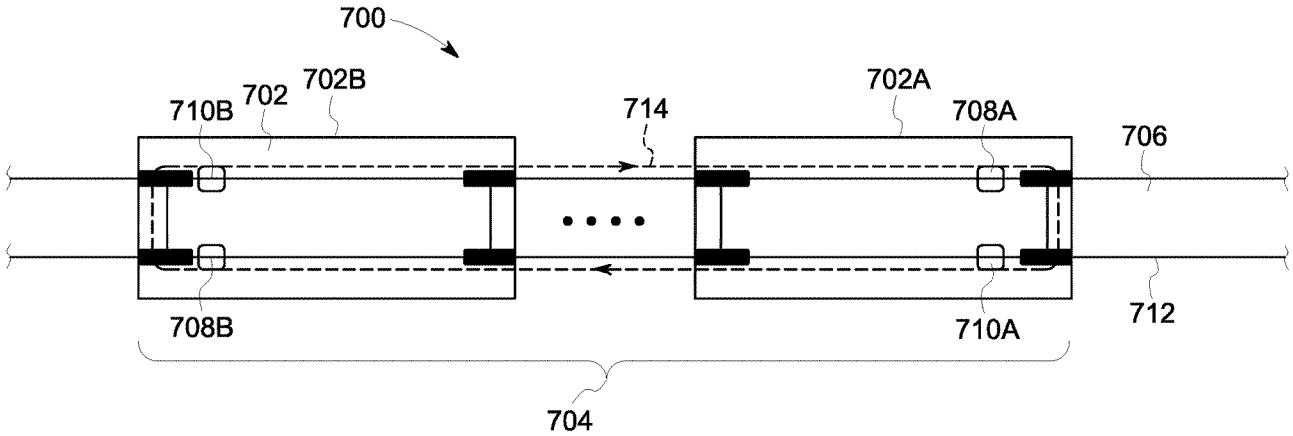
FIG. 7 is a schematic illustration of an embodiment of an examining system disposed on multiple vehicles of a vehicle system traveling along a route.

FIG. 7 is a schematic illustration of an embodiment of an examining system 700 disposed on multiple vehicles 702 of a vehicle system 704 traveling along a route 706. The examining system 700 may represent the examining system 600 shown in FIG. 6. In contrast to the examining system 600 shown in FIG. 6, the examining system 700 is disposed on multiple vehicles 702 in the vehicle system 704, where the vehicles 702 are mechanically coupled together.

In an embodiment, the examining system 700 includes a first application device 708A configured to be disposed on a first vehicle 702A of the vehicle system 702, and a second application device 708B configured to be disposed on a second vehicle 702B of the vehicle system 702. The application devices 708A, 708B may be conductively and/or inductively coupled with different conductive tracks 712, such that the application devices 708A, 708B are disposed diagonally along the vehicle system 704. The first and second vehicles 702A and 702B may be directly coupled, or may be indirectly coupled, having one or more additional vehicles coupled in between the vehicles 702A, 702B. Optionally the vehicles 702A, 702B may each be either one of the vehicles 104 or 106 shown in FIG. 1. Optionally, the second vehicle 702B may trail the first vehicle 702A during travel of the vehicle system 704 along the route 706.

The examining system 700 also includes a first detection unit 710A configured to be disposed on the first vehicle 702A of the vehicle system 702, and a second detection unit 710B configured to be disposed on the second vehicle 702B of the vehicle system 702. The first and second detection units 710A, 710B may be configured to monitor electrical characteristics of the route 706 along different conductive tracks 712, such that the detection units 710 are oriented diagonally along the vehicle system 704. The location of the first application device 708A and/or first detection unit 710A along the length of the first vehicle 702A is optional, as well as the location of the second application device 708B and/or second detection unit 710B along the length of the second vehicle 702B. However, the location of the application devices 708A, 708B affects the length of a current loop that defines a test loop 714. For example, the test loop 714 spans a greater length of the route 706 than the test loop 620 shown in FIG. 6. Increasing the length of the test loop 714 may increase the amount of signal loss as the electrical examination signals are diverted along alternative conductive paths, which diminishes the capability of the detection units 710 to receive the electrical characteristics. Optionally, the application devices 708 and detection units 710 may be disposed on adjacent vehicles 702 and proximate to the coupling mechanism that couples the adjacent vehicles, such that the defined conductive test loop 714 may be smaller in length than the conductive test loop 620 disposed on the single vehicle 602 (shown in FIG. 6).

Figure 8:
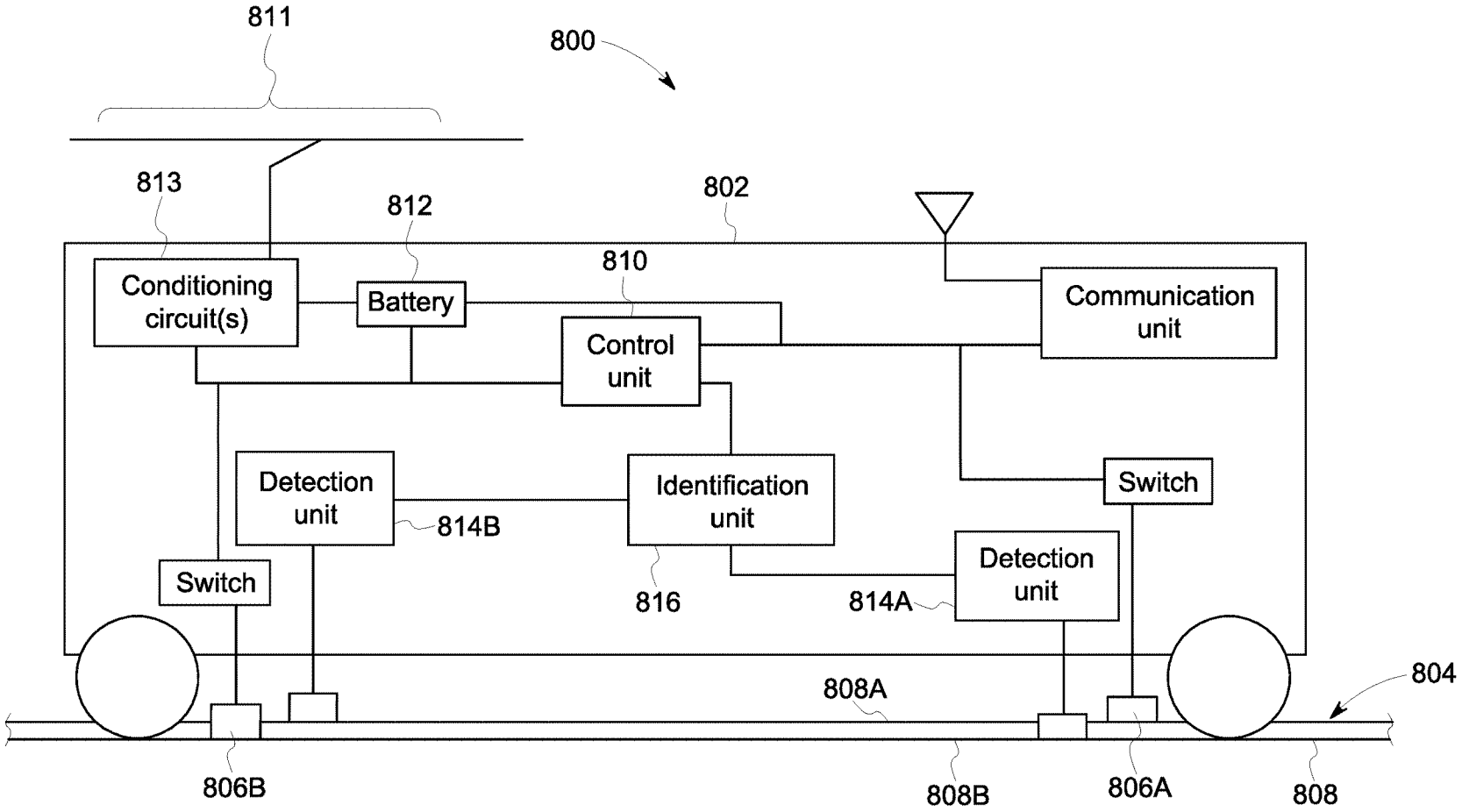
FIG. 8 is a schematic diagram of an embodiment of an examining system on a vehicle of a vehicle system on a route.

FIG. 8 is a schematic diagram of an embodiment of an examining system 800 on a vehicle 802 of a vehicle system (not shown) on a route 804. The examining system 800 may represent the examining system 102 shown in FIG. 1 and/or the examining system 200 shown in FIG. 2. In contrast to the examining system 200, the examining system 800 is disposed within a single vehicle 802. The vehicle 802 may represent at least one of the vehicles 104, 106 shown in FIG. 1.

The vehicle 802 includes a first application device 806A that is conductively and/or inductively coupled to a first conductive track 808A of the route 804, and a second application device 806B that is conductively and/or inductively coupled to a second conductive track 808B. A control unit 810 is configured to control supply of electric current from a power source 811 (e.g., battery 812 and/or conditioning circuits 813) to the first and second application devices 806A, 806B in order to electrically inject examination signals into the conductive tracks 808. For example, the control unit 810 may control the application of a first examination signal into the first conductive track 808A via the first application device 806A and the application of a second examination signal into the second conductive track 808B via the second application device 806B.

The control unit 810 is configured to control application of at least one of a designated direct current, a designated alternating current, or a designated radio frequency signal of each of the first and second examination signals from the power source 811 to the conductive tracks 808 of the route 804. For example, the power source 811 may be an onboard energy storage device 812 (e.g., battery) and the control unit 810 may be configured to inject the first and second examination signals into the route 804 by controlling when electric current is conducted from the onboard energy storage device 812 to the first and second application devices 806A and 806B. Alternatively or in addition, the power source 811 may be an off-board energy storage device 813 (e.g., catenary and conditioning circuits) and the control unit 810 is configured to inject the first and second examination signals into the conductive tracks 808 by controlling when electric current is conducted from the off-board energy storage device 813 to the first and second application devices 806A and 806B.

The vehicle 802 also includes a first detection unit 814A disposed onboard the vehicle 802 that is configured to monitor one or more electrical characteristics of the second conductive track 808B of the route 804, and a second detection unit 814B disposed onboard the vehicle 802 that is configured to monitor one or more electrical characteristics of the first conductive track 808A. An identification unit 816 is disposed onboard the vehicle 802. The identification unit 816 is configured to examine the one or more electrical characteristics of the conductive tracks 808 monitored by the detection units 814A, 814B in order to determine whether a section of the route 804 traversed by the vehicle 802 is potentially damaged based on the one or more electrical characteristics. As used herein, "potentially damaged" means that the section of the route may be damaged or at least deteriorated. The identification unit 816 may further determine whether the section of the route traversed by the vehicle is damaged by distinguishing between one or more electrical characteristics that indicate damage to the section of the route and one or more electrical characteristics that indicate an electrical short on the section of the route.

Figure 9:
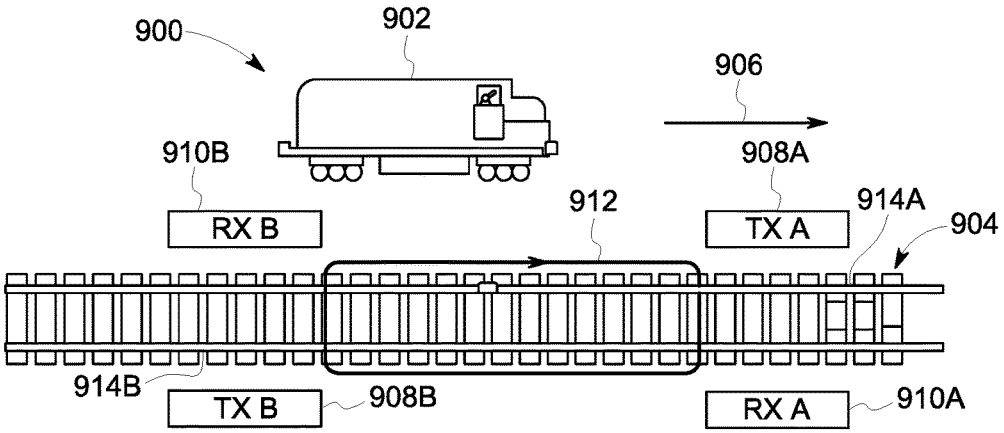
FIG. 9 is a schematic illustration of an embodiment of an examining system on a vehicle as the vehicle travels along a route.
Figure 10:
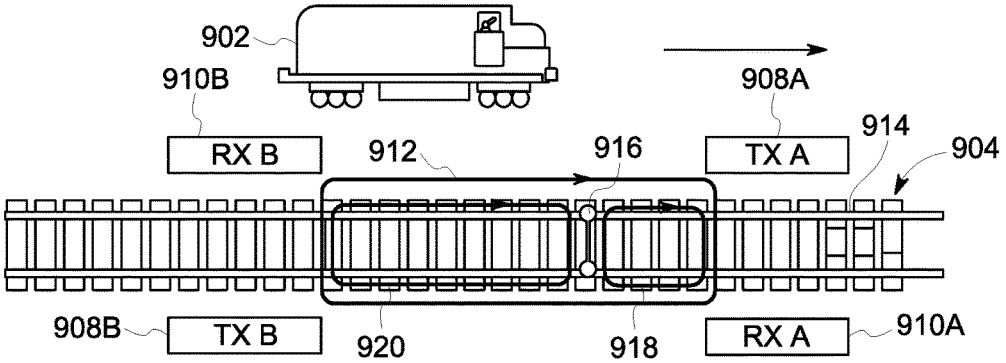
FIG. 10 is another schematic illustration of an embodiment of an examining system on a vehicle as the vehicle travels along a route.
Figure 11:
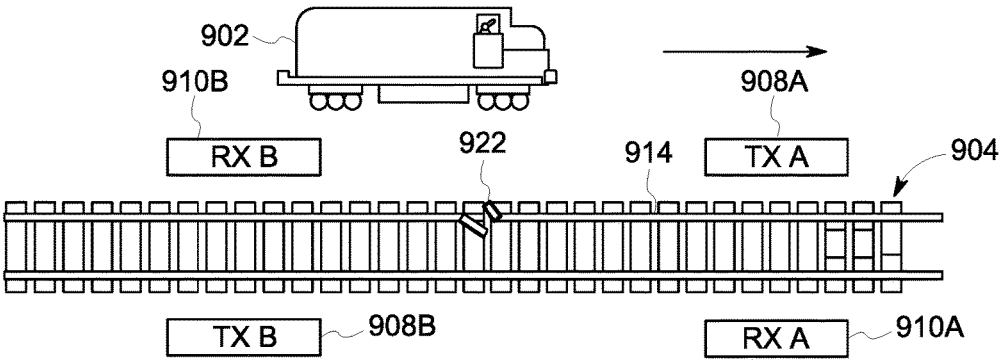
FIG. 11 is another schematic illustration of an embodiment of an examining system on a vehicle as the vehicle travels along a route.

FIGS. 9 through 11 are schematic illustrations of an embodiment of an examining system 900 on a vehicle 902 as the vehicle 902 travels along a route 904. The examining system 900 may be the examining system 600 shown in FIG. 6 and/or the examining system 800 shown in FIG. 8. The vehicle 902 may be the vehicle 602 of FIG. 6 and/or the vehicle 802 of FIG. 8. FIGS. 9 through 11 illustrate various route conditions that the vehicle 902 may encounter while traversing in a travel direction 906 along the route 904.

The vehicle 902 includes two transmitters or application units 908A and 908B, and two receivers or detection units 910A and 910B all disposed onboard the vehicle 902. The application units 908 and detection units 910 are positioned along a conductive loop 912 defined by shunts on the vehicle 902 and tracks 914 of the route 904 between the shunts. For example, the vehicle 902 may include six axles, each axle attached to two wheels in electrical contact with the tracks 914 and forming a shunt. Optionally, the conductive loop 912 may be bounded between the inner most axles (e.g., between the third and fourth axles) to reduce the amount of signal loss through the other axles and/or the vehicle frame. As such, the third and fourth axles define the ends of the conductive loop 912, and the tracks 914 define the segments of the conductive loop 912 that connect the ends.

The conductive loop 912 defines a test loop 912 (e.g., test section) for detecting faults in the route 904 and distinguishing damaged tracks 914 from short circuit false alarms. As the vehicle 902 traverses the route 904, a first examination signal is injected into a first track 914A of the route 904 from the first application unit 908A, and a second examination signal is injected into a second track 914B of the route 904 from the second application unit 908B. The first and second examination signals may be injected into the route 904 simultaneously or in a staggered sequence. The first and second examination signals can each have a unique identifier to distinguish the first examination signal from the second examination signal as the signals circulate the test loop 912. The unique identifier of the first examination signal may include a frequency, a modulation, an embedded signature, and/or the like, that differs from the unique identifier of the second examination signal. For example, the first examination signal may have a higher frequency and/or a different embedded signature than the second examination signal. Alternatively, the examination signals may have different frequencies to allow for differentiation of the signals from each other. For example, the first examination signal may be injected into the route at a frequency of 4.6 kilohertz (kHz), or another frequency, while the second examination signal is injected into the route at a frequency of 3.8 kHz (or another frequency). In one embodiment, the signals may have different identifiers and different frequencies.

In FIG. 9, the vehicle 902 traverses over a section of the route 904 that is intact (e.g., not damaged) and does not have an electrical short. Since there is no electrical short or electrical break on the route 904 within the area of the conductive test loop 912, which is the area between two designated shunts (e.g., axles) of the vehicle 902, the first and second examination signals both circulate a full length of the test loop 912. As such, the first examination signal current transmitted by the first application device 908A is detected by both the first detection device 910A and the second detection device 910B as the first examination signal current flows around the test loop 912. Although the second examination signal is injected into the route 904 at a different location, the second examination signal current circulates the test loop 912 with the first examination signal current, and is likewise detected by both detection devices 910A, 910B. Each of the detection devices 910A, 910B may be configured to detect one or more electrical characteristics along the route 904 proximate to the respective detection device 910. Therefore, when the section of route is free of shorts and breaks, the electrical characteristics received by each of the detection devices 910 includes the unique signatures of each of the first and second examination signals.

In FIG. 10, the vehicle 902 traverses over a section of the route 904 that includes an electrical short 916. The electrical short 916 may be a device on the route 904 or condition of the route 904 that conductively and/or inductively couples the first conductive track 914A to the second conductive track 914B. The electrical short 916 causes current injected in one track 914 to flow through the short 916 to the other track 914 instead of flowing along the full length of the conductive test loop 912 and crossing between the tracks 914 at the shunts. For example, the short 916 may be a piece of scrap metal or other extraneous conductive device positioned across the tracks 914, a non-insulated signal crossing or switch, an insulated switch or joint in the tracks 914 that is non-insulated due to wear or damage, and the like. As the vehicle 902 traverses along route 904 over the electrical short 916, such that the short 916 is at least temporarily located between the shunts within the area defined by the test loop 912, the test loop 912 may short circuit.

As the vehicle 902 traverses over the electrical short 916, the electrical short 916 diverts the current flow of the first and second examination signals that circulate the test loop 912 to additional loops. For example, the first examination signal may be diverted by the short 916 to circulate primarily along a first conductive short loop 918 that is newly-defined along a section of the route 904 between the first application device 908A and the electrical short 916. Similarly, the second examination signal may be diverted to circulate primarily along a second conductive short loop 920 that is newly-defined along a section of the route 904 between the electrical short 916 and the second application device 908B. Only the first examining signal that was transmitted by the first application device 908A significantly traverses the first short loop 918, and only the second examination signal that was transmitted by the second application device 908B significantly traverses the second short loop 920.

As a result, the one or more electrical characteristics of the route received and/or monitored by first detection unit 910A may only indicate a presence of the first examination signal. Likewise, the electrical characteristics of the route received and/or monitored by second detection unit 910B may only indicate a presence of the second examining signal. As used herein, "indicat[ing] a presence of" an examination signal means that the received electrical characteristics include more than a mere threshold signal-to-noise ratio of the unique identifier indicative of the respective examination signal that is more than electrical noise. For example, since the electrical characteristics received by the second detection unit 910B may only indicate a presence of the second examination signal, the second examination signal exceeds the threshold signal-to-noise ratio of the received electrical characteristics but the first examination signal does not exceed the threshold. The first examination signal may not be significantly received at the second detection unit 908B because the majority of the first examination signal current originating at the device 908A may get diverted along the short 916 (e.g., along the first short loop 918) before traversing the length of the test loop 912 to the second detection device 908B. As such, the electrical characteristics with the unique identifiers indicative of the first examination signal received at the second detection device 910B may be significantly diminished when the vehicle 902 traverses the electrical short 916.

The peripheral size and/or area of the first and second conductive short loops 918 and 920 may have an inverse correlation at the vehicle 902 traverses the electrical short 916. For example, the first short loop 918 increases in size while the second short loop 920 decreases in size as the test loop 912 of the vehicle 902 overcomes and passes the short 916. It is noted that the first and second short loops 916 are only formed when the short 916 is located within the boundaries or area covered by the test loop 912. Therefore, received electrical characteristics that indicate the examination signals are circulating the first and second conductive short 918, 920 loops signify that the section includes an electrical short 916 (e.g., as opposed to a section that is damaged or is fully intact without an electrical short).

In FIG. 11, the vehicle 902 traverses over a section of the route 904 that includes an electrical break 922. The electrical break 922 may be damage to one or both tracks 914A, 914B that cuts off (e.g., or significantly reduces) the electrical conductive path along the tracks 914. The damage may be a broken track, disconnected lengths of track, and the like. As such, when a section of the route 904 includes an electrical break, the section of the route forms an open circuit, and current generally does not flow along an open circuit. In some breaks, it may be possible for inductive current to traverse slight breaks, but the amount of current would be greatly reduced as opposed to a non-broken conductive section of the route 904.

As the vehicle 902 traverses over the electrical break 922 such that the break 922 is located within the boundaries of the test loop 912 (e.g., between designated shunts of the vehicle 902 that define the ends of the test loop 912), the test loop 912 may be broken, forming an open circuit. As such, the injected first and second examination signals do not circulate the test loop 912 nor along any short loops. The first and second detection units 910A and 910B do not receive any significant electrical characteristics in response to the first and second examination signals because the signal current do not flow along the broken test loop 912. Once, the vehicle 902 passes beyond the break, subsequently injected first and second examination signals may circulate the test section 912 as shown in FIG. 9. It is noted that the vehicle 902 may traverse an electrical break caused by damage to the route 904 without derailing. Some breaks may support vehicular traffic for an amount of time until the damage increases beyond a threshold, as is known in the art.

As shown in FIG. 9 through 11, the electrical characteristics along the route 904 that are detected by the detection units 910 may differ whether the vehicle 902 traverses over a section of the route 904 having an electrical short 916 (shown in FIG. 10), an electrical break 922 (shown in FIG. 11), or is electrically contiguous (shown in FIG. 9). The examining system 900 may be configured to distinguish between one or more electrical characteristics that indicate a damaged section of the route 904 and one or more electrical characteristics that indicate a non-damaged section of the route 904 having an electrical short 916, as discussed further herein.

Figure 12:
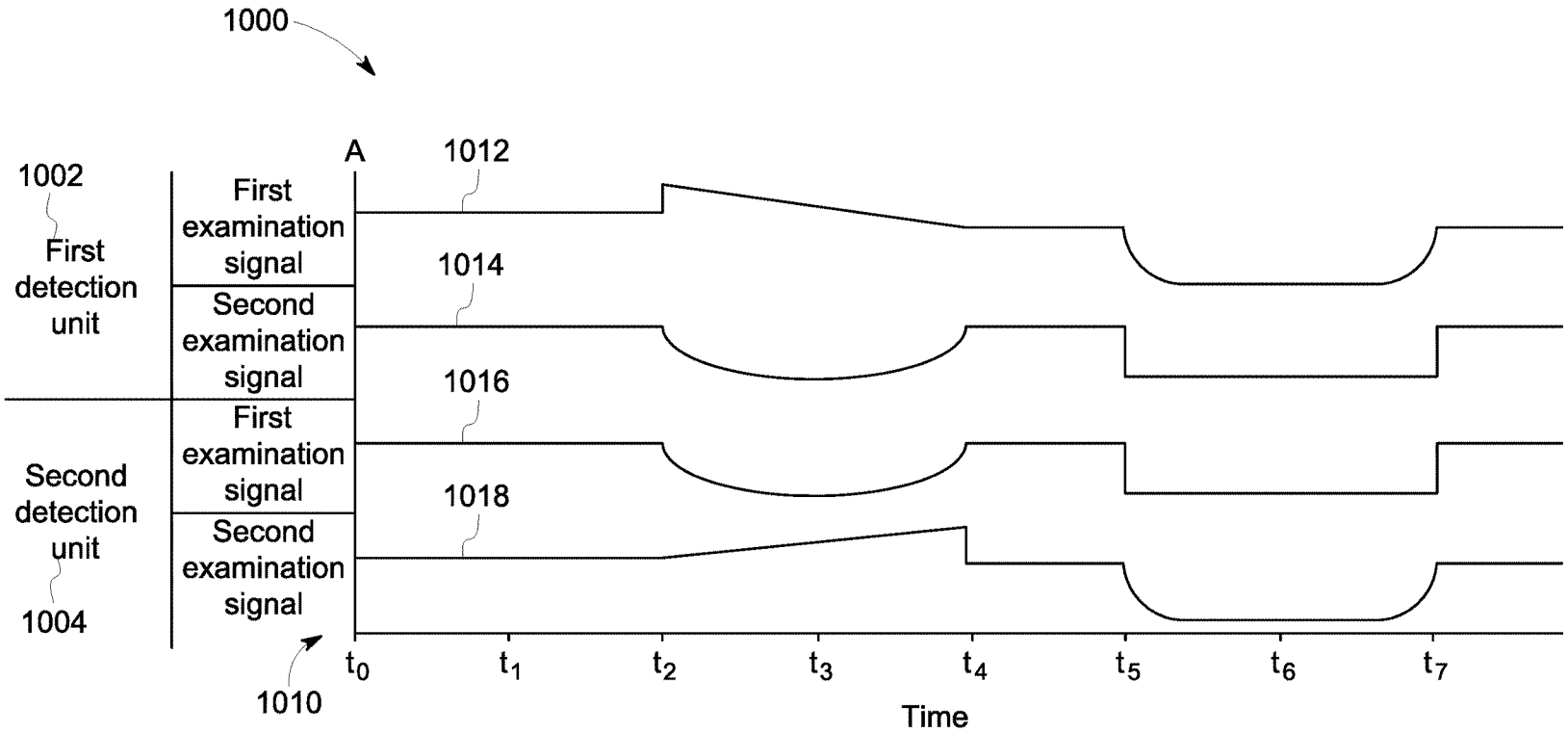
FIG. 12 illustrates electrical signals monitored by an examining system on a vehicle system as the vehicle system travels along a route.

FIG. 12 illustrates electrical signals 1000 monitored by an examining system on a vehicle system as the vehicle system travels along a route. The examining system may be the examining system 900 shown in FIG. 9. The vehicle system may include vehicle 902 traveling along the route 904 (both shown in FIG. 9). The electrical signals 1000 are one or more electrical characteristics that are received by a first detection unit 1002 and a second detection unit 1004. The electrical signals 1000 are received in response to the transmission or injection of a first examination signal and a second examination signal into the route. The first and second examination signals may each include a unique identifier that allows the examining system to distinguish electrical characteristics of a monitored current that are indicative of the first examination signal from electrical characteristics indicative of the second examination signal, even if an electrical current includes both examination signals.

In FIG. 12, the electrical signals 1000 are graphically displayed on a graph 1010 plotting amplitude (A) of the signals 1000 over time (t). For example, the graph 1010 may graphically illustrate the monitored electrical characteristics in response to the first and second examination signals while the vehicle 902 travels along the route 904 and encounters the various route conditions described with reference to FIG. 9. The graph 1010 may be displayed on a display device for an operator onboard the vehicle and/or may be transmitted to an off-board location such as a dispatch or repair facility. The first electrical signal 1012 represents the electrical characteristics in response to (e.g., indicative of the first examination signal that are received by the first detection unit 1002. The second electrical signal 1014 represents the electrical characteristics in response to (e.g., indicative of the second examination signal that are received by the first detection unit 1002. The third electrical signal 1016 represents the electrical characteristics in response to (e.g., indicative of the first examination signal that are received by the second detection unit 1004. The fourth electrical signal 1018 represents the electrical characteristics in response to (e.g., indicative of) the second examination signal that are received by the second detection unit 1004.

Between times t0 and t2, the electrical signals 1000 indicate that both examination signals are being received by both detection units 1002, 1004. Therefore, the signals are circulating the length of the conductive primary test loop 912 (shown in FIGS. 9 and 10). At a time t1, the vehicle is traversing over a section of the route that is intact and does not have an electrical short, as shown in FIG. 9. The amplitudes of the electrical signals 1012-1018 may be relatively constant at a baseline amplitude for each of the signals 1012-1018. The base line amplitudes need not be the same for each of the signals 1012-1018, such that the electrical signal 1012 may have a different base line amplitude than at least one of the other electrical signals 1014-1018.

At time t2, the vehicle traverses over an electrical short. As shown in FIG. 12, immediately after t2, the amplitude of the electrical signal 1012 indicative of the first examination signal received by the first detection unit 1002 increases by a significant gain and then gradually decreases towards the base line amplitude. The amplitude of the electrical signal 1014 indicative of the second examination signal received by the first detection unit 1002 drops below the base line amplitude for the electrical signal 1014. As such, the electrical characteristics received at the first detection unit 1002 indicate a greater significance or proportion of the first examination signal (e.g., due to the first electrical signal circulating newly-defined loop 918 in FIG. 10), while less significance or proportion of the second examination signal than compared to the respective base line levels. At the second detection unit 1004 at time t2, the electrical signal 1016 indicative of the first examination signal drops in like manner to the electrical signal 1016 received by the first detection unit 1002. The electrical signal 1018 indicative of the second examination signal gradually increases in amplitude above the base line amplitude from time t2 to t4 as the test loop passes the electrical short.

These electrical characteristics from time t2 to t4 indicate that the electrical short defines new circuit loops within the primary test loop 912 (shown in FIGS. 9 and 10). The amplitude of the examination signals that were injected proximate to the respective detection units 1002, 1004 increase relative to the base line amplitudes, while the amplitude of the examination signals that were injected on the other side of the test loop (and spaced apart) from the respective detection units 1002, 1004 decrease (or drop) relative to the base line amplitudes. For example the amplitude of the electrical signal 1012 increases by a step right away due to the first examination signal injected by the first application device 908A circulating the newly-defined short loop or sub-loop 918 in FIG. 10 and being received by the first detection unit 910A that is proximate to the first application device 908A. The amplitude of the electrical signal 1012 gradually decreases towards the base line amplitude as the examining system moves relative to the electrical short because the electrical short gets further from the first application device 908A and the first detection unit 910A and the size of the sub-loop 918 increases. The electrical signal 1018 also increases relative to the base line amplitude due to the second examination signal injected by the second application device 908B circulating the newly-defined short loop or sub-loop 920 and being received by the second detection unit 910B that is proximate to the second application device 908A. The amplitude of the electrical signal 1018 gradually increases away from the base line amplitude (until time t4) as the examining system moves relative to the electrical short because the electrical short gets closer to the second application device 908B and second detection unit 910B and the size of the sub-loop 920 decreases. The amplitude of an examination signal may be higher for a smaller circuit loop because less of the signal attenuates along the circuit before reaching the corresponding detection unit than an examination signal in a larger circuit loop. The positive slope of the electrical signal 1018 may be inverse from the negative slope of the electrical signal 1012. For example, the amplitude of the electrical signal 1012 monitored by the first detection device 1002 may be an inverse derivative of the amplitude of the electrical signal 1018 monitored by the second detection device 1004. This inverse relationship is due to the movement of the vehicle relative to the stationary electrical short along the route. Referring also to FIG. 10, time t3 may represent the electrical signals 1012-1018 when the electrical short 916 bisects the test loop 912, and the short loops 918, 920 have the same size.

At time t4, the test section (e.g., loop) of the vehicle passes beyond the electrical short. Between times t4 and t5, the electrical signals 1000 on the graph 1010 indicate that both the first and second examination signals once again circulate the primary test loop 912, as shown in FIG. 9.

At time t5, the vehicle traverses over an electrical break in the route. As shown in FIG. 12, immediately after t5, the amplitude of each of the electrical signals 1012-1018 decrease or drop by a significant step. Throughout the length of time for the test section to pass the electrical break in the route, represented as between times t5 and t7, all four signals 1012-1018 are at a low or at least attenuated amplitude, indicating that the first and second examination signals are not circulating the test loop due to the electrical break in the route. Time t6 may represent the location of the electrical break 922 relative to the route examining system 900 as shown in FIG. 11.

In an embodiment, the identification unit may be configured to use the received electrical signals 1000 to determine whether a section of the route traversed by the vehicle is potentially damaged, meaning that the section may be damaged or at least deteriorated. For example, based on the recorded waveforms of the electrical signals 1000 between times t2-t4 and t5-t7, the identification unit may identify the section of the route traversed between times t2-t4 as being non-damaged but having an electrical short and the section of route traversed between times t5-t7 as being damaged. For example, it is clear in the graph 1010 that the receiver coils or detection units 1002, 1004 both lose signal when the vehicle transits the damaged section of the route between times t5-t7. However, when crossing the short on the route between times t2-t4, the first detection unit 1002 loses the second examination signal, as shown on the electrical signal 1014, and the electrical signal 1018 representing second examination signal received by the second detection unit 1004 increases in amplitude as the short is transited. Thus, there is a noticeable distinction between a break in the track versus features that short the route. Optionally, a vehicle operator may view the graph 1010 on a display and manually identify sections of the route as being damaged or non-damaged but having an electrical short based on the recorded waveforms of the electrical signals 1000.

In an embodiment, the examining system may be further used to distinguish between non-damaged track features by the received electrical signals 1000. For example, wide band shunts (e.g., capacitors) may behave similar to hard wire highway crossing shunts, except an additional phase shift may be identified depending on the frequencies of the first and second examination signals. Narrow band (e.g., tuned) shunts may impact the electrical signals 1000 by exhibiting larger phase and amplitude differences responsive to the relation of the tuned shunt frequency and the frequencies of the examination signals.

The examining system may also distinguish electrical circuit breaks due to damage from electrical breaks (e.g., pseudo-breaks) due to intentional track features, such as insulated joints and turnouts (e.g., track switches). In turnouts, in specific areas, only a single pair of transmit and receive coils (e.g., a single application device and detection unit located along one conductive track) may be able to inject current (e.g., an examination signal). The pair on the opposite track (e.g., rail) may be traversing a "fouling circuit," where the opposite track is electrically connected at only one end, rather than part of the circulating current loop.

With regard to insulated joints, for example, distinguishing insulated joints from broken rails may be accomplished by an extended signal absence in the primary test loop caused by the addition of a dead section loop. As is known in the art, railroad standards typically indicate the required stagger of insulated joints to be 32 in. to 56 in. In addition to the insulated joint providing a pseudo-break with an extended length, detection may be enhanced by identifying location specific signatures of signaling equipment connected to the insulated joints, such as batteries, track relays, electronic track circuitry, and the like. The location specific signatures of the signaling equipment may be received in the monitored electrical characteristics in response to the current circulating the newly-defined short loops 918, 920 (shown in FIG. 9) through the connected equipment. For example, signaling equipment that is typically found near an insulated joint may have a specific electrical signature or identifier, such as a frequency, modulation, embedded signature, and the like, that allows the examination system to identify the signaling equipment in the monitored electrical characteristics. Identifying signaling equipment typically found near an insulated joint provides an indication that the vehicle is traversing over an insulated joint in the route, and not a damaged section of the route.

In the alternative embodiment described with reference to FIG. 6 in which the examining system includes at least two detection units that are spaced apart from each other but less than two application devices (such as zero or one) such that only one examination signal is injected into the route, the monitored electrical characteristics along the route by the two detection units may be shown in a graph similar to graph 1010. For example, the graph may include the plotted electrical signals 1012 and 1016, where the electrical signal 1012 represents the examination signal detected by or received at the first detection unit 1002, and the electrical signal 1016 represents the examination signal detected by or received at the second detection unit 1004. Using only the plotted amplitudes of the electrical signals 1012 and 1016 (instead of also 1014 and 1018), the identification unit may determine the status of the route. Between times t0 and t2, both signals 1012 and 1016 are constant (with a slope of zero) at base line values. Thus, the one or more electrical characteristics indicate that both detection units 1002, 1004 receive the examination signal, and the identification unit determines that the section of the route is non-damaged and does not include an electrical short. Between times t2-and t4, the first detection unit 1002 detects an increased amplitude of the examination signal above the base line (although the slope is negative), while the second detection unit 1004 detects a drop in the amplitude of the examination signal. Thus, the one or more electrical characteristics indicate that the first detection unit 1002 receives the examination signal but the second detection unit 1004 does not, and the identification unit determines that the section of the route includes an electrical short. Finally, between times t5 and t7, both the first and second detection units 1002, 1004 detect drops in the amplitude of the examination signal. Thus, the one or more electrical characteristics indicate that neither of the detection units 1002, 1004 receive the examination signal, and the identification unit determines that the section of the route is potentially damaged. Alternatively, the examination signal may be the second examination signal shown in the graph 1010 such that the electrical signals are the plotted electrical signals 1014 and 1018 instead of 1012 and 1016.

In the alternative embodiment described with reference to FIG. 6 in which the examining system includes at least two application devices that are spaced apart from each other but only one detection unit, the monitored electrical characteristics along the route by the detection unit may be shown in a graph similar to graph 1010. For example, the graph may include the plotted electrical signals 1012 and 1014, where the electrical signal 1012 represents the first examination signal injected by the first application device (such as application device 606A in FIG. 6) and detected by the detection unit 1002 (such as detection unit 616A in FIG. 6), and the electrical signal 1014 represents the second examination signal injected by the second application device (such as application device 606B in FIG. 6) and detected by the same detection unit 1002. Using only the plotted amplitudes of the electrical signals 1012 and 1014 (instead of also 1016 and 1018), the identification unit may determine the status of the route. For example, between times t0 and t2, both signals 1012 and 1014 are constant at the base line values, indicating that the detection unit 1002 receives both the first and second examination signals, so the section of the route is non-damaged. Between times t2 and t4, the one or more electrical characteristics monitored by the detection unit 1002 indicate an increased amplitude of the first examination signal above the base line and a decreased amplitude of the second examination signal below the base line. Thus, during this time period the detection unit 1002 only receives the first examination signal and not the second examination signal (beyond a trace or negligible amount), which indicates that the section of the route may include an electrical short. For example, referring to FIG. 6, the first application device 606A is on the same side of the electrical short as the detection unit 616A, so the first examination signal is received by the detection unit 616A and the amplitude of the electrical signals associated with the first examination signal is increased over the base line amplitude due to the sub-loop created by the electrical short. However, the second application device 606B is on an opposite side of the electrical short from the detection unit 616A, so the second examination signal circulates a different sub-loop and is not received by the detection unit 616A, resulting in the amplitude drop in the plotted signal 1014 over this time period. Finally, between times t5 and t7, the one or more electrical characteristics monitored by the detection unit 1002 indicate drops in the amplitudes of the both the first and second examination signals, so neither of the examination signals are received by the detection unit 1002. Thus, the section of the route is potentially damaged, which causes an open circuit loop and explains the lack of receipt by the detection unit 1002 of either of the examination signals. Alternatively, the detection unit 1002 may be the detection unit 1004 shown in the graph 1010 such that the electrical signals are the plotted electrical signals 1016 and 1018 instead of 1012 and 1014.

In the alternative embodiment described with reference to FIG. 6 in which the examining system includes only one application device and only one detection unit, the monitored electrical characteristics along the route by the detection unit may be shown in a graph similar to graph 1010. For example, the graph may include the plotted electrical signal 1012, where the electrical signal 1012 represents the examination signal injected by the application device (such as application device 606A shown in FIG. 6) and detected by the detection unit 1002 (such as detection unit 161A shown in FIG. 6). Using only the plotted amplitudes of the electrical signal 1012 (instead of also 1014, 1016, and 1018), the identification unit may determine the status of the route. For example, between times t0 and t2, the signal 1012 is constant at the base line value, indicating that the detection unit 1002 receives the examination signal, so the section of the route is non-damaged. Between times t2 and t4, the one or more electrical characteristics monitored by the detection unit 1002 indicate an increased amplitude of the examination signal above the base line, which further indicates that the section of the route includes an electrical short. Finally, between times t5 and t7, the one or more electrical characteristics monitored by the detection unit 1002 indicate a drop in the amplitude of the examination signal, so the examination signal is not received by the detection unit 1002. Thus, the section of the route is potentially damaged, which causes an open circuit loop. Alternatively, the detection unit may be the detection unit 1004 shown in the graph 1010 (such as the detection unit 616B shown in FIG. 6) and the electrical signal is the plotted electrical signal 1018 (injected by the application device 606B shown in FIG. 9) instead of 1012. Thus, the detection unit may be proximate to the application device in order to obtain the plotted electrical signals 1012 and 1018. For example, an application device that is spaced apart from the detection device along a length of the vehicle or vehicle system may result in the plotted electrical signals 1014 or 1016, which both show drops in amplitude when the examining system traverses both a damaged section of the route and an electrical short. A spaced-apart arrangement between the detection unit and the application unit that provides one of the plotted signals 1014, 1016 is not useful in distinguishing between these two states of the route, unless the plotted signal 1014 or 1016 is interpreted in combination with other monitored electrical characteristics, such as phase or modulation, for example.

Figure 13:
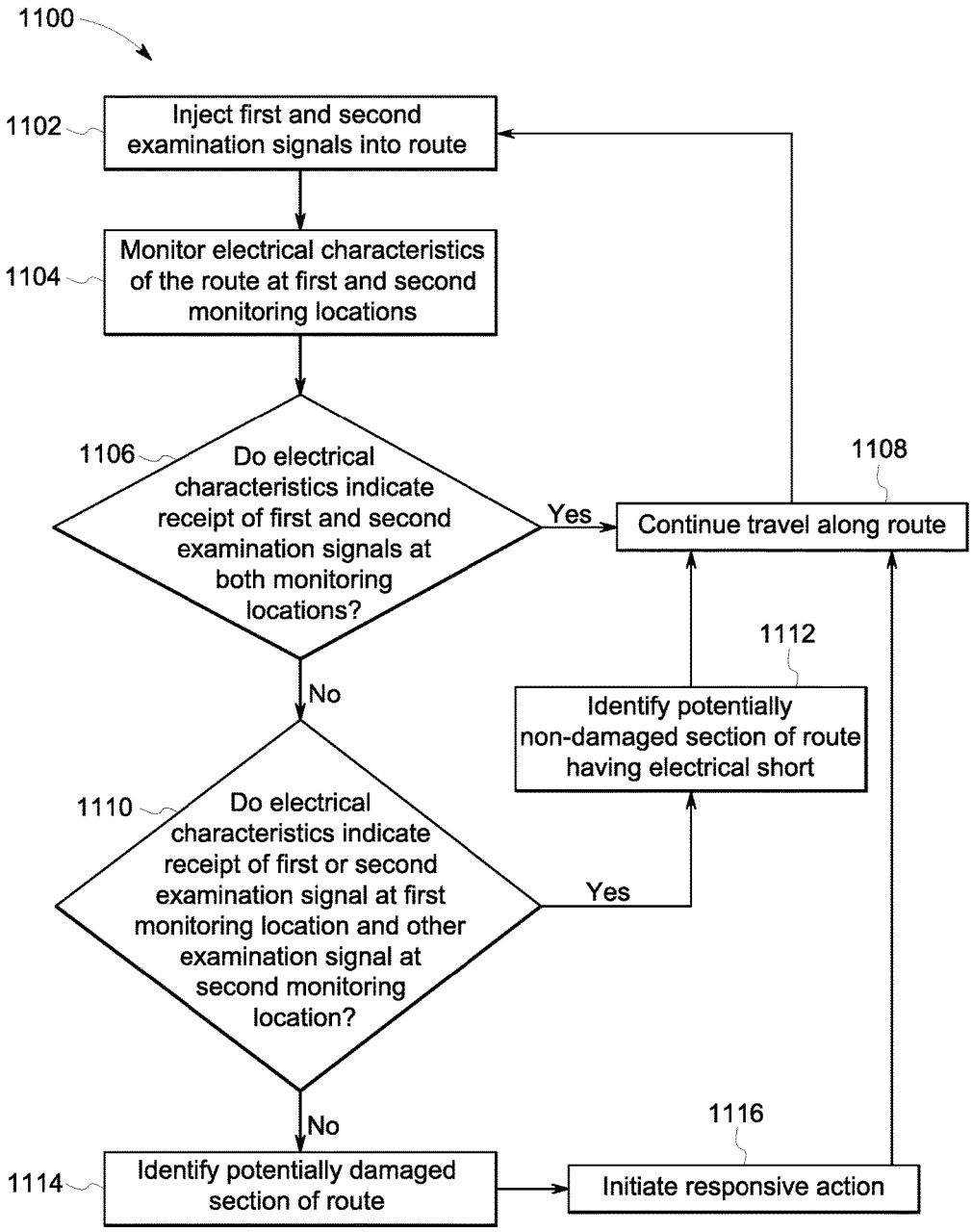
FIG. 13 is a flowchart of an embodiment of a method for examining a route being traveled by a vehicle system from onboard the vehicle system.

FIG. 13 is a flowchart of an embodiment of a method 1100 for examining a route being traveled by a vehicle system from onboard the vehicle system. The method 1100 may be used in conjunction with one or more embodiments of the vehicle systems and/or examining systems described herein. Alternatively, the method 1100 may be implemented with another system.

At 1102, first and second examination signals are electrically injected into conductive tracks of the route being traveled by the vehicle system. The first examination signal may be injected using a first vehicle of the vehicle system. The second examination signal may be injected using the first vehicle at a rearward or frontward location of the first vehicle relative to where the first examination signal is injected. Optionally, the first examination signal may be injected using the first vehicle, and the second examination signal may be injected using a second vehicle in the vehicle system. Electrically injecting the first and second examination signals into the conductive tracks may include applying a designated direct current, a designated alternating current, and/or a designated radio frequency signal to at least one conductive track of the route. The first and second examination signals may be transmitted into different conductive tracks, such as opposing parallel tracks.

At 1104, one or more electrical characteristics of the route are monitored at first and second monitoring locations. The monitoring locations may be onboard the first vehicle in response to the first and second examination signals being injected into the conductive tracks. The first monitoring location may be positioned closer to the front of the first vehicle relative to the second monitoring location. Detection units may be located at the first and second monitoring locations. Electrical characteristics of the route may be monitored along one conductive track at the first monitoring location; the electrical characteristics of the route may be monitored along a different conductive track at the second monitoring location. Optionally, a notification may be communicated to the first and second monitoring locations when the first and second examination signals are injected into the route. Monitoring the electrical characteristics of the route may be performed responsive to receiving the notification.

At 1106, a determination is made as to whether one or more monitored electrical characteristics indicate receipt of both the first and second examination signals at both monitoring locations. For example, if both examination signals are monitored in the electrical characteristics at both monitoring locations, then both examination signals are circulating the conductive test loop 912 (shown in FIG. 9). As such, the circuit of the test loop is intact. But, if each of the monitoring locations monitors electrical characteristics indicating only one or none of the examination signals, then the circuit of the test loop may be affected by an electrical break or an electrical short. If the electrical characteristics do indicate receipt of both first and second examination signals at both monitoring locations, flow of the method 1100 may proceed to 1108.

At 1108, the vehicle continues to travel along the route. Flow of the method 1100 then proceeds back to 1102 where the first and second examination signals are once again injected into the conductive tracks, and the method 1100 repeats. The method 1100 may be repeated instantaneously upon proceeding to 1108, or there may be a wait period, such as 1 second, 2 seconds, or 5 seconds, before re-injecting the examination signals.

Referring back to 1106, if the electrical characteristics indicate that both examination signals are not received at both monitoring locations, then flow of the method 1100 proceeds to 1110. At 1110, a determination is made as to whether one or more monitored electrical characteristics indicate a presence of only the first or the second examination signal at the first monitoring location and a presence of only the other examination signal at the second monitoring location. For example, the electrical characteristics received at the first monitoring location may indicate a presence of only the first examination signal, and not the second examination signal. Likewise, the electrical characteristics received at the second monitoring location may indicate a presence of only the second examination signal, and not the first examination signal. As described herein, "indicat[ing] a presence of" an examination signal means that the received electrical characteristics include more than a mere threshold signal-to-noise ratio of the unique identifier indicative of the respective examination signal that is more than electrical noise.

This determination may be used to distinguish between electrical characteristics that indicate the section of the route is damaged and electrical characteristics that indicate the section of the route is not damaged but may have an electrical short. For example, since the first and second examination signals are not both received at each of the monitoring locations, the route may be identified as being potentially damaged due to a broken track that is causing an open circuit. However, an electrical short may also cause one or both monitoring locations to not receive both examination signals, potentially resulting in a false alarm. Therefore, this determination is made to distinguish an electrical short from an electrical break.

For example, if neither examination signal is received at either of the monitoring locations as the vehicle system traverses over the section of the route, the electrical characteristics may indicate that the section of the route is damaged (e.g., broken). Alternatively, the section may be not damaged but including an electrical short if the one or more electrical characteristics monitored at one of the monitoring locations indicate a presence of only one of the examination signals. This indication may be strengthened if the electrical characteristics monitored at the other monitoring location indicate a presence of only the other examination signal. Additionally, a non-damaged section of the route having an electrical short may also be indicated if an amplitude of the electrical characteristics monitored at the first monitoring location is an inverse derivative of an amplitude of the electrical characteristics monitored at the second monitoring location as the vehicle system traverses over the section of the route. If the monitored electrical characteristics indicate significant receipt of only one examination signal at the first monitoring location and only the other examination signal at the second monitoring location, then flow of the method 1100 proceeds to 1112.

At 1112, the section of the route is identified as being non-damaged but having an electrical short. In response, the notification of the identified section of the route including an electrical short may be communicated off-board and/or stored in a database onboard the vehicle system. The location of the electrical short may be determined more precisely by comparing a location of the vehicle over time to the inverse derivatives of the monitored amplitudes of the electrical characteristics monitored at the monitoring locations. For example, the electrical short may have been equidistant from the two monitoring locations when the inverse derivatives of the amplitude are monitored as being equal. Location information may be obtained from a location determining unit, such as a GPS device, located on or off-board the vehicle. After identifying the section as having an electrical short, the vehicle system continues to travel along the route at 1108.

Referring now back to 1100, if the monitored electrical characteristics do not indicate significant receipt of only one examination signal at the first monitoring location and only the other examination signal at the second monitoring location, then flow of the method 1100 proceeds to 1114. At 1114, the section of the route is identified as damaged. Since neither monitoring location receives electrical characteristics indicating at least one of the examination signals, it is likely that the vehicle is traversing over an electrical break in the route, which prevents most if not all of the conduction of the examination signals along the test loop. The damaged section of the route may be disposed between the designated axles of the first vehicle that define ends of the test loop based on the one or more electrical characteristics monitored at the first and second monitoring locations. After identifying the section of the route as being damaged, flow proceeds to 1116.

At 1116, responsive action is initiated in response to identifying that the section of the route is damaged. For example, the vehicle, such as through the control unit and/or identification unit, may be configured to automatically slow movement, automatically notify one or more other vehicle systems of the damaged section of the route, and/or automatically request inspection and/or repair of the damaged section of the route. A warning signal may be communicated to an off-board location that is configured to notify a recipient of the damaged section of the route. A repair signal to request repair of the damaged section of the route may be communicated off-board as well. The warning and/or repair signals may be communicated by at least one of the control unit or the identification unit located onboard the vehicle. Furthermore, the responsive action may include determining a location of the damaged section of the route by obtaining location information of the vehicle from a location determining unit during the time that the first and second examination signals are injected into the route. The calculated location of the electrical break in the route may be communicated to the off-board location as part of the warning and/or repair signal. Optionally, responsive actions, such as sending warning signals, repair signals, and/or changing operational settings of the vehicle, may be at least initiated manually by a vehicle operator onboard the vehicle or a dispatcher located at an off-board facility.

In addition or as an alternate to using one or more embodiments of the route examination systems described herein to detect damaged sections of a route, one or more embodiments of the route examination systems may be used to determine location information about the vehicles on which the route examination systems are disposed. The location information can include a determination of which route of several different routes on which the vehicle is currently disposed, a determination of the location of the vehicle on a route, a direction of travel of the vehicle along the route, and/or a speed at which the vehicle is moving along the route.

Figure 14:
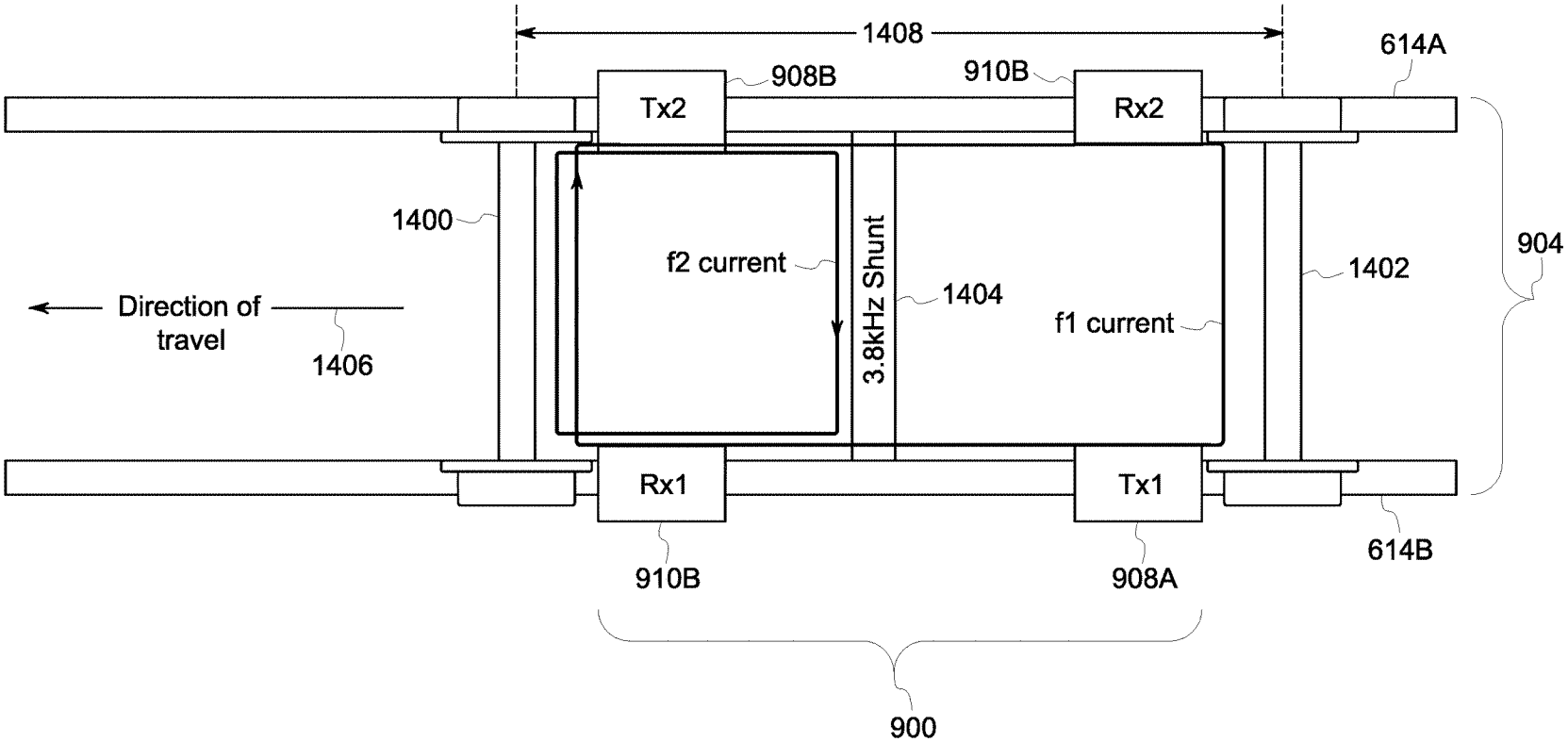
FIG. 14 is a schematic illustration of an embodiment of the examining system on the vehicle as the vehicle travels along the route.

FIG. 14 is a schematic illustration of an embodiment of the examining system 900 on the vehicle 902 as the vehicle 902 travels along the route 904. While only two axles 1400, 1402 ("Axle 3" and "Axle 4" in FIG. 14) are shown in FIG. 14, the vehicle 902 may include a different number of axles and/or axles other than the third and fourth axles of the vehicle 902 may be used.

The route 904 can be formed from the conductive rails 614 described above (e.g., the rails 614A, 614B). The route 904 can include one or more frequency tuned shunts 1404 that extend between the conductive rails 614A, 614B. A frequency tuned shunt 1404 can form a conductive pathway or short between the rails 614A, 614B of the route 904 for an electric signal that is conducted in the rails 614A, 614B at a frequency to which the shunt 1404 is tuned. For example, the shunt 1404 shown in FIG. 14 is tuned to a frequency of 3.8 kHz. An electric signal having a frequency of 3.8 kHz that is conducted along the rail 614A will also be conducted through the shunt 1404 to the rail 614B (and/or such a signal may be conducted from the rail 614B to the rail 614A through the shunt 1404). Electric signals having other frequencies (e.g., 4.6 kHz or another frequency), however, will not be conducted by the shunt 1404. As a result, a signal having a frequency to which the shunt 1404 is tuned (referred to as a tuned frequency) that is injected into the rail 614A by the application unit 908B ("Tx2" in FIG. 14) will be conducted along a circuit loop or path that includes the rail 614A, the axle 1400, the rail 614B, and the shunt 1404. This signal is detected by the detection unit 910B ("Rx1" in FIG. 14). Similarly, a signal having the tuned frequency that is injected into the rail 614B by the application unit 908A ("Tx1" in FIG. 14) will be conducted along a circuit loop or path that includes the rail 614B, the axle 1402, the rail 614A, and the shunt 1404. In one embodiment, one or more of the detection units may detect signals having different frequencies.

A signal that has a frequency other than the tuned frequency and that is injected into the rail 614A by the application unit 908B will be conducted along a circuit loop or path that includes the rail 614A, the axle 1400, the rail 614B, and the axle 1402, but that does not include the shunt 1404. Similarly, a signal that has a frequency other than the tuned frequency and that is injected into the rail 614B by the application unit 908A will be conducted along a circuit loop or path that includes the rail 614B, the axle 1402, the rail 614A, and the axle 1400, but that does not include the shunt 1404. A shunt that is tuned to multiple frequencies, such as 3.8 kHz and 4.6 kHz or a range of frequencies that include 3.8 kHz and 4.6 kHz, will conduct the signals. For example, a shunt that is tuned to a range of frequencies that include both 3.8 kHz and 4.6 kHz will conduct signals having frequencies of 3.8 kHz or 4.6 kHz between the rails 614A, 614B.

One or more frequency tuned shunts can be disposed across routes at designated locations to calibrate the location of vehicles traveling along the routes. The frequency tuned shunts can be read by the examining systems described herein to define a specific location of the vehicle on the route. This can allow for accurate calibration of location of the vehicle when combined with a location determining system of the vehicle (e.g., a global positioning system receiver, wireless transceiver, or the like), and can increase the accuracy of the location of the vehicle when using a dead reckoning technique and/or when another locating method is unavailable. The detection of the frequency tuned shunts also can also be used to determine which route of several different routes on which a vehicle is currently located.

The examining system can use multiple different frequencies to test the route beneath the vehicle for damage. By placing an element such as a frequency tuned shunt on the route that responds to one or a combination of the frequencies, and placing such elements at planned differences in spacing along the route, codes can be generated to convey information about the specific location to the vehicle in an economical and reliable manner.

Figure 15:
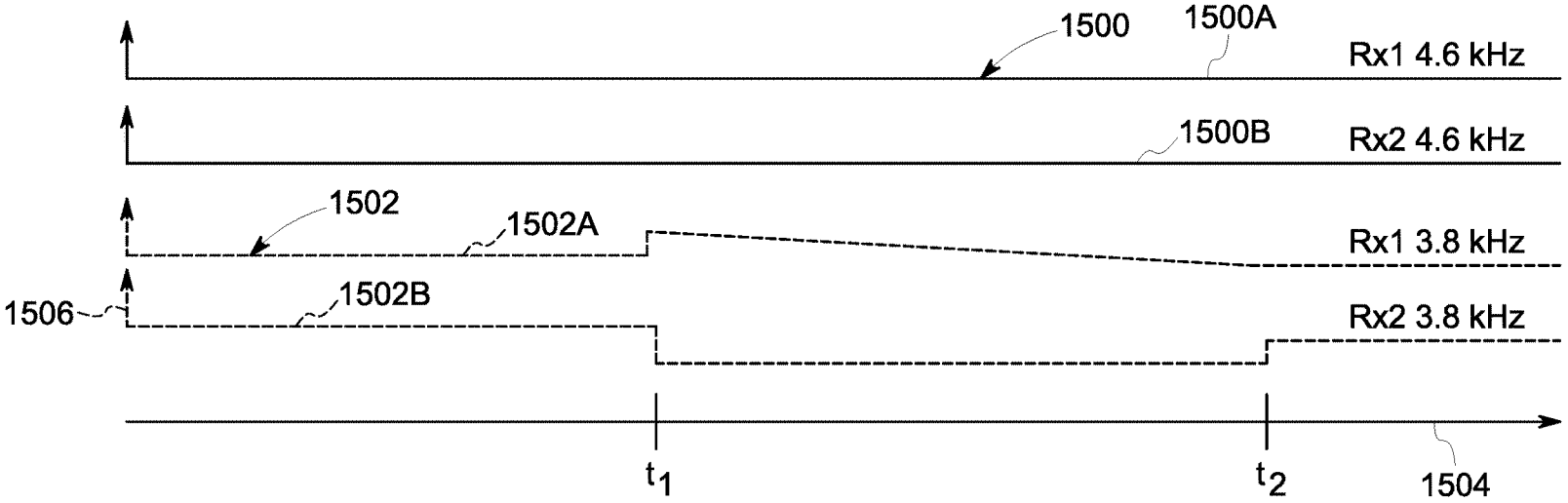
FIG. 15 illustrates electrical characteristics that may be monitored by the examining system on a vehicle system as the vehicle system travels along the route according to one example.

FIG. 15 illustrates electrical characteristics 1500 (e.g., electrical characteristics 1500A, 1500B) and electrical characteristics 1502 (e.g., electrical characteristics 1502A, 1502B) of the route that may be monitored by the examining system on a vehicle system as the vehicle system travels along the route 904 (shown in FIG. 14) according to one example. The electrical characteristics 1500, 1502 are shown alongside a horizontal axis 1504 representative of time or distance along the route 904 and vertical axes 1506 representative of magnitudes of the electrical characteristics 1500, 1502 (as measured by the detection units 910A, 910B shown in FIG. 14. The electrical characteristics 1500, 1502 represent the magnitudes of first and second signals injected into the rails 614 (shown in FIG. 14) of the route 904 by the application units 908, as detected by the detection units 910A, 910B during travel of the vehicle system over the frequency tuned shunt 1404.

The application unit 908A can inject a first signal having a frequency that is not the tuned frequency of the shunt 1404 (or that is outside of the range of tuned frequencies of the shunt 1404). The application unit 908B can inject a second signal having the tuned frequency of the shunt 1404 (or that is within the range of tuned frequencies of the shunt 1404). The detection unit 910A can detect magnitudes of the first and second signals as conducted to the detection unit 910A through the rail 614A and the detection unit 910B can detect magnitudes of the first and second signals as conducted to the detection unit 910B through the rail 614B. The electrical characteristic 1500A represents the magnitudes of the first signal (the non-tuned frequency signal) as detected by the detection unit 910B and the electrical characteristic 1500B represents the magnitudes of the first signal as detected by the detection unit 910A. The electrical characteristic 1502A represents the magnitudes of the second signal (the tuned frequency signal) as detected by the detection unit 910B and the electrical characteristic 1502B represents the magnitudes of the second signal as detected by the detection unit 910A.

A time t1 indicates when the axle 1400 (e.g., a leading axle) passes the shunt 1404 as the vehicle system travels along a direction of travel 1406 shown in FIG. 14. A time t2 indicates when the axle 1402 (e.g., a trailing axle) passes the shunt 1404 as the vehicle system travels along the direction of travel 1406. The time period including and between the times t1 and t2 represents when the shunt 1404 is disposed between the axles 1400, 1402.

Prior to the axle 1400 passing over the shunt 1404 (e.g., before the time t1), the first and second signals are conducted through a circuit formed from the axles 1400, 1402 and the sections of the rails 614 that extend from and between the axles 1400, 1402. As a result, the magnitudes of the electrical characteristics 1500, 1502 do not appreciably change (e.g., the electrical characteristics 1500, 1502 may not change in magnitude or the changes in the magnitude may be caused by noise or outside interference).

Upon the axle 1400 passing the shunt 1404, however, different circuits are formed for the different first and second signals, depending on the frequencies of the signals. For example, for the first signal (the non-tuned frequency signal), the circuit through which the first signal is conducted to the detection units 910A, 910B does not change. As a result, the magnitudes of the electrical characteristics 1500A, 1500B do not appreciably change. For the second signal (the tuned frequency signal), the shunt 1404 conducts the second signal and a smaller, different circuit is formed. The circuit that conducts the second signal includes the axle 1400, the shunt 1404, and the sections of the rails 614 extending from the axle 1400 to the shunt 1404. This circuit for the second signal also can prevent the second signal from being conducted to the detection unit 910A. The smaller circuit that includes the shunt 1404 can prevent the second signal from reaching and being detected by the detection unit 910A.

The detection unit 910B detects an increase in the second signal at or near the time t1, as indicated by the increase in the electrical characteristic 1502A shown in FIG. 15. This increase may be caused by decreased electrical impedance in the circuit formed from the axle 1400, the shunt 1404, and the sections of the rails 614 extending from the axle 1400 to the shunt 1404. For example, because this circuit is shorter than the circuit that does not include the shunt 1404, the electrical impedance may be less.

The detection unit 910A may no longer be able to detect the second signal after time t1 due to the circuit formed with the shunt 1404. The circuit formed with the shunt 1404 can prevent the second signal from being conducted in the rail 614A. The detection unit 910A may detect a decrease or elimination of the second signal, as represented by the decrease in the electrical characteristic 1502B at time t1.

As the vehicle moves over the shunt 1404, the axle 1400 moves farther from the shunt 1404. This increasing distance from the axle 1400 to the shunt 1404 increases the size of the circuit that includes the axle 1400 and the shunt 1404. The impedance of the circuit through which the electrical characteristic 1502A is conducted increases from time t1 to time t2. The increasing impedance can decrease the magnitude of the second signal (as detected by the detection unit 910B). As a result, the magnitude of the electrical characteristic 1502A detected by the detection unit 910B decreases from time t1 to time t2. With respect to the detection unit 910A, because the shunt 1404 continues to prevent the second signal from being conducted to the detection unit 910A, the magnitude of the electrical characteristics 1502B remain reduced, as shown in FIG. 15.

Once the vehicle system has moved over the shunt 1404 and the shunt 1404 is no longer between the axles 1400, 1402 (e.g., after time t2), the second signal is again conducted through the circuit that does not include the shunt 1404 and that is formed from the axles 1400, 1402 and the sections of the rails 614 extending between the axles 1400, 1402. The magnitude of the second signal as detected by the detection unit 910B may return to a level that was measured prior to time t1. Because the shunt 1404 is no longer preventing the detection unit 910A from detecting the second signal after time t2, the value of the electrical characteristic 1502B may increase back to the level that existed prior to the time t1.

The examining system can analyze two or more of the electrical characteristics 1500A, 1500B, 1502A, 1502B to differentiate detection of a frequency tuned shunt 1404 from detection of a damaged section of the route 904 and/or the presence of another shunt on the route 904. A break 922 in a rail 614 in the route 904 may result in two or more signals 1012, 1014, 1016, 1018 as detected by the detection units 910A, 910B to decrease during concurrent times, as shown in FIG. 12 during the time period extending from time t5 to time t7. In contrast, only one of the electrical characteristics 1500A, 1500B, 1502A, 1502B decreases during passage of the vehicle system over the shunt 1404. The control unit and/or identification unit can determine how many electrical characteristics 1500A, 1500B, 1502A, 1502B decrease at a time to determine if the vehicle system is traveling over a damaged section of the route 904 or over a frequency tuned shunt 1404. A shunt 916 that is not a frequency tuned shunt 1404 causes two or more (or all) of the signals 1012, 1014, 1016, 1018 to increase and/or decrease during passage over the shunt 916, as shown in FIG. 12 during the time period from time t2 to the time t4. In contrast, only the signals detected by a single detection unit 910B change during passage over a frequency tuned shunt 1404. Therefore, if signals detected by two or more detection units change, then the shunt that is detected may not be a frequency tuned shunt. If signals detected by the same detection unit change, but the signals detected by another detection unit do not change, then the shunt that is detected may be a frequency tuned shunt.

The examining systems described herein can examine the electrical characteristics 1500, 1502 to determine a variety of information about the vehicle system and/or the route 904, in addition to or as an alternate to detecting damage to the route 904. As one example, the control unit 206, 506 and/or identification unit 220, 520 can identify which route 904 the vehicle system is traveling along. Different routes 904 may have frequency tuned shunts 1404 in different locations and/or sequences. The location of the shunts 1404 and/or sequences of the shunts 1404 may be unique to the routes 904 such that, upon detecting the shunts 1404, the examining systems can determine which route 904 the vehicle system is traveling along.

For example, a first route 904 may have a first shunt 1404 tuned to a first frequency and a second route 904 may have a second shunt 1404 tuned to a second frequency. The examining system can inject signals having one or more of the first or second frequencies to attempt to detect the first and/or second shunt 1404. Upon detecting one or more of the changes in the electrical characteristics 1502, the examining system can determine that the vehicle system traveled over the first or second shunt 1404. If the examining system is injecting an electrical test signal having the first frequency into the route 904 and the examining system detects the changes in the signal that are similar to the changes in the electrical characteristics 1502A and/or 1502B, the examining system can determine that the vehicle system passed over the first shunt 1404. The first route 904 may be associated with the first shunt 1404 in a memory 540 of the examining system (shown in FIG. 5, such as a memory of the control unit, identification unit, or the like, and/or as communicated to the examining system) such that, upon detecting the first shunt 1404, the examining system determines that the vehicle system is on the first route 904.

If the examining system is injecting the electrical test signal having the first frequency into the route 904 and the examining system does not detect the changes in the signal that are similar to the changes in the electrical characteristics 1502A and/or 1502B, the examining system can determine that the vehicle system has not passed over the first shunt 1404. The examining system can then determine that the vehicle system is not on the first route 904.

If the examining system is injecting an electrical test signal having the second frequency into the route 904 and the examining system detects the changes in the signal that are similar to the changes in the electrical characteristics 1502A and/or 1502B, the examining system can determine that the vehicle system passed over the second shunt 1404. The second route 904 may be associated with the second shunt 1404 such that, upon detecting the second shunt 1404, the examining system determines that the vehicle system is on the second route 904. If the examining system is injecting the electrical test signal having the second frequency into the route 904 and the examining system does not detect the changes in the signal that are similar to the changes in the electrical characteristics 1502A and/or 1502B, the examining system can determine that the vehicle system has not passed over the second shunt 1404. The examining system can then determine that the vehicle system is not on the second route 904.

Additionally or alternatively, different routes 904 may be associated with different sequences of two or more frequency tuned shunts 1404. A sequence of shunts 1404 can represent an order in which the shunts 1404 are encountered by a vehicle system traveling over the sequence of shunts 1404, and optionally may include the frequencies to which the shunts 1404 are tuned and/or distances between the shunts 1404. For example, Table 1 below represents different sequences of shunts 1404 in different routes 904:

TABLE 1

| Route | Shunt Sequence |
|---|---|
| 1 | A, A, A, A |
| 2 | A, A, A, B |
| 3 | A, A, B, A |
| 4 | A, B, A, A |
| 5 | B, A, A, A |
| 6 | A, A, B, B |
| 7 | A, B, B, A |
| 8 | B, B, A, A |
| 9 | A, B, B, B |
| 10 | B, B, B, A |
| 11 | A, B, A, B |
| 12 | B, A, B, A |
| 13 | B, B, B, B |
| 14 | B, B, A, B |
| 15 | B, A, B, B |
| 16 | B, A, A, B |

The letters A and B represent different frequencies to which the shunts 1404 are tuned. While each sequence of the shunts 1404 in Table 1 includes four shunts 1404, alternatively, one or more of the sequences may include a different number of shunts 1404. While the sequences only include two different frequencies, optionally, one or more sequences may include more frequencies.

The examining system can track the order in which different shunts 1404 are detected by the vehicle system to determine which route 904 that the vehicle system is traveling along. For example, if the examining system detects a shunt 1404 tuned to frequency B, followed by another shunt 1404 tuned to frequency B, followed by another shunt 1404 tuned to frequency A, followed by a shunt 1404 tuned to frequency A, then the examining system can determine that the vehicle system is on the eighth route 904 listed above.

A shunt sequence optionally may include distances between shunts 1404. Table 2 below illustrates examples of shunt sequences that also include distances:

| Route | Shunt Sequence |
|---|---|
| 9 | A, 50 m, A |
| 10 | A, 30 m, B |
| 11 | A, 100 m, A |
| 12 | B, 20 m, A, 30 m, A |

The numbers 50 m, 30 m, and so on, listed between the letters A and/or B represent distances between the shunts 1404 tuned to the A or B frequency. The examining system can detect the shunts 1404 tuned to the different frequencies, the order in which these shunts 1404 are detected, and the distance between the shunts 1404, in order to determine which route the vehicle system is traveling along.

Using the detection of one or more frequency tuned shunts 1404 to determine which route 904 the vehicle system is traveling along can be useful for the control unit 206, 506 to differentiate between different routes 904 that are closely spaced together. Some routes 904 may be sufficiently close to each other that the resolution of other location determining systems (e.g., global positioning systems, wireless triangulation, etc.) may not be able to differentiate between which of the different routes 904 that the vehicle system is traveling along. At times, the vehicle system may not be able to rely on such other location determining systems, such as when the vehicle system is traveling in a tunnel, in valleys, urban areas, or the like. The detection of a frequency tuned shunt 1404 associated with a route 904 can allow the examining systems to determine which route 904 the vehicle system is on when the other location determining systems may be unable to determine which route 904 the vehicle system is traveling on.

In another example, the control unit 206, 506 and/or identification unit 220, 520 can determine where the vehicle system is located along a route 904 using detection of one or more shunts 1404. Different locations along the routes 904 may have frequency tuned shunts 1404 in different locations and/or sequences. The location of the shunts 1404 and/or sequences of the shunts 1404 may be unique to the locations along the routes 904 such that, upon detecting the shunts 1404, the examining systems can determine where the vehicle system is located along a route 904.

For example, a first location along a route 904 may have a first shunt 1404 tuned to a first frequency and a second location along the route 904 may have a second shunt 1404 tuned to a second frequency. The examining system can inject signals having one or more of the first or second frequencies to attempt to detect the first and/or second shunt 1404. Upon detecting one or more of the changes in the electrical characteristics 1502, the examining system can determine that the vehicle system traveled over the first or second shunt 1404. If the examining system is injecting an electrical test signal having the first frequency into the route 904 and the examining system detects the changes in the signal that are similar to the changes in the electrical characteristics 1502A and/or 1502B, the examining system can determine that the vehicle system passed over the first shunt 1404. The first location along the route 904 may be associated with the first shunt 1404 in the memory 540 of the examining system such that, upon detecting the first shunt 1404, the examining system determines that the vehicle system is at the location along the first route 904 associated with the first shunt 1404.

If the examining system is injecting the electrical test signal having the first frequency into the route 904 and the examining system does not detect the changes in the signal that are similar to the changes in the electrical characteristics 1502A and/or 1502B, the examining system can determine that the vehicle system has not passed over the first shunt 1404. The examining system can then determine that the vehicle system is not located at the location on the first route 904 that is associated with the first shunt 1404.

If the examining system is injecting an electrical test signal having the second frequency into the route 904 and the examining system detects the changes in the signal that are similar to the changes in the electrical characteristics 1502A and/or 1502B, the examining system can determine that the vehicle system passed over the second shunt 1404. The second location along the route 904 may be associated with the second shunt 1404 such that, upon detecting the second shunt 1404, the examining system determines that the vehicle system is at the location on the route 904 associated with the second shunt 1404. If the examining system is injecting the electrical test signal having the second frequency into the route 904 and the examining system does not detect the changes in the signal that are similar to the changes in the electrical characteristics 1502A and/or 1502B, the examining system can determine that the vehicle system has not passed over the second shunt 1404. The examining system can then determine that the vehicle system is not at the location along the route 904 that is associated with the second shunt 1404

Additionally or alternatively, different locations along routes 904 may be associated with different sequences of two or more frequency tuned shunts 1404. Similar to as described above, detection of shunts 1404 in a sequence associated with a designated location along a route 904 can allow for the examining system to determine where the vehicle system is located along the route.

Using the detection of one or more frequency tuned shunts 1404 to determine where the vehicle system is located along a route 904 can be useful for the control unit 206, 506 to determine where the vehicle system is located. As described above, the vehicle system may not be able to rely on other location determining systems to determine where the vehicle system is located. Additionally, the examining system can determine the location of the vehicle system to assist in calibrating or updating a location that is based on a dead reckoning technique. For example, if the vehicle system is using dead reckoning to determine where the vehicle system is located, determination of the location of the vehicle system using the shunts 1404 can serve as a check or update on the location as determined using dead reckoning.

The determined location of the vehicle system may be used to calibrate or update other location determining systems of the vehicle system, such as global positioning system receivers, wireless transceivers, or the like. Some location determining systems may be unable to provide locations of the vehicle system after initialization of the location determining systems. For example, after turning the vehicle system and/or the location determining systems on, the location determining systems may be unable to determine the locations of the vehicle systems for a period of time that the location determining systems are initializing. The detection of frequency tuned shunts during this initialization can allow for the vehicle systems to determine the locations of the vehicle systems during the initialization.

Optionally, the failure to detect a frequency tuned shunt 1404 in a designated location can be used by the examining system to determine that the shunt 1404 is damaged or has been removed. Because the locations of the frequency tuned shunts 1404 may be stored in the memory 540 of the vehicle system and/or communicated to the vehicle system, the failure to detect a frequency tuned shunt 1404 at the designated location of the shunt 1404 can serve to notify the examining system that the shunt 1404 is damaged and/or has been removed. The examining system and/or control unit can then notify an operator of the vehicle system of the damaged and/or missing shunt 1404, can cause the communication unit to automatically send a signal to a scheduling or dispatch facility to schedule inspection, repair, or replacement of the shunt 1404, or the like.

In another example, the control unit 206, 506 and/or identification unit 220, 520 can determine a direction of travel of the vehicle system responsive to detecting one or more frequency tuned shunts 1404. Upon detecting the changes in the electrical characteristics 1502 that indicate presence of a frequency tuned shunt 1404, the identification unit can examine one or more aspects of the electrical characteristics 1502 to determine a direction of travel 1406. The identification unit can examine the slope of the electrical characteristic 1502 to determine the direction of travel 1406. If the electrical characteristic 1502 has a negative slope between time t1 and t2, then the slope can indicate that the vehicle system has the direction of travel 1406 shown in FIG. 14. But, if the electrical characteristic 1502 has a positive slope between time t1 and t2, the slope can indicate that the vehicle system has an opposite direction of travel.

In another example, the control unit 206, 506 and/or identification unit 220, 520 can determine a moving speed of the vehicle system responsive to detecting one or more frequency tuned shunts 1404. In one aspect, the examining system can determine the time period elapsed between time t1 and t2 based on the changes in the electrical characteristic 1502A and/or 1502B that indicate detection of the shunt 1404. Based on the elapsed time period and a separation distance 1408 (shown in FIG. 14) between the axles 1400, 1402, the control unit and/or identification unit can calculate a moving speed of the vehicle system. For example, if the separation distance 1408 is 397 inches (e.g., ten meters) and the time period between t1 and t2 is 1.13 seconds, then the examining system can determine that the vehicle system is traveling at approximately twenty miles per hour (e.g., 32 kilometers per hour).

In another example, the control unit 206, 506 and/or identification unit 220, 520 can determine a moving speed of the vehicle system responsive to detecting one or more frequency tuned shunts 1404. In one aspect, the examining system can determine the slope of the electrical characteristic 1502A between the time t1 and the time t2. Larger absolute values of the slopes may be associated with faster speeds of the vehicle system than smaller absolute values of the slopes. Different absolute values of slopes may be associated with different speeds in the memory 540 of the examining system and/or as communicated to the examining system. The control unit and/or identification unit can determine the absolute value of the slope in the electrical characteristic 1502A and compare the determined slope to absolute values of the slopes associated with different speeds to determine how fast the vehicle system is moving.

Figure 16:
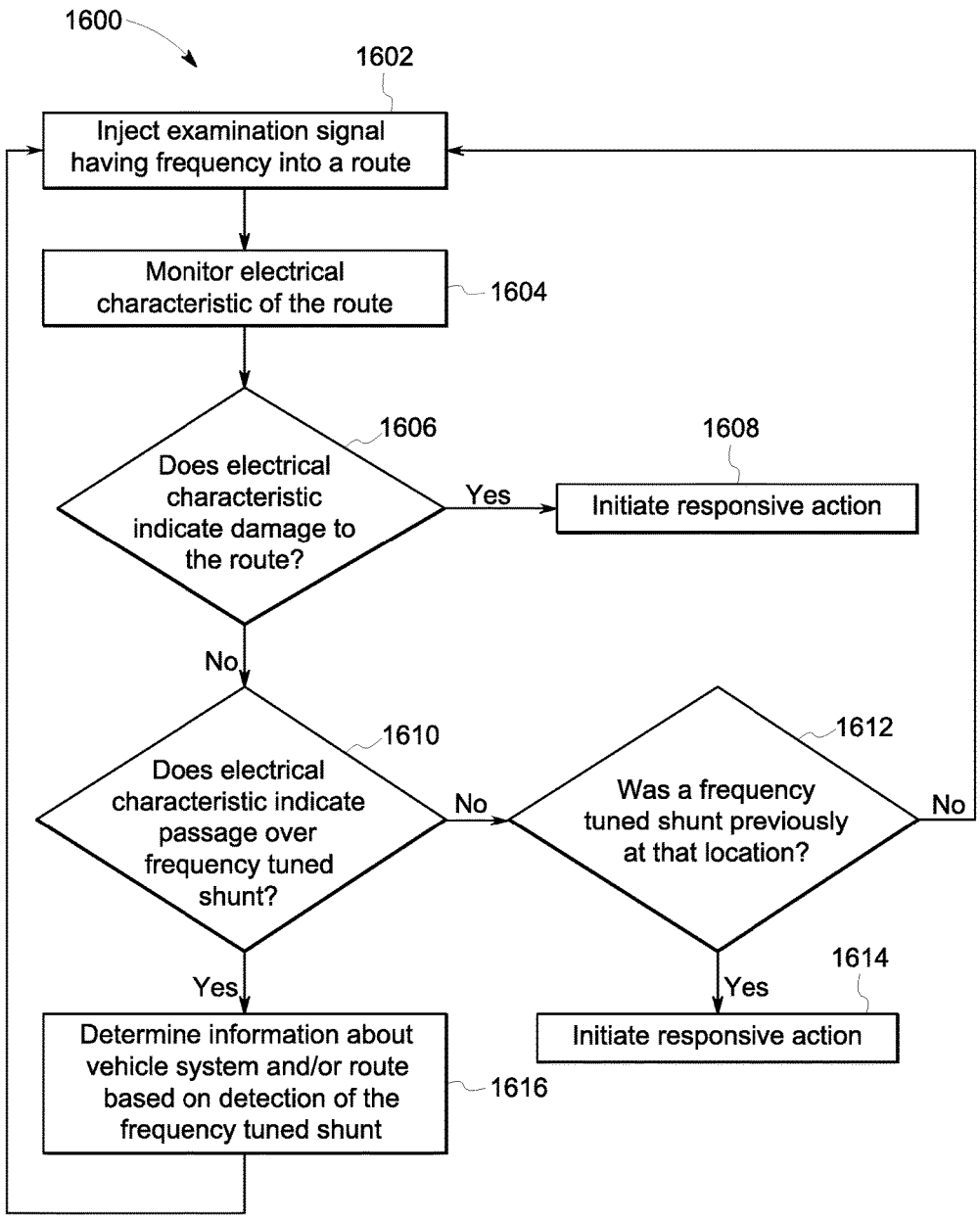
FIG. 16 illustrates a flowchart of one embodiment of a method for examining a route and/or determining information about the route and/or a vehicle system.

FIG. 16 illustrates a flowchart of one embodiment of a method 1600 for examining a route and/or determining information about the route and/or a vehicle system. The method 1600 may be performed by one or more embodiments of the examining systems described herein to detect damage to a route, detect a shunt on the route, and/or determine information about the route and/or a vehicle system traveling on the route.

At 1602, an examination signal having a designated frequency is injected into the route. The examination signal may have a frequency associated with one or more frequency tuned shunts. Optionally multiple examination signals may be injected into the route. For example, different signals having different frequencies associated with frequency tuned shunts may be injected into the route.

At 1604, one or more electrical characteristics of the route are monitored. For example, the voltages, currents, resistances, impedances, or the like, of the route may be monitored, as described herein. At 1606, the one or more electrical characteristics that are monitored may be examined to determine if the one or more electrical characteristics indicate damage to the route, as described above. Optionally, the one or more electrical characteristics may be examined to determine if a shunt (e.g., other than a frequency tuned shunt) is on the route, as described above. If the one or more electrical characteristics indicate damage to the route, flow of the method 1600 may proceed toward 1608. Otherwise, flow of the method 1600 can proceed toward 1610. At 1608, one or more responsive actions may be initiated to detection of the damage to the route, as described above.

At 1610, a determination is made as to whether the one or more electrical characteristics indicate passage of the vehicle system over a frequency tuned shunt. As described above, the characteristic can be examined as one or more of the electrical characteristics 1500, 1502 shown in FIG. 15. If the characteristic indicates movement over the frequency tuned shunt, then flow of the method 1600 can proceed toward 1616. Otherwise, flow of the method 1600 can proceed toward 1612.

At 1612, a determination is made as to whether a frequency tuned shunt previously was at the location of the vehicle. For example, if no frequency tuned shunt was detected at a location, but a frequency tuned shunt is supposed to be at the location, then the failure to detect the shunt can indicate that the shunt is damaged or removed. As a result, flow of the method 1600 can proceed toward 1614. If a frequency tuned shunt is not known to have previously been at that location, however, then flow of the method 1600 can return toward 1602 or the method 1600 can terminate.

At 1614, one or more responsive actions can be implemented responsive to the failure to detect the shunt. For example, an operator of the vehicle system may be notified, a message may be communicated to an off-board location to automatically schedule inspection, repair, or replacement of the frequency tuned shunt, etc.

At 1616, information about the vehicle system and/or route is determined based on detection of the frequency tuned shunt. As described above, the route on which the vehicle is traveling may be identified, the location of the vehicle system along the route may be determined, the direction of travel of the vehicle system, the speed of the vehicle system, etc., may be determined based on detection of one or more frequency tuned shunts. Flow of the method 1600 may return to 1602 or the method 1600 may terminate.

In an embodiment, a system (e.g., a route examining system) includes first and second application devices, a control unit, first and second detection units, and an identification unit. The first and second application devices are configured to be disposed onboard a vehicle of a vehicle system traveling along a route having first and second conductive tracks. The first and second application devices are each configured to be at least one of conductively or inductively coupled with one of the conductive tracks. The control unit is configured to control supply of electric current from a power source to the first and second application devices in order to electrically inject a first examination signal into the conductive tracks via the first application device and to electrically inject a second examination signal into the conductive tracks via the second application device. The first and second detection units are configured to be disposed onboard the vehicle. The detection units are configured to monitor one or more electrical characteristics of the first and second conductive tracks in response to the first and second examination signals being injected into the conductive tracks. The identification unit is configured to be disposed onboard the vehicle. The identification unit is configured to examine the one or more electrical characteristics of the first and second conductive tracks monitored by the first and second detection units in order to determine whether a section of the route traversed by the vehicle and electrically disposed between the opposite ends of the vehicle is potentially damaged based on the one or more electrical characteristics.

In an aspect, the first application device is disposed at a spaced apart location along a length of the vehicle relative to the second application device. The first application device is configured to be at least one of conductively or inductively coupled with the first conductive track. The second application device is configured to be at least one of conductively or inductively coupled with the second conductive track.

In an aspect, the first detection unit is disposed at a spaced apart location along a length of the vehicle relative to the second detection unit. The first detection unit is configured to monitor the one or more electrical characteristics of the second conductive track. The second detection unit is configured to monitor the one or more electrical characteristics of first conductive track.

In an aspect, the first and second examination signals include respective unique identifiers to allow the identification unit to distinguish the first examination signal from the second examination signal in the one or more electrical characteristics of the route.

In an aspect, the unique identifier of the first examination signal includes at least one of a frequency, a modulation, or an embedded signature that differs from the unique identifier of the second examination signal.

In an aspect, the control unit is configured to control application of at least one of a designated direct current, a designated alternating current, or a designated radio frequency signal of each of the first and second examination signals from the power source to the conductive tracks of the route.

In an aspect, the power source is an onboard energy storage device and the control unit is configured to inject the first and second examination signals into the route by controlling conduction of electric current from the onboard energy storage device to the first and second application devices.

In an aspect, the power source is an off-board energy storage device and the control unit is configured to inject the first and second examination signals into the route by controlling conduction of electric current from the off-board energy storage device to the first and second application devices.

In an aspect, further comprising two shunts disposed at spaced apart locations along a length of the vehicle. The two shunts configured to at least one of conductively or inductively couple the first and second conductive tracks to each other at least part of the time when the vehicle is traveling over the route. The first and second conductive tracks and the two shunts define an electrically conductive test loop when provides a circuit path for the first and second examination signals to circulate.

In an aspect, the two shunts are first and second trucks of the vehicle. Each of the first and second trucks includes an axle interconnecting two wheels that contact the first and second conductive tracks. The wheels and the axle of each of the first and second trucks are configured to at least one of conductively or inductively couple the first conductive track to the second conductive track to define respective ends of the conductive test loop.

In an aspect, the identification unit is configured to identify at least one of a short circuit in the conductive test loop caused by an electrical short between the first and second conductive tracks or an open circuit in the conductive test loop caused by an electrical break on at least the first conductive track or the second conductive track.

In an aspect, when the section of the route has an electrical short positioned between the two shunts, a first conductive short loop defined along the first and second conductive tracks of the second of the route between one of the two shunts and the electrical short. A second conductive short loop is defined along the first and second conductive tracks of the section of the route between the other of the two shunts and the electrical short. The first application device and the first detection unit are disposed along the first conductive short loop. The second application device and the second detection unit are disposed along the second conductive short loop.

In an aspect, the identification unit is configured to determine whether the section of the route traversed by the vehicle is potentially damaged by distinguishing between one or more electrical characteristics that indicate the section is damaged and one or more electrical characteristics that indicate the section is not damaged but has an electrical short.

In an aspect, the identification unit is configured to determine the section of the route is damaged when the one or more electrical characteristics received by the first detection unit and the second detection unit both fail to indicate conduction of the first or second examination signals through the conductive tracks as the vehicle traverses the section of the route.

In an aspect, the identification unit is configured to determine the section of the route is not damaged but has an electrical short when an amplitude of the one or more electrical characteristics indicative of the first examination signal monitored by the first detection unit is an inverse derivative of an amplitude of the one or more electrical characteristics indicative of the second examination signal monitored by the second detection unit as the vehicle traverses the section of the route.

In an aspect, the identification unit is configured to determine the section of the route is not damaged but has an electrical short when the one or more electrical monitored by the first detection unit only indicate a presence of the first examination signal and the one or more electrical characteristics monitored by the second detection unit only indicate a presence of the second examination signals as the vehicle traverses over the section of the route.

In an aspect, in response to determining that the section of the route is a potentially damaged section of the route, at least one of the control unit or the identification unit is configured to at least one of automatically slow movement of the vehicle system, automatically notify one or more other vehicle systems of the potentially damaged section of the route, or automatically request at least one of inspection or repair of the potentially damaged section of the route.

In an aspect, in response to determining that the section of the route is damaged, at least one of the control unit or the identification unit is configured to communicate a repair signal to an off-board location to request repair of the section of the route.

In an aspect, the vehicle system further includes a location determining unit configured to determine the location of the vehicle along the route. At least one of the control unit or the identification unit is configured to determine a location of the section of the route by obtaining the location of the vehicle from the location determining unit when the control unit injects the first and second examination signals into the conductive tracks.

In an embodiment, a method (e.g., for examining a route being traveled by a vehicle system) includes electrically injecting first and second examination signals into first and second conductive tracks of a route being traveled by a vehicle system having at least one vehicle. The first and second examination signals are injected using the vehicle at spaced apart locations along a length of the vehicle. The method also includes monitoring one or more electrical characteristics of the first and second conductive tracks at first and second monitoring locations that are onboard the vehicle in response to the first and second examination signals being injected into the conductive tracks. The first monitoring location is spaced apart along the length of the vehicle relative to the second monitoring location. The method further includes identifying a section of the route traversed by the vehicle system is potentially damaged based on the one or more electrical characteristics monitored at the first and second monitoring locations.

In an aspect, the first examination signal is injected into the first conductive track and the second examination signal is injected into the second conductive track. The electrical characteristics along the second conductive track are monitored at the first monitoring location, and the electrical characteristics along the first conductive track are monitored at the second monitoring location.

In an aspect, the first and second examination signals include respective unique identifiers to allow for distinguishing the first examination signal from the second examination signal in the one or more electrical characteristics of the conductive tracks.

In an aspect, electrically injecting the first and second examination signals into the conductive tracks includes applying at least one of a designated direct current, a designated alternating current, or a designated radio frequency signal to at least one of the conductive tracks of the route.

In an aspect, the method further includes communicating a notification to the first and second monitoring locations when the first and second examination signals are injected into the route. Monitoring the one or more electrical characteristics of the route is performed responsive to receiving the notification.

In an aspect, identifying the section of the route is damaged includes determining if one of the conductive tracks of the route is broken when the first and second examination signals are not received at the first and second monitoring locations.

In an aspect, the method further includes communicating a warning signal when the section of the route is identified as being damaged. The warning signal is configured to notify a recipient of the damage to the section of the route.

In an aspect, the method further includes communicating a repair signal when the section of the route is identified as being damaged. The repair signal is communicated to an off-board location to request repair of the damage to the section of the route.

In an aspect, the method further includes distinguishing between one or more electrical characteristics that indicate the section of the route is damaged and one or more electrical characteristics that indicate the section is not damaged but has an electrical short.

In an aspect, one or more electrical characteristics indicate the section of the route is damaged when neither the first examination signal nor the second examination signal is received at the first or second monitoring locations as the vehicle system traverses the section of the route.

In an aspect, monitoring the one or more electrical characteristics of the first and second conductive tracks includes monitoring the first and second examination signals circulating an electrically conductive test loop that is defined by the first and second conductive tracks between two shunts disposed along the length of the vehicle. If the section of the route includes an electrical short between the two shunts, the first examination signal circulates a first conductive short loop defined between one of the two shunts and the electrical short, and the second examination signal circulates a second conductive short loop defined between the other of the two shunts and the electrical short.

In an aspect, the section of the route is identified as non-damaged but has an electrical short when an amplitude of the electrical characteristics indicative of the first examination signal monitored at the first monitoring location is an inverse derivative of an amplitude of the electrical characteristics indicative of the second examination signal monitored at the second monitoring location as the vehicle system traverses the section of the route.

In an aspect, the section of the route is identified as non-damaged but has an electrical short when the electrical characteristics monitored at the first monitoring location only indicate a presence of the first examination signal, and the electrical characteristics monitored at the second monitoring location only indicate a presence of the second examination signal as the vehicle system traverses the section of the route.

In an aspect, the method further includes determining a location of the section of the route that is damaged by obtaining from a location determining unit a location of the vehicle when the first and second examination signals are injected into the route.

In another embodiment, a system (e.g., a route examining system) includes first and second application devices, a control unit, first and second detection units, and an identification unit. The first application device is configured to be disposed on a first vehicle of a vehicle system traveling along a route having first and second conductive tracks. The second application device is configured to be disposed on a second vehicle of the vehicle system trailing the first vehicle along the route. The first and second application devices are each configured to be at least one of conductively or inductively coupled with one of the conductive tracks. The control unit is configured to control supply of electric current from a power source to the first and second application devices in order to electrically inject a first examination signal into the first conductive track via the first application device and a second examination signal into the second conductive track via the second application device. The first detection unit is configured to be disposed onboard the first vehicle. The second detection unit is configured to be disposed onboard the second vehicle. The detection units are configured to monitor one or more electrical characteristics of the conductive tracks in response to the first and second examination signals being injected into the conductive tracks. The identification unit is configured to examine the one or more electrical characteristics of the conductive tracks monitored by the first and second detection units in order to determine whether a section of the route traversed by the vehicle system is potentially damaged based on the one or more electrical characteristics.

In an aspect, the first detection unit is configured to monitor one or more electrical characteristics of the second conductive track. The second detection unit is configured to monitor one or more electrical characteristics of the first conductive track.

In an aspect, when the section of the route has an electrical short positioned between two shunts of the vehicle system, a first conductive short loop is defined along the first and second conductive tracks between one of the two shunts and the electrical short. A second conductive short loop is defined along the first and second conductive tracks of the section of the route between the other of the two shunts and the electrical short. The first application device and the first detection unit are disposed along the first conductive short loop. The second application device and the second detection unit are disposed along the second conductive short loop.

In an embodiment, a method (e.g., for examining a route and/or determining information about the route and/or a vehicle system) includes injecting a first electrical examination signal into a conductive route from onboard a vehicle system traveling along the route, detecting a first electrical characteristic of the route based on the first electrical examination signal, and detecting, using a route examining system that also is configured to detect damage to the route based on the first electrical characteristic, a first frequency tuned shunt in the route based on the first electrical characteristic.

In one aspect, detecting the first frequency tuned shunt in the route occurs responsive to a frequency of the first electrical examination signal being one or more of a tuned frequency or within a range of tuned frequencies of the first frequency tuned shunt.

In one aspect, the method also includes identifying the route from among several different routes based on detection of the first frequency tuned shunt.

In one aspect, the method also includes determining a location of the vehicle system along the route based on detection of the first frequency tuned shunt.

In one aspect, the method also includes determining a direction of travel of the vehicle system based on detection of the first frequency tuned shunt.

In one aspect, the method also includes determining a speed of the vehicle system based on detection of the first frequency tuned shunt.

In one aspect, the method also includes determining that a second frequency tuned shunt is one or more of missing or damaged based on a failure to detect the second frequency tuned shunt at a designated location associated with the second frequency tuned shunt.

In one aspect, the method also includes identifying the route from among several different routes based on detection of a sequence of frequency tuned shunts that includes the first frequency tuned shunt and one or more other frequency tuned shunts, wherein the sequence is associated with the route.

In one aspect, the method also includes determining a location of the vehicle system along the route based on detection of a sequence of frequency tuned shunts that includes the first frequency tuned shunt and one or more other frequency tuned shunts, wherein the sequence is associated with the location along the route.

In one aspect, the first electrical examination signal injected into the route has a first frequency to which the first frequency tuned shunt is tuned. The method also can include injecting a second electrical examination signal having a different, second frequency into the route from onboard the vehicle system, detecting a second electrical characteristic of the route based on the second electrical examination signal, and differentiating between the damage to the route or detection of the first frequency tuned shunt based on the first and second electrical characteristics.

In an embodiment, a system (e.g., a route examining system) includes a first application unit configured to inject a first electrical examination signal into a conductive route from onboard a vehicle system traveling along the route, a first detection unit configured to measure a first electrical characteristic of the route based on the first electrical examination signal, and an identification unit configured to detect damage to the route based on the first electrical characteristic and to detect a first frequency tuned shunt in the route based on the first electrical characteristic.

In one aspect, the identification unit is configured to detect the first frequency tuned shunt in the route responsive to a frequency of the first electrical examination signal being one or more of a tuned frequency or within a range of tuned frequencies of the first frequency tuned shunt.

In one aspect, the identification unit is configured to identify the route from among several different routes based on detection of the first frequency tuned shunt.

In one aspect, the identification unit is configured to determine a location of the vehicle system along the route based on detection of the first frequency tuned shunt.

In one aspect, the identification unit is configured to determine a direction of travel of the vehicle system based on detection of the first frequency tuned shunt.

In one aspect, the identification unit is configured to determine a speed of the vehicle system based on detection of the first frequency tuned shunt.

In one aspect, the identification unit is configured to determine that a second frequency tuned shunt is one or more of missing or damaged based on a failure to detect the second frequency tuned shunt at a designated location associated with the second frequency tuned shunt.

In one aspect, the identification unit is configured to identify the route from among several different routes based on detection of a sequence of frequency tuned shunts that includes the first frequency tuned shunt and one or more other frequency tuned shunts, wherein the sequence is associated with the route.

In one aspect, the identification unit is configured to determine a location of the vehicle system along the route based on detection of a sequence of frequency tuned shunts that includes the first frequency tuned shunt and one or more other frequency tuned shunts, wherein the sequence is associated with the location along the route.

In one aspect, the first application unit is configured to inject the first electrical examination signal with a first frequency to which the first frequency tuned shunt is tuned. The system also can include a second application unit configured to inject a second electrical examination signal having a different, second frequency into the route from onboard the vehicle system and a second detection unit configured to detect a second electrical characteristic of the route based on the second electrical examination signal. The identification unit can be configured to differentiate between the damage to the route or detection of the first frequency tuned shunt based on the first and second electrical characteristics.

In an embodiment, a system (e.g., a route examining system) includes a first application unit configured to inject a first electrical signal having a first frequency into a first conductive rail of a route from onboard a vehicle system, a first detection unit configured to monitor a first characteristic of the first conductive rail of the route from onboard the vehicle system based on the first electrical signal, a second application unit configured to inject a second electrical signal having a different, second frequency into a second conductive rail of the route from onboard the vehicle system, a second detection unit configured to monitor a second characteristic of the second conductive rail of the route from onboard the vehicle system based on the second electrical signal, and an identification unit configured to detect damage to the route and to determine one or more of identify the route from several different routes, determine a location of the vehicle system along the route, determine a direction of travel of the vehicle system, determine a speed of the vehicle system, or identify a missing or damaged frequency tuned shunt based on one or more of the first or second characteristic.

Another embodiment disclosed herein provides for systems and methods that detect and classify broken rails by extracting features from electrical characteristics of the rails and classifying these features with pattern recognition, machine learning, and/or signal processing methods. The system and method operate in two or more stages. A first stage includes detecting broken rails based on changes in electrical characteristics in rails responsive to injecting electric examination signals into the rails. To reduce the rate of false-positive detections, a second stage refines the first-pass detection by discriminating broken rails from likely sources of false-positive confusions, such as poor wheel-to-rail shunting and noise, using pattern recognition or machine learning methods.

Figure 17:
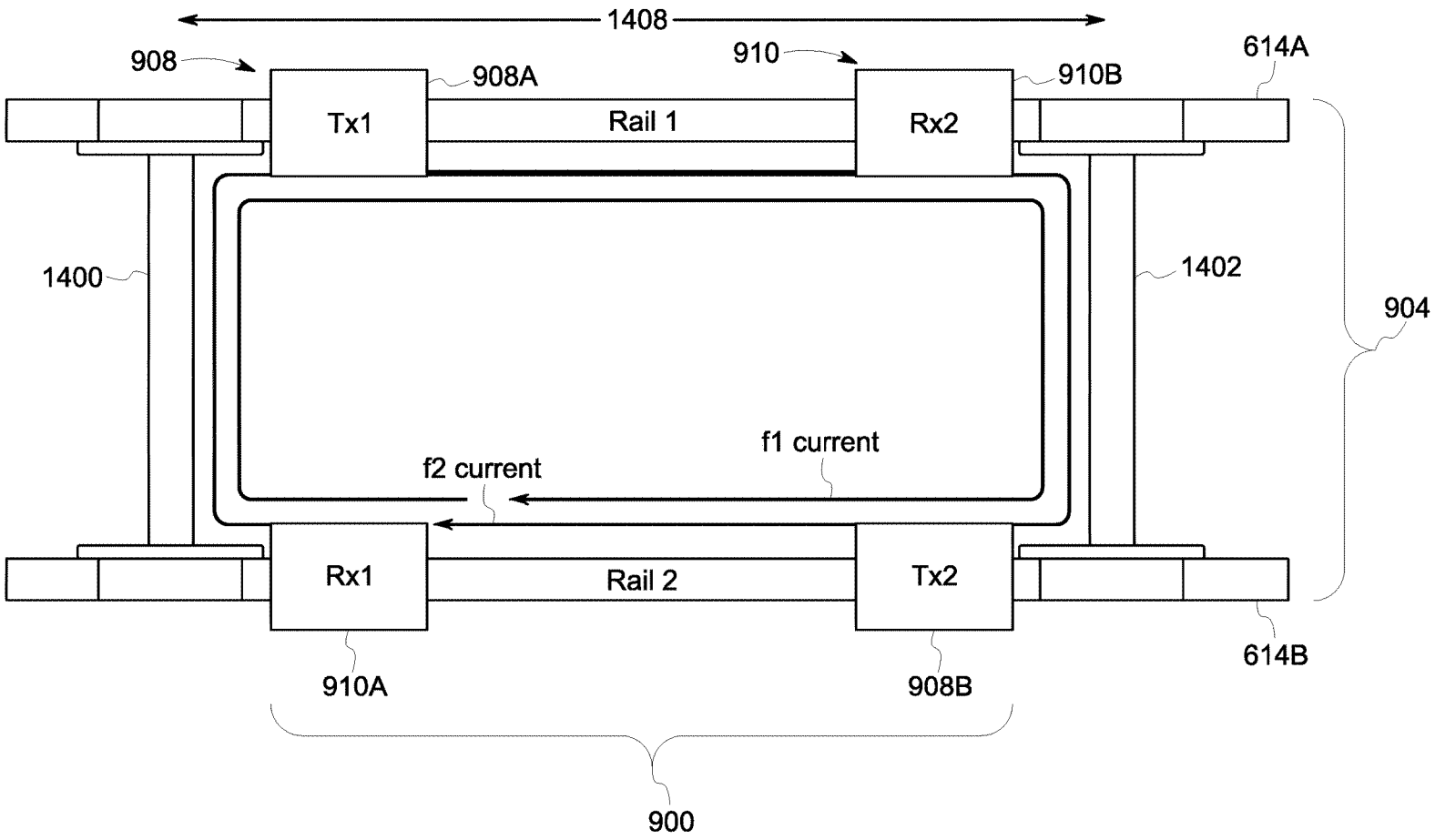
FIG. 17 illustrates another example of the examining system shown herein in operation.

FIG. 17 illustrates another example of the examining system 900 in operation. In the illustrated example, the examining system 900 travels over the route 904 and includes the application unit 908A ("Tx1" in FIG. 17) that injects an examination signal having a first frequency (e.g., "f1 current" in FIG. 17) into the rail 614A ("Rail 1" in FIG. 17) and the application unit 908B ("Tx2" in FIG. 17) that injects an examination signal having a different, second frequency (e.g., "f2 current" in FIG. 17) into the rail 614B ("Rail 2" in FIG. 17). Optionally, the application units 908 (e.g., application units 908A, 908B) may inject signals having the same frequencies but different identifiers included therein into the rails 614A, 614B. In contrast to the example shown in FIG. 14, the application unit 908A and the detection unit 910B may be conductively and/or inductively coupled with the same rail 614A while the application unit 908B and the detection unit 910A are conductively and/or inductively coupled with the other rail 614B. Alternatively, the application unit 908A and the detection unit 910A may be conductively and/or inductively coupled with different rails 614A, 614B and/or the application unit 908B and the detection unit 910B may be conductively and/or inductively coupled with different rails 614A, 614B.

Figure 18:
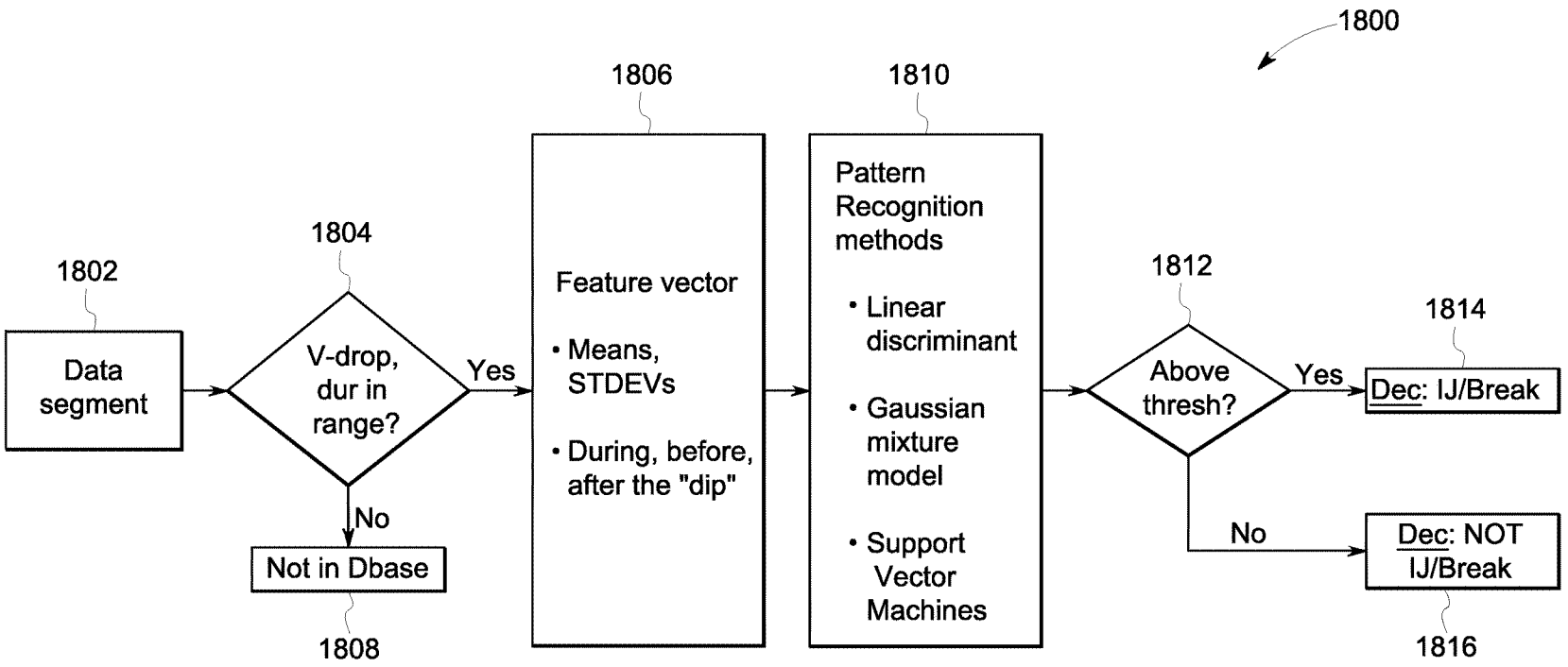
FIG. 18 illustrates a flowchart of one embodiment of a method for examining a route.
Figure 19:
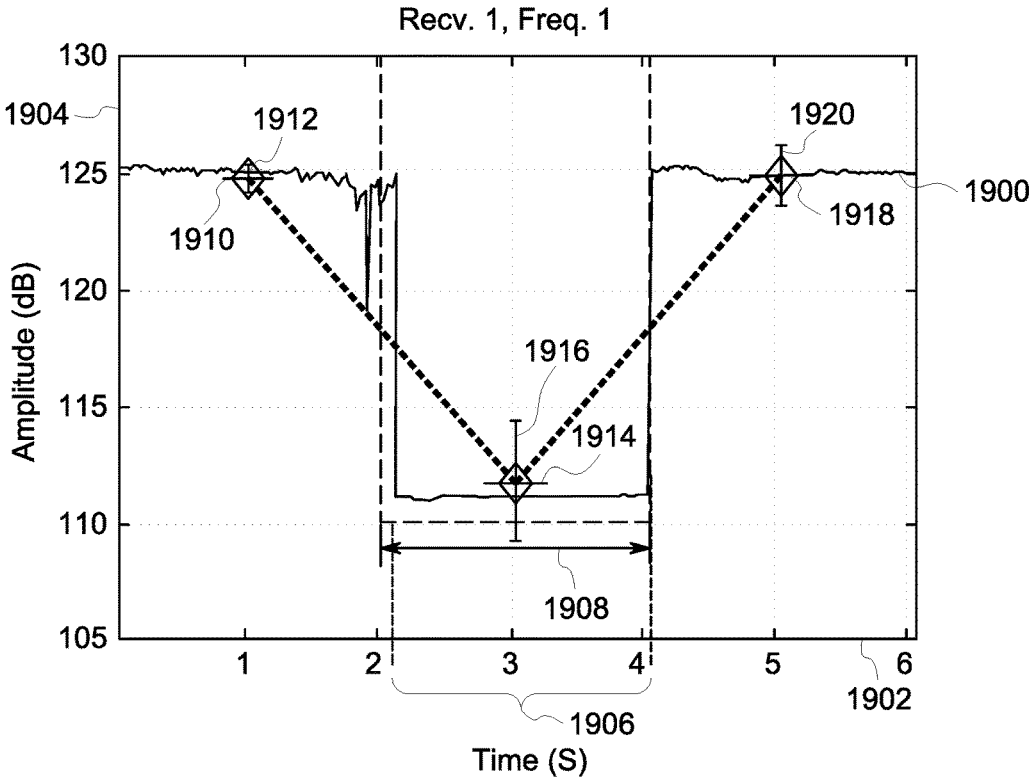
FIG. 19 illustrates an example of electrical characteristics measured by the detection units shown in FIG. 17.
Figure 20:
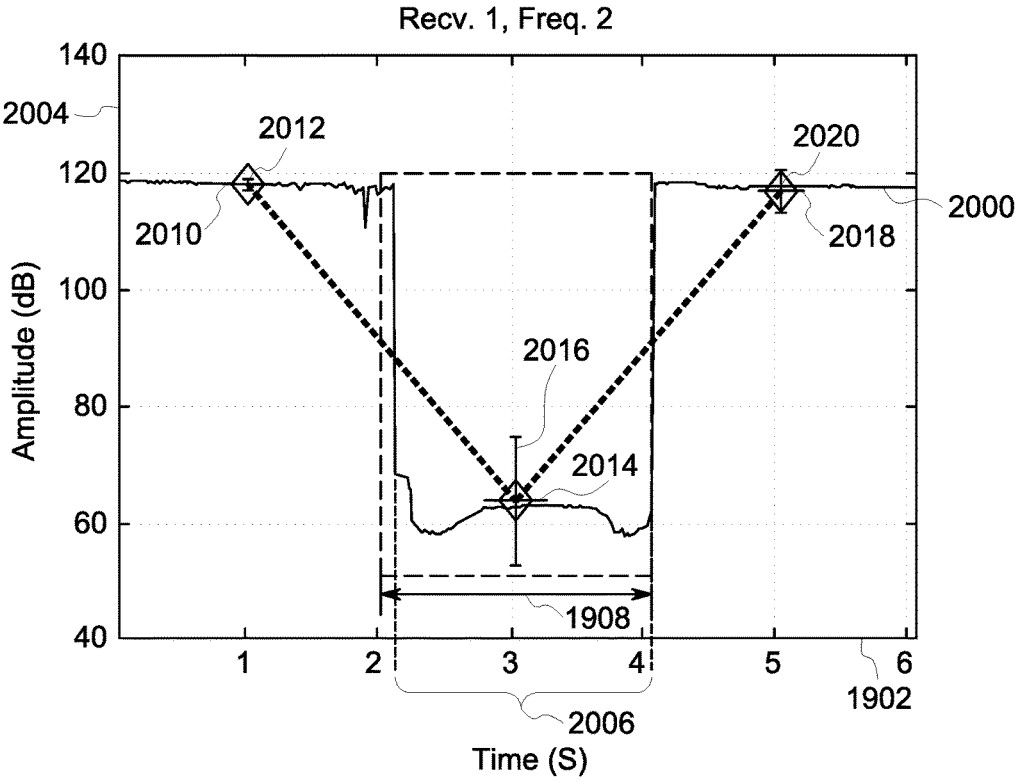
FIG. 20 illustrates an example of electrical characteristics measured by the detection units shown in FIG. 17.
Figure 21:
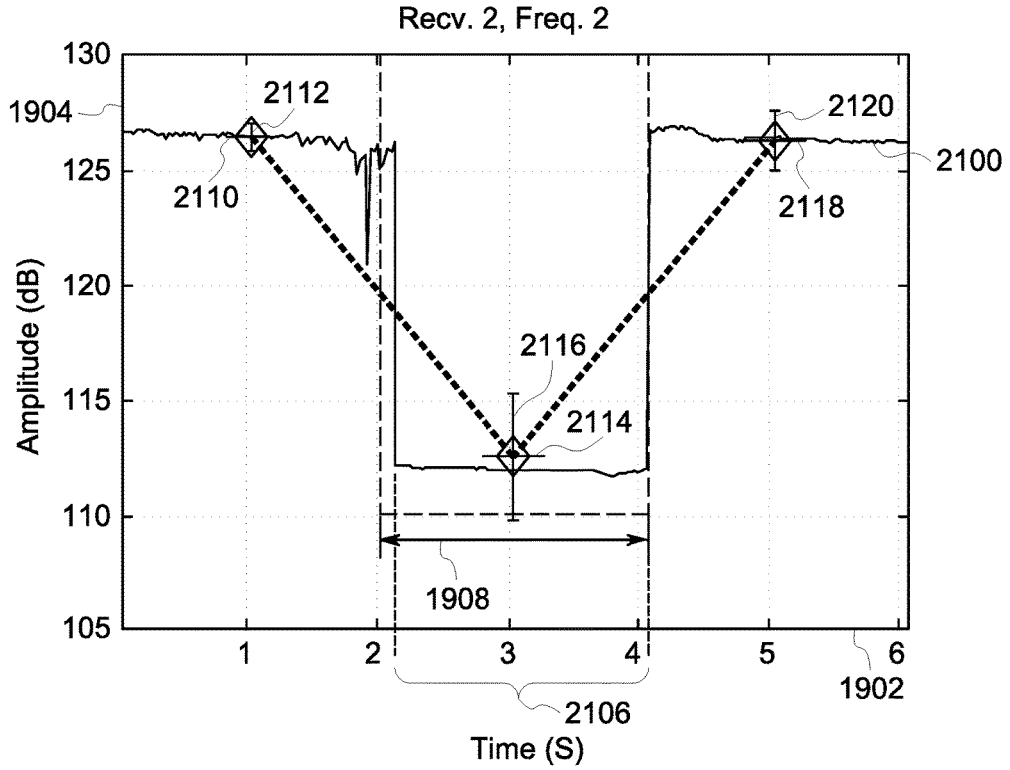
FIG. 21 illustrates an example of electrical characteristics measured by the detection units shown in FIG. 17.
Figure 22:
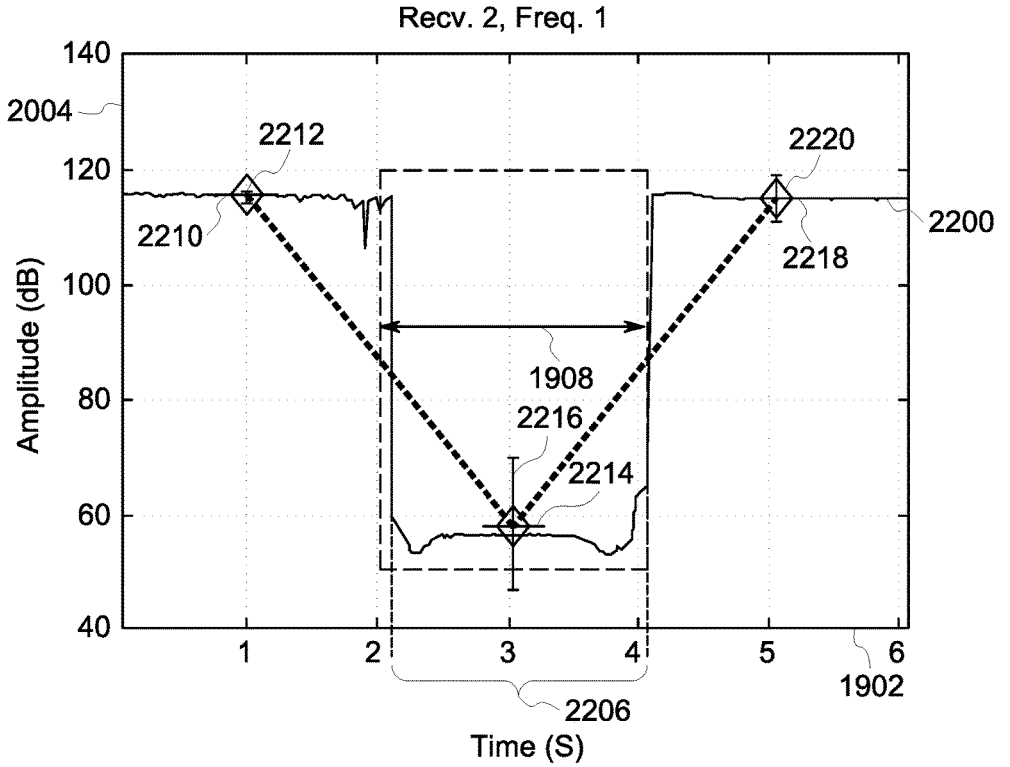
FIG. 22 illustrates an example of electrical characteristics measured by the detection units shown in FIG. 17.

FIG. 18 illustrates a flowchart of one embodiment of a method 1800 for examining a route. The method 1800 may be performed by one or more embodiments of the route examining systems described herein to identify damage to the routes, insulated joints in the routes, shunts across the rails of the routes, or the like. For example, the identification unit 220, 1816 can perform the analysis of the electrical characteristics and patterns as described herein.

At 1802, a data segment is obtained. The data segment can include the electrical characteristics measured by the detection units 910A, 910B. For example, the data segment can include magnitudes of current and/or voltage as measured by the detection units 910A, 910B for two or more different frequencies (e.g., frequency 1 and frequency 2).

With continued reference to the flowchart of the method 1800 shown in FIG. 18, FIGS. 19 through 22 illustrate examples of electrical characteristics 1900, 2000, 2100, 2200 measured by the detection units 910 shown in FIG. 17. The electrical characteristics 1900, 2000, 2100, 2200 are shown alongside a horizontal axis 1902 representative of time and vertical axes 1904, 2004 representative of magnitudes of the electrical characteristics 1900, 2000, 2100, 2200. The electrical characteristics 1900 can represent the electrical characteristics of the rail 614B (shown in FIG. 17) as measured by the detection unit 910A (shown in FIG. 17) based on injection of the examination signal having the first frequency and injected into the rail 614A (shown in FIG. 17) by the application unit 908A (shown in FIG. 17). The electrical characteristics 2000 can represent the electrical characteristics of the rail 614B as measured by the detection unit 910A based on injection of the examination signal having the second frequency and injected into the rail 614B by the application unit 908B (shown in FIG. 17). The electrical characteristics 2100 can represent the electrical characteristics of the rail 614A as measured by the detection unit 910B based on injection of the examination signal having the second frequency and injected into the rail 614B by the application unit 908B. The electrical characteristics 2200 can represent the electrical characteristics of the rail 614A as measured by the detection unit 910B based on injection of the examination signal having the first frequency and injected into the rail 614A by the application unit 908A.

One or more indices of the electrical characteristics 1900, 2000, 2100, 2200 measured by the different detection units 910 based on different frequencies (or other different identifiers) can be determined and examined in order to differentiate between noise in the electrical characteristics and electrical characteristics representative of travel over insulated joints, damaged sections of the route 904 (shown in FIG. 17), shunts across the rails 614 of the route 904, or the like.

At 1804 in the flowchart of the method 1800 shown in FIG. 18, a determination is made as to whether a change in the electrical characteristics 1900, 2000, 2100, 2200 indicates a break or insulated joint in the route. This determination may be made by determining whether the change in the electrical characteristics 1900, 2000, 2100, 2200 exceeds a designated threshold and/or whether a time period over which the change in the electrical characteristics 1900, 2000, 2100, 2200 occurs is within a designated time period. For example, the electrical characteristics 1900, 2000, 2100, 2200 can be examined to determine if decreases in the electrical characteristics 1900, 2000, 2100, 2200 exceed a designated drop threshold (e.g., 50 dB, 40 dB, 30 dB, 10%, 20%, 30%, or the like). In the illustrated examples, all of the electrical characteristics 1900, 2000, 2100, 2200 decrease by more than the designated drop threshold at or near two seconds along the horizontal axis 1902 and then increase at approximately four seconds along the horizontal axis 1902.

The drops in the electrical characteristics 1900, 2000, 2100, 2200 and/or the time periods over which the drops occur may be indices of the electrical characteristics 1900, 2000, 2100, 2200 that are examined in order to determine whether the route includes a break in conductivity (e.g., damage to the route, an insulated joint in the route, or the like). The drops in the electrical characteristics 1900, 2000, 2100, 2200 can be examined to determine drop time periods 1906, 2006, 2106, 2206 over which the drops in the electrical characteristics 1900, 2000, 2100, 2200 occur. For example, the time periods 1906, 2006, 2106, 2206 may be measured from a time when the electrical characteristics 1900, 2000, 2100, 2200 decrease by at least the designated drop threshold to a subsequent time when the electrical characteristics 1900, 2000, 2100, 2200 increase by at least the designated drop threshold. The time periods 1906, 2006, 2106, 2206 of the drops (which may be referred to herein as drop time periods) can be compared to one or more designated time periods 1908. In the illustrated embodiment, the drop time periods 1906, 2006, 2106, 2206 are compared to the same designated time period 1908 of approximately two seconds, but alternatively, the drop time periods 1906, 2006, 2106, 2206 may be compared to different designated time periods 1908 and/or a designated time period 1908 of other than two seconds. In one aspect, the designated time period 1908 may change based on the moving speed of the vehicle or vehicles on which the detection units 910 are disposed. For faster moving vehicles, the designated time period 1908 can decrease and for slower moving vehicles, the designated time period 1908 may increase.

In one embodiment, if all of the electrical characteristics 1900, 2000, 2100, 2200 decrease by at least the designated drop threshold for time periods 1906, 2006, 2106, 2206 that are no longer or no greater than the designated time period 1908, then the electrical characteristics 1900, 2000, 2100, 2200 may be indicative of a conductive break in the route, such as damage to the route, an insulated joint in the route, or the like. Optionally, if at least a designated threshold or percentage (e.g., at least 75%, at least 50%, etc.) of the electrical characteristics 1900, 2000, 2100, 2200 decrease by at least the designated drop threshold for time periods 1906, 2006, 2106, 2206 that are no longer or no greater than the designated time period 1908, then the electrical characteristics 1900, 2000, 2100, 2200 may be indicative of a conductive break in the route, such as damage to the route, an insulated joint in the route, or the like. As a result, flow of the method 1800 can proceed toward 1806 for further examination of the electrical characteristics 1900, 2000, 2100, 2200.

But, if the electrical characteristics 1900, 2000, 2100, 2200 (or at least a designated threshold of the electrical characteristics 1900, 2000, 2100, 2200) do not decrease by at least the designated drop threshold and/or within a time period no longer or no greater than the designated time period 1908, then the electrical characteristics 1900, 2000, 2100, 2200 may not be indicative of a break in the conductivity of the route. As a result, flow of the method 1800 can proceed toward 1808.

At 1808, a determination is made that the electrical characteristics 1900, 2000, 2100, 2200 are not representative of a break in the electrical conductivity of the route. For example, the electrical characteristics 1900, 2000, 2100, 2200 may not indicate a break in the route, damage to the route, an insulated joint or segment in the route, or the like. Flow of the method 1800 may then terminate or return to 1802 to obtain and examine additional electrical characteristics.

At 1806, the electrical characteristics may be examined to ensure that the detection of the break or insulated joint is not false-positive detection. The electrical characteristics can be further analyzed to check on whether detection of the break or insulated joint at 1804 is not indicative of another condition, such as oil or other debris on the route, reduced conductivity between the wheels of the vehicle and the route, etc. This additional check on the electrical characteristics can significantly reduce the number of times that a break or insulated joint in a rail is incorrectly identified.

In one aspect, one or more feature vectors are determined based on the electrical characteristics 1900, 2000, 2100, 2200. The feature vectors also may be referred to as indices of the electrical characteristics 1900, 2000, 2100, 2200. The feature vector for an electrical characteristic 1900, 2000, 2100, 2200 can include multiple measurements or calculations derived from the electrical characteristic 1900, 2000, 2100, 2200. In one embodiment, several feature vectors are calculated for each electrical characteristic 1900, 2000, 2100, 2200.

The feature vectors calculated for an electrical characteristic 1900, 2000, 2100, 2200 can include one or more statistical measures of the electrical characteristic. A statistical measure can include a mean or median value 1910, 2010, 2110, 2210 of the electrical characteristic 1900, 2000, 2100, 2200 prior to the decrease in the electrical characteristic 1900, 2000, 2100, 2200 by more than the designated drop threshold. The feature vectors also can include a statistical measure, such as a standard deviation 1912, 2012, 2112, 2212 or other measurement representative of how much the electrical characteristic 1900, 2000, 2100, 2200 varies prior to the decrease in the electrical characteristic 1900, 2000, 2100, 2200 by more than the designated drop threshold.

The time period over which the mean or median values 1910, 2010, 2110, 2210 are calculated for the electrical characteristics 1900, 2000, 2100, 2200 and/or the standard deviations 1912, 2012, 2112, 2212 can include a time period that is as long as the drop time period 1906. Alternatively, these values may be calculated over longer or shorter time periods.

The feature vectors calculated for an electrical characteristic 1900, 2000, 2100, 2200 can include a statistical measure, such as a mean or median value 1914, 2014, 2114, 2214 of the electrical characteristic 1900, 2000, 2100, 2200, within the drop time periods 1906, 2006, 2106, 2206. The feature vectors also can include a statistical measure, such as a standard deviation 1916, 2016, 2116, 2216 or other measurement representative of how much the electrical characteristic 1900, 2000, 2100, 2200 varies during the drop time periods 1906, 2006, 2106, 2206.

The feature vectors calculated for an electrical characteristic 1900, 2000, 2100, 2200 can include statistical measure, such as a mean or median value 1918, 2018, 2118, 2218 of the electrical characteristic 1900, 2000, 2100, 2200 after the drop time periods 1906, 2006, 2106, 2206. The feature vectors also can include a statistical measure, such as a standard deviation 1920, 2020, 2120, 2220 or other measurement representative of how much the electrical characteristic 1900, 2000, 2100, 2200 varies after the drop time periods 1906, 2006, 2106, 2206.

The time period over which the mean or median values 1918, 2018, 2118, 2218 are calculated for the electrical characteristics 1900, 2000, 2100, 2200 and/or the standard deviations 1920, 2020, 2120, 2220 can include a time period that is as long as the drop time period 1906. Alternatively, these values may be calculated over longer or shorter time periods.

The statistical measures can include means and/or median values, as described herein, but optionally may include other statistical calculations of the electrical characteristics. For example, medians, root mean square values, or the like, may be calculated and included in the feature vectors. The statistical measures that are calculated for the electrical characteristics can be the indices of the electrical characteristics that are examined in order to determine if the electrical characteristics are representative of travel over a break in the conductivity of the route. These indices represent the feature vectors of the electrical characteristics. In one embodiment, a combination of the mean or median value of an electrical characteristic prior to the decrease by more than the drop threshold and the standard deviation of the same electrical characteristic prior to the decrease by more than the drop threshold is a first feature vector of that electrical characteristic. This first feature vector can be referred to as pre-drop feature vector. A combination of the mean or median value of an electrical characteristic during the drop time period and the standard deviation of the same electrical characteristic during the drop time period is a second feature vector of that electrical characteristic. This second feature vector can be referred to as drop feature vector. A combination of the mean or median value of an electrical characteristic after the increase from the drop time period and the standard deviation of the same electrical characteristic after the increase from the drop time period is a third feature vector of that electrical characteristic. This third feature vector can be referred to as post-drop feature vector. If four electrical characteristics are monitored (e.g., voltages associated with injected currents having two different frequencies as sensed by two different detection units), then there can be twelve feature vectors (e.g., three feature vectors per electrical signal). Alternatively, a different number of feature vectors may be determined, or a single feature vector may be determined. The feature vectors for the electrical signals being monitored can be referred to as a set of feature vectors.

In one aspect, the values of the feature vectors may be multiplied by a constant value. The constant value may be based on the number of electrical characteristics being monitored. For example, if four electrical characteristics are being monitored, then the values of the feature vectors for all four electrical characteristics may be multiplied by four. Alternatively, the values of the feature vectors may be multiplied by another constant, or may not be multiplied by a constant.

At 1810, the set of feature vectors are compared to one or more patterns of feature vectors. The patterns can represent different conditions of the route. A first feature pattern can include feature vectors representative of travel over a break in a rail of the route. A different, second feature pattern can include feature vectors representative of travel over an insulated joint in the route. A different, third feature pattern can include feature vectors representative of travel over a shunt that conductively couples the rails of the route. A different, fourth feature pattern can include feature vectors representative of travel over a crossing between routes. One or more other patterns may be used.

The set of feature vectors can be compared to the patterns of the feature vectors to determine which, if any, of the patterns of the feature vectors that the set of feature vectors matches (or matches more closely than one or more other patterns). In aspect, linear discriminant analysis is used to compare the set of feature vectors with the patterns. The analysis can be used to find a linear combination of feature vectors that matches, or more closely matches, the set of feature vectors, than one or more other linear combination of the feature vectors. Different linear combinations of feature vectors can be the different patterns of the feature vectors. The linear combination that matches or more closely matches the set of feature vectors than one or more other linear combinations may be identified as a matching pattern of feature vectors.

In another aspect, a Gaussian mixture model may be used to determine if the set of feature vectors matches a pattern associated with one or more conditions of the route. The Gaussian mixture model can be used to calculate probabilities that at least a subset of the feature vectors in the set match some or all of the feature vectors associated with a pattern. Depending on the probabilities that the subset of the feature vectors in the set match some or all feature vectors of different patterns, a pattern may be selected to identify the condition of the route.

In another aspect, one or more support vector machines may be used to determine which pattern is matched by or more closely matched by the set of feature vectors than one or more (or all) other patterns. The support vector machine analysis can involve one or more processors (e.g., of the identification unit 520 shown in FIG. 5) examining feature vectors that are previously associated as being representative or indicative of different conditions of the route. The support vector machine analysis constructs categories of different feature vectors, with the categories associated with the different route conditions. The support vector machine analysis then examines the set of feature vectors to determine which of these categories that the set of feature vectors more closely matches than other categories. The condition of the route may then be identified based on this category.

Optionally, another technique may be used to determine if the set of feature vector matches or more closely matches a pattern of feature vectors.

Figure 23:
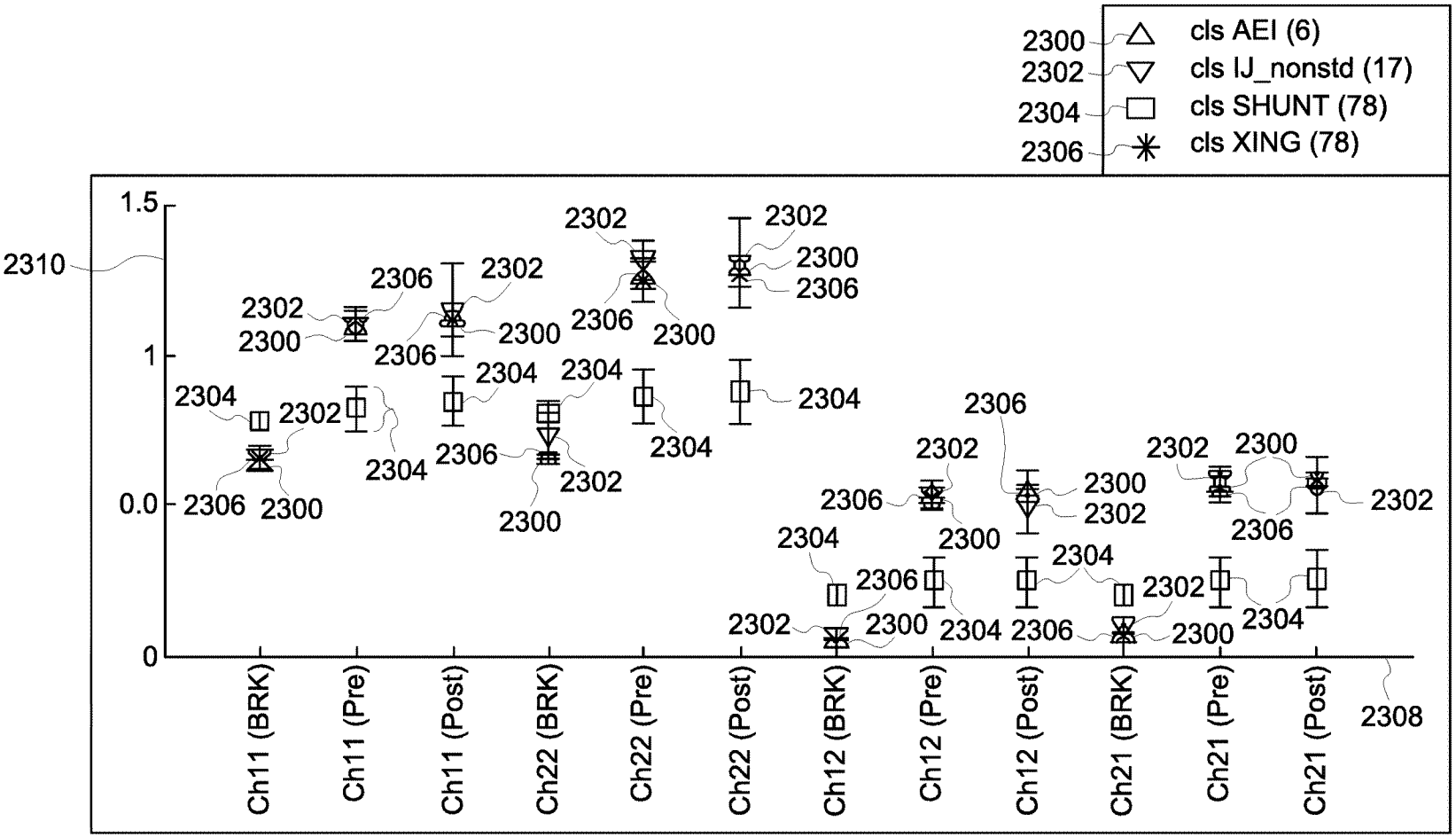
FIG. 23 illustrates examples of feature vectors included in different patterns representative of different conditions of the route.

FIG. 23 illustrates examples of feature vectors 2300, 2302, 2304, 2306 included in different patterns representative of different conditions of the route. The patterns include different values for the feature vectors 2300, 2302, 2304, 2306 associated with the different electrical characteristics being measured. The feature vectors 2300, 2302, 2304, 2306 (e.g., means and standard deviations) are shown alongside a horizontal axis 2308 a vertical axis 2310. The horizontal axis 2308 represents the different electrical characteristics and the vertical axis 2310 represents the values of the feature vectors included in the different patterns 2300, 2302, 2304, 2306.

The feature vectors 2300, 2302, 2304, 2306 are shown in columns associated with different electrical characteristics and different time periods. Along the horizontal axis 2308, the feature vectors 2300, 2302, 2304, 2306 above "Ch11 (BRK)" represent the feature vectors 2300, 2302, 2304, 2306 (e.g., the means and standard deviations) calculated during the drop time period for electrical characteristics measured by the first detection unit 910A based on the signal injected into the rail with the first frequency. The feature vectors 2300, 2302, 2304, 2306 above "Ch11 (Pre)" represent the feature vectors 2300, 2302, 2304, 2306 (e.g., the means and standard deviations) calculated for the time prior to the drop time period for electrical characteristics measured by the first detection unit 910A based on the signal injected into the rail with the first frequency. The feature vectors 2300, 2302, 2304, 2306 above "Ch11 (Post)" represent the feature vectors 2300, 2302, 2304, 2306 (e.g., the means and standard deviations) calculated for the time after the drop time period for electrical characteristics measured by the first detection unit 910A based on the signal injected into the rail with the first frequency.

The feature vectors 2300, 2302, 2304, 2306 above "Ch22 (BRK)" represent the feature vectors 2300, 2302, 2304, 2306 (e.g., the means and standard deviations) calculated during the drop time period for electrical characteristics measured by the second detection unit 910B based on the signal injected into the rail with the second frequency. The feature vectors 2300, 2302, 2304, 2306 above "Ch22 (Pre)" represent the feature vectors 2300, 2302, 2304, 2306 (e.g., the means and standard deviations) calculated for the time prior to the drop time period for electrical characteristics measured by the second detection unit 910B based on the signal injected into the rail with the second frequency. The feature vectors 2300, 2302, 2304, 2306 above "Ch22 (Post)" represent the feature vectors 2300, 2302, 2304, 2306 (e.g., the means and standard deviations) calculated for the time after the drop time period for electrical characteristics measured by the second detection unit 910B based on the signal injected into the rail with the second frequency.

The feature vectors 2300, 2302, 2304, 2306 above "Ch12 (BRK)" represent the feature vectors 2300, 2302, 2304, 2306 (e.g., the means and standard deviations) calculated during the drop time period for electrical characteristics measured by the first detection unit 910A based on the signal injected into the rail with the second frequency. The feature vectors 2300, 2302, 2304, 2306 above "Ch12 (Pre)" represent the feature vectors 2300, 2302, 2304, 2306 (e.g., the means and standard deviations) calculated for the time prior to the drop time period for electrical characteristics measured by the first detection unit 910A based on the signal injected into the rail with the second frequency. The feature vectors 2300, 2302, 2304, 2306 above "Ch12 (Post)" represent the feature vectors 2300, 2302, 2304, 2306 (e.g., the means and standard deviations) calculated for the time after the drop time period for electrical characteristics measured by the first detection unit 910A based on the signal injected into the rail with the second frequency.

The feature vectors 2300, 2302, 2304, 2306 above "Ch21 (BRK)" represent the feature vectors 2300, 2302, 2304, 2306 (e.g., the means and standard deviations) calculated during the drop time period for electrical characteristics measured by the second detection unit 910B based on the signal injected into the rail with the first frequency. The feature vectors 2300, 2302, 2304, 2306 above "Ch21 (Pre)" represent the feature vectors 2300, 2302, 2304, 2306 (e.g., the means and standard deviations) calculated for the time prior to the drop time period for electrical characteristics measured by the second detection unit 910B based on the signal injected into the rail with the first frequency. The feature vectors 2300, 2302, 2304, 2306 above "Ch21 (Post)" represent the feature vectors 2300, 2302, 2304, 2306 (e.g., the means and standard deviations) calculated for the time after the drop time period for electrical characteristics measured by the second detection unit 910B based on the signal injected into the rail with the first frequency.

The feature vectors 2300 for each of the different time periods and the electrical characteristics represent a first pattern indicative of travel over a break in a rail of the route. For example, the values of the mean and standard deviation for the feature vectors 2300 above Ch11 (BRK), Ch11 (Pre), Ch11 (Post), Ch22 (BRK), Ch22 (Pre), Ch22 (Post), Ch12 (BRK), Ch12 (Pre), Ch12 (Post), Ch21 (BRK), Ch21 (Pre), and Ch22 (Post) are included in the first pattern.

The feature vectors 2302 for each of the different time periods and the electrical characteristics represent a second pattern indicative of travel over an insulated joint in a rail of the route. For example, the values of the mean and standard deviation for the feature vectors 2302 above Ch11 (BRK), Ch11 (Pre), Ch11 (Post), Ch22 (BRK), Ch22 (Pre), Ch22 (Post), Ch12 (BRK), Ch12 (Pre), Ch12 (Post), Ch21 (BRK), Ch21 (Pre), and Ch22 (Post) are included in the second pattern.

The feature vectors 2304 for each of the different time periods and the electrical characteristics represent a third pattern indicative of travel over a shunt between rails of the route. For example, the values of the mean and standard deviation for the feature vectors 2304 above Ch11 (BRK), Ch11 (Pre), Ch11 (Post), Ch22 (BRK), Ch22 (Pre), Ch22 (Post), Ch12 (BRK), Ch12 (Pre), Ch12 (Post), Ch21 (BRK), Ch21 (Pre), and Ch22 (Post) are included in the third pattern.

The feature vectors 2306 for each of the different time periods and the electrical characteristics represent a fourth pattern indicative of travel over a crossing between routes. For example, the values of the mean and standard deviation for the feature vectors 2306 above Ch11 (BRK), Ch11 (Pre), Ch11 (Post), Ch22 (BRK), Ch22 (Pre), Ch22 (Post), Ch12 (BRK), Ch12 (Pre), Ch12 (Post), Ch21 (BRK), Ch21 (Pre), and Ch22 (Post) are included in the fourth pattern.

Returning to the description of the flowchart of the method 1800 shown in FIG. 18, at 1812, a determination is made as to whether the set of feature vectors calculated for the electrical characteristics being monitored for a vehicle match the feature vectors of a pattern. If the values of the feature vectors in the set match or are within a designated range of the feature vectors of a pattern, then the set of feature vectors match the pattern. In one embodiment, a degree of match between the set of feature vectors and the feature vectors of a pattern is calculated. The closer that the values of the feature vectors in the set are to the values of the feature vectors in the pattern, the larger of a value of the degree of match. The degree of match may be compared to one or more thresholds, such as 70%, 80%, 90%, or the like.

In one embodiment, the patterns to which the feature vectors are compared represent a break in the rail of a route or an insulated joint. If the degree of match exceeds the threshold, then the set of feature vectors may be identified as matching the pattern. As a result, the set of feature vectors may indicate that the route includes a break in a rail or an insulated joint, and flow of the method 1800 can proceed toward 1814. Otherwise, the set of feature vectors may not indicate a break or insulated joint. As a result, flow of the method 1800 can proceed toward 1816.

At 1814, a break or insulated joint in the route is identified. The break or insulated joint may be identified based on which pattern was matched or more closely matched by the set of feature vectors. Responsive to the break or insulated joint being identified, one or more responsive actions may be implemented. For example, responsive to a break being detected, the systems and methods described herein may automatically communicate one or more signals to schedule inspection or repair of the route, to slow or stop movement of the vehicle, or the like. Responsive to the insulated joint being identified, the systems and methods described herein may attempt to identify a location of the vehicle along the route, which route is being traveled by the vehicle, or the like. Flow of the method 1800 may then terminate or return to 1802 to obtain and examine additional electrical characteristics.

At 1816, a break or insulated joint in the route is not identified. For example, the set of feature vectors may not match the patterns associated with a break or insulated joint. The set of feature vectors may be representative of noise or another condition in the route other than the break or insulated joint. Flow of the method 1800 may then terminate or return to 1802 to obtain and examine additional electrical characteristics.

In one embodiment, a method (e.g., for examining a route) includes injecting a first electrical examination signal into a conductive route from onboard a vehicle system traveling along the route, detecting a first electrical characteristic of the route based on the first electrical examination signal, and detecting a break in conductivity of the route responsive to the first electrical characteristic decreasing by more than a designated drop threshold for a time period within a designated drop time period.

In one aspect, the break that is detected includes a break in a conductive rail of the route or an insulated joint in the route.

In one aspect, detecting the break includes detecting an opening in a circuit formed by wheels and axles of the vehicle system and segments of conductive rails of the route extending between the wheels of the vehicle system.

In one aspect, injecting the first electrical examination signal into the route includes injecting the first electrical examination signal having one or more of a first frequency or a first unique identifier into the route. The method also can include injecting a second electrical examination signal having one or more of a different, second frequency or a different, second unique identifier into the route.

In one aspect, the first electrical examination signal is injected into a first conductive rail of the route and the second electrical examination signal is injected into a second conductive rail of the route.

In one aspect, the first electrical characteristic of the route includes a first voltage of the first electrical examination signal as measured along the first conductive rail by a first detection unit of a route examining system onboard the vehicle system. The method also can include detecting a second voltage of the first electrical examination signal as measured along the first conductive rail by the first detection unit as a second electrical characteristic of the route, detecting a third voltage of the second electrical examination signal as measured along the second conductive rail by a second detection unit of the route examining system as a third electrical characteristic of the route, detecting a fourth voltage of the second electrical examination signal as measured along the second conductive rail by the second detection unit as a fourth electrical characteristic of the route.

In one aspect, the method also includes determining feature vectors representative of different values of each of the first, second, third, and fourth electrical characteristics, and comparing the feature vectors to one or more patterns of feature vectors associated with different conditions of the route, at least one of the patterns of feature vectors associated with the break in the conductivity of the route. The break in the conductivity of the route can be detected responsive to the first electrical characteristic decreasing by more than the designated drop threshold for the time period within the designated drop time period and responsive to the feature vectors more closely matching the at least one pattern of feature vectors associated with the break in the conductivity of the route.

In one aspect, the feature vectors are determined for each of the first, second, third, and fourth electrical characteristics. The feature vectors can include, for each of the first, second, third, and fourth electrical characteristic: a first mean and a first standard deviation of values of the respective first, second, third, or fourth electrical characteristic prior to the respective first, second, third, or fourth electrical characteristic decreasing by more than the designated drop threshold for the time period that is within the designated drop time period; a second mean and a second standard deviation of values of the respective first, second, third, or fourth electrical characteristic after the respective first, second, third, or fourth electrical characteristic decreases by more than the designated drop threshold and before the respective first, second, third, or fourth electrical characteristic increases by at least the designated drop threshold; and a third mean and a third standard deviation of values of the respective first, second, third, or fourth electrical characteristic after the respective first, second, third, or fourth electrical characteristic increases by at least the designated drop threshold.

In another embodiment, a system (e.g., a route examining system) includes a first application unit configured to inject a first electrical examination signal into a conductive route from onboard a vehicle system traveling along the route, a first detection unit configured to detect a first electrical characteristic of the route based on the first electrical examination signal, and one or more processors configured to detect a break in conductivity of the route responsive to the first electrical characteristic decreasing by more than a designated drop threshold for a time period within a designated drop time period.

In one aspect, the break that is detected by the one or more processors includes a break in a conductive rail of the route or an insulated joint in the route.

In one aspect, the one or more processors are configured to detect the break by detecting an opening in a circuit formed by wheels and axles of the vehicle system and segments of conductive rails of the route extending between the wheels of the vehicle system.

In one aspect, the first application unit is configured to inject the first electrical examination signal into the route by injecting the first electrical examination signal having one or more of a first frequency or a first unique identifier into the route. The system also can include a second application unit configured to inject a second electrical examination signal having one or more of a different, second frequency or a different, second unique identifier into the route.

In one aspect, the first application unit is configured to inject the first electrical examination signal into a first conductive rail of the route and the second application unit is configured to inject the second electrical examination signal into a second conductive rail of the route.

In one aspect, the first detection unit is configured to measure the first electrical characteristic of the route as a first voltage of the first electrical examination signal measured along the first conductive rail. The first detection unit can be configured to measure a second voltage of the first electrical examination signal along the first conductive rail by the first detection unit as a second electrical characteristic of the route. The system also can include a second detection unit configured to measure a third voltage of the second electrical examination signal along the second conductive rail as a third electrical characteristic of the route. The second detection unit also can be configured to measure a fourth voltage of the second electrical examination signal along the second conductive rail as a fourth electrical characteristic of the route.

In one aspect, the one or more processors are configured to determine feature vectors representative of different values of each of the first, second, third, and fourth electrical characteristics, and to compare the feature vectors to one or more patterns of feature vectors associated with different conditions of the route, at least one of the patterns of feature vectors associated with the break in the conductivity of the route. The one or more processors can be configured to detect the break in the conductivity of the route responsive to the first electrical characteristic decreasing by more than the designated drop threshold for the time period within the designated drop time period and responsive to the feature vectors more closely matching the at least one pattern of feature vectors associated with the break in the conductivity of the route.

In one aspect, the one or more processors are configured to determine the feature vectors for each of the first, second, third, and fourth electrical characteristics as including: a first mean and a first standard deviation of values of the respective first, second, third, or fourth electrical characteristic prior to the respective first, second, third, or fourth electrical characteristic decreasing by more than the designated drop threshold for the time period that is within the designated drop time period; a second mean and a second standard deviation of values of the respective first, second, third, or fourth electrical characteristic after the respective first, second, third, or fourth electrical characteristic decreases by more than the designated drop threshold and before the respective first, second, third, or fourth electrical characteristic increases by at least the designated drop threshold; and a third mean and a third standard deviation of values of the respective first, second, third, or fourth electrical characteristic after the respective first, second, third, or fourth electrical characteristic increases by at least the designated drop threshold.

In another embodiment, a system (e.g., a route examining system) includes first and second application units, first and second detection units, and one or more processors. The first application unit is configured to be disposed onboard a vehicle traveling along a route having plural conductive rails. The first application unit is configured to inject a first electrical examination signal having one or more of a first frequency or a first unique identifier into a first rail of the plural conductive rails. The second application unit is configured to be disposed onboard the vehicle and to inject a second electrical examination signal having one or more of a different, second frequency or a different, second unique identifier into a second rail of the plural conductive rails. The first detection unit is configured to be disposed onboard the vehicle and to measure a first electrical characteristic of the first rail based on the first electrical examination signal and to measure a second electrical characteristic of the first rail based on the second electrical examination signal. The second detection unit is configured to be disposed onboard the vehicle and to measure a third electrical characteristic of the second rail based on the first electrical examination signal and to measure a fourth electrical characteristic of the second rail based on the second electrical examination signal. The one or more processors are configured to detect a break in conductivity of one or more of the first rail or the second rail of the route responsive to one or more of the first electrical characteristic, the second electrical characteristic, the third electrical characteristic, or the fourth electrical characteristic decreasing by more than a designated drop threshold for a time period that is within a designated drop time period.

In one aspect, the one or more processors are configured to detect the break by detecting an opening in a circuit formed by wheels and axles of the vehicle system and segments of the first and second rails of the route extending between the wheels of the vehicle system.

In one aspect, the one or more processors are configured to determine feature vectors representative of different values of each of the first, second, third, and fourth electrical characteristics and to compare the feature vectors to one or more patterns of feature vectors associated with different conditions of the route, at least one of the patterns of feature vectors associated with the break in the conductivity of the route. The one or more processors can be configured to detect the break in the conductivity of one or more of the first rail or the second rail responsive to the first electrical characteristic decreasing by more than the designated drop threshold for the time period within the designated drop time period and responsive to the feature vectors more closely matching the at least one pattern of feature vectors associated with the break in the conductivity of one or more of the first rail or the second rail.

In one aspect, the one or more processors are configured to determine the feature vectors for each of the first, second, third, and fourth electrical characteristics. The feature vectors can include, for each of the first, second, third, and fourth electrical characteristic: a first mean and a first standard deviation of values of the respective first, second, third, or fourth electrical characteristic prior to the respective first, second, third, or fourth electrical characteristic decreasing by more than the designated drop threshold for the time period that is within the designated drop time period; a second mean and a second standard deviation of values of the respective first, second, third, or fourth electrical characteristic after the respective first, second, third, or fourth electrical characteristic decreases by more than the designated drop threshold and before the respective first, second, third, or fourth electrical characteristic increases by at least the designated drop threshold; and a third mean and a third standard deviation of values of the respective first, second, third, or fourth electrical characteristic after the respective first, second, third, or fourth electrical characteristic increases by at least the designated drop threshold.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A system comprising:

a power source coupled to a conditioning circuit, a first conductive body, and a third conductive body, wherein the first conductive body is configured to inject a first electrical examination signal into a first conductive rail of a route from onboard a vehicle system traveling along the route and wherein the third conductive body is configured to inject a second electrical examination signal into a second conductive rail of the route;

a second conductive body configured to detect a first electrical characteristic of the route based on the first electrical examination signal as a first voltage of the first electrical examination signal measured along the first conductive rail, and wherein the second conductive body is configured to measure a second voltage of the second electrical examination signal along the first conductive rail by the second conductive body as a second electrical characteristic of the route;

a fourth conductive body configured to measure a third voltage of the first electrical examination signal along the second conductive rail as a third electrical characteristic of the route, wherein the fourth conductive body also is configured to measure a fourth voltage of the second electrical examination signal along the second conductive rail as a fourth electrical characteristic of the route; and one or more processors configured to detect a break in conductivity of the route responsive to the first electrical characteristic decreasing by more than a designated drop threshold for a time period within a designated drop time period;

wherein each of the first, second and the third conductive body includes a conductive shoe or a conductive brush that slides along a surface of a track or an outer circumference of a wheel or an inductive circuit.

2. The system of claim 1, wherein the break that is detected by the one or more processors includes a break in a conductive rail of the route or an insulated joint in the route.

3. The system of claim 1, wherein the one or more processors are configured to detect the break by detecting an opening in a circuit formed by wheels and axles of the vehicle system and segments of conductive rails of the route extending between the wheels of the vehicle system.

4. The system of claim 1, wherein the first conductive body is configured to inject the first electrical examination signal into the route by injecting the first electrical examination signal having one or more of a first frequency or a first unique identifier into the route, and the third conductive body is configured to inject the second electrical examination signal into the route by injecting the second electrical examination signal having one or more of a different, second frequency or a different, second unique identifier into the route.

5. The system of claim 1, wherein the one or more processors are configured to determine feature vectors representative of different values of each of the first, second, third, and fourth electrical characteristics, and to compare the feature vectors to one or more patterns of feature vectors associated with different conditions of the route, at least one of the patterns of feature vectors associated with the break in the conductivity of the route, the one or more processors are configured to detect the break in the conductivity of the route responsive to the first electrical characteristic decreasing by more than the designated drop threshold for the time period within the designated drop time period and responsive to the feature vectors more closely matching the at least one pattern of feature vectors associated with the break in the conductivity of the route.

6. The system of claim 5, wherein the one or more processors are configured to determine the feature vectors for each of the first, second, third, and fourth electrical characteristics as including:

a first statistical measure of values of the respective first, second, third, or fourth electrical characteristic prior to the respective first, second, third, or fourth electrical characteristic decreasing by more than the designated drop threshold for the time period that is within the designated drop time period, a second statistical measure of values of the respective first, second, third, or fourth electrical characteristic after the respective first, second, third, or fourth electrical characteristic decreases by more than the designated drop threshold and before the respective first, second, third, or fourth electrical characteristic increases by at least the designated drop threshold, and a third statistical measure of values of the respective first, second, third, or fourth electrical characteristic after the respective first, second, third, or fourth electrical characteristic increases by at least the designated drop threshold.

7. A system comprising:

a first application unit configured to be disposed onboard a vehicle traveling along a route having plural conductive rails, the first application unit configured to inject, from a power source coupled to a conditioning circuit, a first electrical examination signal having one or more of a first frequency or a first unique identifier into a first rail of the plural conductive rails;

a second application unit configured to be disposed onboard the vehicle and to inject, from the power source coupled to the conditioning circuit, a second electrical examination signal having one or more of a different, second frequency or a different, second unique identifier into a second rail of the plural conductive rails;

a first detection unit configured to be disposed onboard the vehicle and to measure a first electrical characteristic of the first rail based on the first electrical examination signal and to measure a second electrical characteristic of the first rail based on the second electrical examination signal;

a second detection unit configured to be disposed onboard the vehicle and to measure a third electrical characteristic of the second rail based on the first electrical examination signal and to measure a fourth electrical characteristic of the second rail based on the second electrical examination signal; and one or more processors configured to detect a break in conductivity of one or more of the first rail or the second rail of the route responsive to one or more of the first electrical characteristic, the second electrical characteristic, the third electrical characteristic, or the fourth electrical characteristic decreasing by more than a designated drop threshold for a time period that is within a designated drop time period;

wherein each of the first and the second application unit includes a conductive shoe or a conductive brush that slides along a surface of a track or an outer circumference of a wheel or an inductive circuit.

8. The system of claim 7, wherein the one or more processors are configured to detect the break by detecting an opening in a circuit formed by wheels and axles of the vehicle system and segments of the first and second rails of the route extending between the wheels of the vehicle system.

9. The system of claim 7, wherein the one or more processors are configured to determine feature vectors representative of different values of each of the first, second, third, and fourth electrical characteristics and to compare the feature vectors to one or more patterns of feature vectors associated with different conditions of the route, at least one of the patterns of feature vectors associated with the break in the conductivity of the route, wherein the one or more processors are configured to detect the break in the conductivity of one or more of the first rail or the second rail responsive to the first electrical characteristic decreasing by more than the designated drop threshold for the time period within the designated drop time period and responsive to the feature vectors more closely matching the at least one pattern of feature vectors associated with the break in the conductivity of one or more of the first rail or the second rail.

10. The system of claim 9, wherein the one or more processors are configured to determine the feature vectors for each of the first, second, third, and fourth electrical characteristics, the feature vectors including, for each of the first, second, third, and fourth electrical characteristic:

a first statistical measure of values of the respective first, second, third, or fourth electrical characteristic prior to the respective first, second, third, or fourth electrical characteristic decreasing by more than the designated drop threshold for the time period that is within the designated drop time period, a second statistical measure of values of the respective first, second, third, or fourth electrical characteristic after the respective first, second, third, or fourth electrical characteristic decreases by more than the designated drop threshold and before the respective first, second, third, or fourth electrical characteristic increases by at least the designated drop threshold, and a third statistical measure of values of the respective first, second, third, or fourth electrical characteristic after the respective first, second, third, or fourth electrical characteristic increases by at least the designated drop threshold.

11. A method comprising:

injecting a first electrical examination signal from a power source coupled to a conditioning circuit into a first conductive rail of a route from onboard a vehicle system traveling along the route;

injecting a second electrical examination signal from a power source coupled to a conditioning circuit into a second conductive rail of the route from onboard a vehicle system traveling along the route;

detecting a first electrical characteristic of the route based on the first electrical examination signal, wherein the first electrical characteristic of the route includes a first voltage of the first electrical examination signal as measured along the and first conductive rail by a first detection unit of a route examining system onboard the vehicle system;

detecting a second voltage of the second electrical examination signal as measured along the first conductive rail by the first detection unit as a second electrical characteristic of the route;

detecting a third voltage of the first electrical examination signal as measured along the second conductive rail by a second detection unit of the route examining system as a third electrical characteristic of the route;

detecting a fourth voltage of the second electrical examination signal as measured along the second conductive rail by the second detection unit as a fourth electrical characteristic of the route; and detecting a break in conductivity of the route responsive to the first electrical characteristic decreasing by more than a designated drop threshold for a time period within a designated drop time period.

12. The method of claim 11, wherein the break that is detected includes a break in a conductive rail of the route or an insulated joint in the route.

13. The method of claim 11, wherein detecting the break includes detecting an opening in a circuit formed by wheels and axles of the vehicle system and segments of conductive rails of the route extending between the wheels of the vehicle system.

14. The method of claim 11, wherein injecting the first electrical examination signal into the route includes injecting the first electrical examination signal having one or more of a first frequency or a first unique identifier into the route, and injecting the second electrical examination signal into the route includes injecting the second electrical examination signal having one or more of a different, second frequency or a different, second unique identifier into the route.

15. The method of claim 11, further comprising:

determining feature vectors representative of different values of each of the first, second, third, and fourth electrical characteristics; and comparing the feature vectors to one or more patterns of feature vectors associated with different conditions of the route, at least one of the patterns of feature vectors associated with the break in the conductivity of the route, wherein the break in the conductivity of the route is detected responsive to the first electrical characteristic decreasing by more than the designated drop threshold for the time period within the designated drop time period and responsive to the feature vectors more closely matching the at least one pattern of feature vectors associated with the break in the conductivity of the route.

16. The method of claim 15, wherein the feature vectors are determined for each of the first, second, third, and fourth electrical characteristics, the feature vectors including, for each of the first, second, third, and fourth electrical characteristic:

a first statistical measure of values of the respective first, second, third, or fourth electrical characteristic prior to the respective first, second, third, or fourth electrical characteristic decreasing by more than the designated drop threshold for the time period that is within the designated drop time period, a second statistical measure of values of the respective first, second, third, or fourth electrical characteristic after the respective first, second, third, or fourth electrical characteristic decreases by more than the designated drop threshold and before the respective first, second, third, or fourth electrical characteristic increases by at least the designated drop threshold, and a third statistical measure of values of the respective first, second, third, or fourth electrical characteristic after the respective first, second, third, or fourth electrical characteristic increases by at least the designated drop threshold.

* * * * *